US010512378B2

(12) United States Patent
Son et al.

(10) Patent No.: US 10,512,378 B2
(45) Date of Patent: Dec. 24, 2019

(54) VACUUM CLEANER

(71) Applicant: LG ELECTRONICS INC., Seoul (KR)

(72) Inventors: Jungkyu Son, Seoul (KR); Bohyun Nam, Seoul (KR); Jaeyong Park, Seoul (KR); Sehwan Bae, Seoul (KR); Jonghyun Seo, Seoul (KR); Jinwoo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/445,494

(22) Filed: Feb. 28, 2017

(65) Prior Publication Data

US 2017/0245708 A1 Aug. 31, 2017

(30) Foreign Application Priority Data

Feb. 29, 2016 (KR) ..... 10-2016-0024022
May 20, 2016 (KR) ..... 10-2016-0062452
(Continued)

(51) Int. Cl.
*A47L 5/36* (2006.01)
*A47L 9/12* (2006.01)
(Continued)

(52) U.S. Cl.
CPC ..... *A47L 5/362* (2013.01); *A47L 9/00* (2013.01); *A47L 9/009* (2013.01); *A47L 9/0081* (2013.01);
(Continued)

(58) Field of Classification Search
CPC ..... A47L 5/362; A47L 9/0081; A47L 9/009; A47L 9/102; A47L 9/12; A47L 9/242;
(Continued)

(56) References Cited

U.S. PATENT DOCUMENTS 2,811,737 A 11/1957 Hayba
4,831,683 A 5/1989 Kroll et al.
(Continued)

FOREIGN PATENT DOCUMENTS

CN 1698527 11/2005
CN 101554306 10/2009
(Continued)

OTHER PUBLICATIONS

International Search Report in International Application No. PCT/KR2017/002143, dated Jun. 27, 2017, 3 pages (with partial English translation).
(Continued)

*Primary Examiner* — Dung Van Nguyen
(74) *Attorney, Agent, or Firm* — Fish & Richardson P.C.

(57) ABSTRACT

Provided is a vacuum cleaner including a base configured to form a lower surface of a cleaner body; moving wheels provided at both side surfaces of the cleaner body and rotated for travel of the vacuum cleaner and also configured to support the cleaner body to be rotated in normal and reverse directions; and a dust container installed at a front of the moving wheels and configured to collect suctioned dust, wherein the base includes a center portion; a first half portion configured to extend to be inclined upward from a front end of the center portion; and a second half portion configured to extend to be inclined upward from a rear end of the center portion, and a rotating center of the moving wheels is located between the first half portion and the second half portion.

17 Claims, 57 Drawing Sheets

(30) Foreign Application Priority Data

Aug. 25, 2016 (KR) ..... 10-2016-0108669
Dec. 30, 2016 (KR) ..... 10-2016-0184117

(51) Int. Cl.

| | |
|---|---|
| ***A47L 9/24*** | (2006.01) |
| ***A47L 9/28*** | (2006.01) |
| ***A47L 9/00*** | (2006.01) |
| ***A47L 9/10*** | (2006.01) |
| ***A47L 9/16*** | (2006.01) |
| ***A47L 9/22*** | (2006.01) |
| ***A47L 9/32*** | (2006.01) |

(52) U.S. Cl.
CPC ..... *A47L 9/102* (2013.01); *A47L 9/106* (2013.01); *A47L 9/12* (2013.01); *A47L 9/122* (2013.01); *A47L 9/127* (2013.01); *A47L 9/1625* (2013.01); *A47L 9/1641* (2013.01); *A47L 9/1683* (2013.01); *A47L 9/1691* (2013.01); *A47L 9/22* (2013.01); *A47L 9/242* (2013.01); *A47L 9/2805* (2013.01); *A47L 9/2852* (2013.01); *A47L 9/2857* (2013.01); *A47L 9/2884* (2013.01); *A47L 9/327* (2013.01)

(58) Field of Classification Search
CPC .... A47L 9/2826; A47L 9/2852; A47L 9/2857; A47L 9/2884
See application file for complete search history.

(56) References Cited

U.S. PATENT DOCUMENTS

| | | | | |
|---|---|---|---|---|
| 4,962,453 | A | 10/1990 | Pong et al. | |
| 5,839,156 | A | 11/1998 | Park et al. | |
| 5,926,909 | A | 7/1999 | McGee et al. | |
| 5,991,972 | A | 11/1999 | Krebs et al. | |
| 6,226,830 | B1 | 5/2001 | Hendriks et al. | |
| 7,637,973 | B2 | 12/2009 | Oh et al. | |
| 8,272,854 | B2 | 9/2012 | Castronovo | |
| 8,613,125 | B2 | 12/2013 | Jeong et al. | |
| 9,089,248 | B2 | 7/2015 | Yoo | |
| 9,820,623 | B2 | 11/2017 | Ha | |
| 9,958,031 | B2 | 5/2018 | Park et al. | |
| 2003/0140444 | A1* | 7/2003 | Soejima | A47L 9/0488 15/327.2 |
| 2005/0102790 | A1 | 5/2005 | Matsuno et al. | |
| 2008/0155768 | A1 | 7/2008 | Ziegler et al. | |
| 2008/0235901 | A1 | 10/2008 | Tanaka et al. | |
| 2010/0132149 | A1 | 6/2010 | Jeong et al. | |
| 2013/0212829 | A1 | 8/2013 | Yoon et al. | |
| 2014/0359967 | A1* | 12/2014 | Park | A47L 9/10 15/347 |
| 2015/0223652 | A1 | 8/2015 | Koura et al. | |
| 2015/0320283 | A1 | 11/2015 | Lee et al. | |
| 2017/0027400 | A1 | 2/2017 | Lee et al. | |
| 2017/0245702 | A1 | 8/2017 | Son et al. | |
| 2017/0245703 | A1 | 8/2017 | Son et al. | |
| 2017/0245704 | A1 | 8/2017 | Son et al. | |
| 2017/0245705 | A1 | 8/2017 | Son et al. | |
| 2017/0245706 | A1 | 8/2017 | Son et al. | |
| 2017/0245707 | A1 | 8/2017 | Son et al. | |
| 2017/0245711 | A1 | 8/2017 | Son | |
| 2017/0245712 | A1 | 8/2017 | Son et al. | |
| 2017/0245713 | A1 | 8/2017 | Son et al. | |
| 2017/0245714 | A1 | 8/2017 | Son et al. | |
| 2017/0245715 | A1 | 8/2017 | Son et al. | |
| 2017/0245716 | A1 | 8/2017 | Son et al. | |
| 2017/0245717 | A1 | 8/2017 | Son et al. | |
| 2017/0245718 | A1 | 8/2017 | Son et al. | |
| 2017/0245719 | A1 | 8/2017 | Son et al. | |
| 2017/0273529 | A1 | 9/2017 | Chung et al. | |
| 2017/0354304 | A1 | 12/2017 | Kwak | |
| 2018/0177360 | A1 | 6/2018 | Kwak | |

FOREIGN PATENT DOCUMENTS

| | | | |
|---|---|---|---|
| CN | 102469901 | | 5/2012 |
| CN | 204169778 | | 2/2015 |
| CN | 204192512 | | 3/2015 |
| CN | 105078363 | | 11/2015 |
| DE | 102005007923 | | 8/2006 |
| DE | 102012101589 | | 8/2013 |
| EP | 319700 | A1 | 6/1991 |
| EP | 319700 | B1 | 6/1991 |
| EP | 1674009 | | 6/2006 |
| EP | 1848318 | | 10/2007 |
| EP | 2203101 | | 7/2010 |
| EP | 2063699 | B1 | 11/2010 |
| EP | 2030543 | B1 | 10/2011 |
| GB | 2402046 | | 12/2004 |
| JP | H01129819 | | 5/1989 |
| JP | H02172433 | | 7/1990 |
| JP | H06-102061 | B2 | 12/1994 |
| JP | 07236599 | A * | 9/1995 |
| JP | 7236599 | B1 | 9/1995 |
| JP | 11004787 | A * | 1/1999 |
| JP | 11004787 | B1 | 1/1999 |
| JP | 2001238828 | | 9/2001 |
| JP | 2002028121 | | 1/2002 |
| JP | 2003019095 | | 1/2003 |
| JP | 2003019097 | | 1/2003 |
| JP | 2003024249 | | 1/2003 |
| JP | 2003038404 | | 2/2003 |
| JP | 2003093302 | | 4/2003 |
| JP | 2003169771 | | 6/2003 |
| JP | 2004033628 | | 2/2004 |
| JP | 2005211462 | | 8/2005 |
| JP | 2006034763 | | 2/2006 |
| JP | 2006263310 | B1 | 10/2006 |
| JP | 2006314569 | A | 11/2006 |
| JP | 2008301851 | B1 | 12/2008 |
| JP | 2009119034 | | 6/2009 |
| JP | 2009238055 | | 10/2009 |
| JP | 2010005341 | | 1/2010 |
| JP | 4553793 | B | 9/2010 |
| JP | 2011177268 | A | 9/2011 |
| JP | 2012125660 | | 7/2012 |
| JP | 2012192006 | | 10/2012 |
| JP | 2012239582 | | 12/2012 |
| JP | 2013066620 | | 4/2013 |
| JP | 2013240599 | | 12/2013 |
| JP | 2014079454 | | 5/2014 |
| JP | 2015096132 | | 5/2015 |
| JP | 2015173673 | | 10/2015 |
| JP | 2015188490 | | 11/2015 |
| JP | 2016015974 | | 2/2016 |
| KR | 20-1989-0004031 | | 4/1989 |
| KR | 199210563 | B1 | 12/1992 |
| KR | 10-1997-0032722 | | 7/1997 |
| KR | 100449933 | | 4/1998 |
| KR | 1020010049141 | | 6/2001 |
| KR | 100876695 | | 9/2001 |
| KR | 200294697 | | 10/2002 |
| KR | 10-2005-0064945 | | 6/2005 |
| KR | 2006062196 | B1 | 6/2006 |
| KR | 10-2006-0082900 | | 7/2006 |
| KR | 2006074612 | B1 | 7/2006 |
| KR | 10-2006-0118185 | | 11/2006 |
| KR | 100640830 | | 11/2006 |
| KR | 100662282 | | 12/2006 |
| KR | 0702733 | | 4/2007 |
| KR | 100702733 | | 4/2007 |
| KR | 10-2007-0106864 | | 11/2007 |
| KR | 100807409 | | 2/2008 |
| KR | 829094 | B1 | 5/2008 |
| KR | 100831784 | | 5/2008 |
| KR | 100840889 | | 6/2008 |
| KR | 10-2008-0099370 | | 11/2008 |
| KR | 869537 | B1 | 11/2008 |
| KR | 1020080099373 | | 11/2008 |
| KR | 0876695 | | 12/2008 |
| KR | 10-2010-0019146 | | 2/2010 |
| KR | 10-2010-0021700 | | 2/2010 |

(56) References Cited

FOREIGN PATENT DOCUMENTS

| | | | |
|---|---|---|---|
| KR | 2010047638 | B1 | 5/2010 |
| KR | 10-2010-0104621 | | 9/2010 |
| KR | 10-2010-0123861 | | 11/2010 |
| KR | 2010116834 | B1 | 11/2010 |
| KR | 101026065 | | 3/2011 |
| KR | 20120004100 | | 1/2012 |
| KR | 101166285 | | 7/2012 |
| KR | 10-2012-0118643 | | 10/2012 |
| KR | 10-2013-0029852 | | 3/2013 |
| KR | 10-2014-0144568 | | 12/2014 |
| KR | 101495732 | | 2/2015 |
| KR | 10-2015-0031304 | | 3/2015 |
| KR | 2015033554 | B1 | 5/2015 |
| KR | 101524797 | | 6/2015 |
| KR | 101552437 | | 9/2015 |
| KR | 1666902 | B1 | 10/2016 |
| KR | 2017000071 | B1 | 1/2017 |
| TW | 529406 | | 4/2003 |
| TW | 572746 | | 1/2004 |
| TW | I240622 | | 10/2005 |
| TW | 201402058 | | 1/2014 |
| TW | 201513821 | | 4/2015 |
| WO | WO2004032696 | | 4/2004 |
| WO | WO2009022759 | | 2/2009 |
| WO | 2010128922 | | 11/2010 |
| WO | 2016208944 | A | 12/2016 |

OTHER PUBLICATIONS

International Search Report in International Application No. PCT/KR2017/001335, dated Apr. 26, 2017, 3 pages (with partial English translation).
International Search Report in International Application No. PCT/KR2017/002148, dated Jul. 6, 2017, 3 pages (with partial English translation).
International Search Report in International Application No. PCT/KR2017/002151, dated Jul. 6, 2017, 3 pages (with partial English translation).
International Search Report in International Application No. PCT/KR2017/002152, dated Jun. 27, 2017, 3 pages (with partial English translation).
International Search Report in International Application No. PCT/KR2017/002155, dated Jun. 23, 2017, 3 pages (with partial English translation).
International Search Report in International Application No. PCT/KR2017/002156, dated Jul. 5, 2017, 3 pages (with partial English translation).
International Search Report in International Application No. PCT/KR2017/002157, dated Jul. 6, 2017, 3 pages (with partial English translation).
International Search Report in International Application No. PCT/KR2017/002159, dated Jul. 6, 2017, 3 pages (with partial English translation).
International Search Report in International Application No. PCT/KR2017/002162, dated Jul. 6, 2017, 3 pages (with partial English translation).
International Search Report in International Application No. PCT/KR2017/002166, dated Jul. 6, 2017, 3 pages (with partial English translation).
Office Action in Australian Application No. 2017226613, dated Nov. 9, 2018, 3 pages.
Office Action in Australian Application No. 2017227410, dated Nov. 2, 2018, 3 pages.
Office Action in Australian Application No. 2017227411, dated Nov. 6, 2018, 3 pages.
Office Action in U.S. Appl. No. 15/445,018, dated Jul. 10, 2018, 11 pages.
Office Action in U.S. Appl. No. 15/445,325, dated Sep. 25, 2018, 36 pages.
Office Action in U.S. Appl. No. 15/445,456, dated Apr. 11, 2018, 10 pages.
Office Action in U.S. Appl. No. 15/445,493, dated Oct. 15, 2018, 26 pages.
Office Action in U.S. Appl. No. 15/445,494, dated Jul. 12, 2018, 13 pages.
Office Action in U.S. Appl. No. 15/445,508, dated Feb. 22, 2018, 12 pages.
Office Action in U.S. Appl. No. 15/445,289, dated Jan. 28, 2019, 37 pages.
Office Action in U.S. Appl. No. 15/444,742, dated Jan. 28, 2019, 36 pages.
Office Action in U.S. Appl. No. 15/445,379, dated Jan. 28, 2019, 41 pages.
Office Action in U.S. Appl. No. 15/444,761, dated Jan. 31, 2019, 32 pages.
Office Action in U.S. Appl. No. 15/445,326, dated Feb. 8, 2019, 32 pages.
Office Action in U.S. Appl. No. 15/445,214, dated Feb. 8, 2019, 41 pages.
Extended European Search Report in European Application No. 17760268.7, dated Oct. 22, 2019, 7 pages.
Extended European Search Report in European Application No. 17760269.5, dated Oct. 22, 2019, 7 pages.
Partial Supplementary European Search Report in European Application No. 17760275.2, dated Oct. 24, 2019, 14 pages.
Extended European Search Report in European Application No. 17760279.4, dated Oct. 24, 2019, 8 pages.

* cited by examiner

VACUUM CLEANER

CROSS-REFERENCE TO RELATED APPLICATION(S)

This application claims priority under 35 U.S.C. § 119 to Korean Patent Application No. 10-2016-0024022, filed in Korea on Feb. 29, 2016, and Korean Patent Application No. 10-2016-0062452, filed in Korea on May 20, 2016, and Korean Patent Application No. 10-2016-0108669, filed in Korea on Aug. 25, 2016, and Korean Patent Application No. 10-2016-0184117, filed in Korea on Dec. 30, 2016, whose entire disclosure is hereby incorporated by reference.

BACKGROUND

1. Field

A vacuum cleaner is disclosed herein.

2. Background

Generally, a vacuum cleaner is an apparatus which suctions dust and foreign substances on a surface to be cleaned using a suction motor provided inside a main body and then filters the dust and the foreign substances at an inside of the main body.

The above-described vacuum cleaner may be classified into an up-right type vacuum cleaner in which a suction nozzle is connected to a main body to be moved along with the main body, and a canister type vacuum cleaner in which the suction nozzle is connected to the main body by a connection pipe, a handle, a hose and the like.

In Korean Patent Publication No.10-2012-0004100 (published on Jan. 12, 2012) as a prior art document, there is disclosed a canister type vacuum cleaner.

SUMMARY

The present invention is directed to a vacuum cleaner in which a cleaner body is rotated when the vacuum cleaner travels and is stopped.

Also, the present invention is directed to a vacuum cleaner in which a bottom surface is formed to be inclined and a cleaner body is more smoothly rotated according to a travel state of the vacuum cleaner.

Also, the present invention is directed to a vacuum cleaner which effectively detects a rotating angle of a cleaner body changed according to a travel state of the vacuum cleaner.

Also, the present invention is directed to a vacuum cleaner which easily climbs over an obstacle when the vacuum cleaner is travelling.

According to an aspect of the present invention, there is provided a vacuum cleaner including moving wheels provided at both side surfaces of a cleaner body and rotated for travel of the vacuum cleaner and also configured to support the cleaner body to be rotated in normal and reverse directions and a dust container installed at a front of the moving wheels and configured to collect suctioned dust, wherein a base of the cleaner body includes a center portion; a first half portion and a second half portion configured to extend to be inclined upward from both ends of the center portion, and a rotating center of the moving wheels is located between the first half portion and the second half portion.

The cleaner body may be formed so that an angle between the center portion and the ground in a stopped state of the vacuum cleaner is larger than that in a travelling state thereof.

The cleaner body may be rotated so that the center portion thereof is arranged to be inclined with respect to the ground when the travel of the vacuum cleaner is stopped.

A wheel which is rotated while being in contact with the ground or an obstacle may be disposed at the first half portion.

The dust container may be seated at the first half portion to be inclined along a slope of the first half portion.

The vacuum cleaner may further include a detecting part configured to detect an inclination of the cleaner body; a wheel motor assembly configured to rotate the moving wheels; and a PCB configured to drive the wheel motor assembly according to the inclination of the cleaner body detected by the detecting part.

According to another aspect of the present invention, there is provided a vacuum cleaner including a base configured to form a lower surface of a cleaner body; and moving wheels provided at both side surfaces of the cleaner body and rotated for travel of the vacuum cleaner and also configured to support the cleaner body to be rotated in normal and reverse directions, wherein the base includes a center portion; and a first half portion and a second half portion configured to extend to be inclined upward from both ends of the center portion, and an angle between the first half portion and the ground when the vacuum cleaner travels is reduced further than that when the vacuum cleaner is stopped and an angle between the second half portion and the ground is increased.

A center of gravity of the cleaner body may be located at a rear side further than a rotating center of the moving wheels.

The center portion may be maintained in a parallel state with the ground while the cleaner body is travelling.

According to still another aspect of the present invention, there is provided a vacuum cleaner including a base configured to form a lower surface of a cleaner body; moving wheels provided at both side surfaces of the cleaner body and rotated for travel of the vacuum cleaner and also configured to support the cleaner body to be rotated in normal and reverse directions; and a dust container installed at a front of the moving wheels and configured to collect suctioned dust wherein the base extends so that a rear portion thereof based on the moving wheels is inclined upward.

A rear end of the base may be the closest to the ground in a stopped state.

A front end of the base may be the most distant from the ground in the stopped state.

The cleaner body may be rotated so that a rear end of the base becomes distant from the ground when travel of the cleaner body starts.

The details of one or more embodiments are set forth in the accompanying drawings and the description below. Other features will be apparent from the description and drawings, and from the claims.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to the embodiments of the present disclosure, examples of which are illustrated in the accompanying drawings. However, the invention may, however, be embodied in many different forms and should not be construed as being limited to the embodiments set forth herein; rather, alternative embodiments included in other retrogressive inventions or falling within the spirit and scope of the present disclosure can easily be derived through adding, altering, and removing, and will fully convey the concept of the invention to those skilled in the art.

Figure 1:
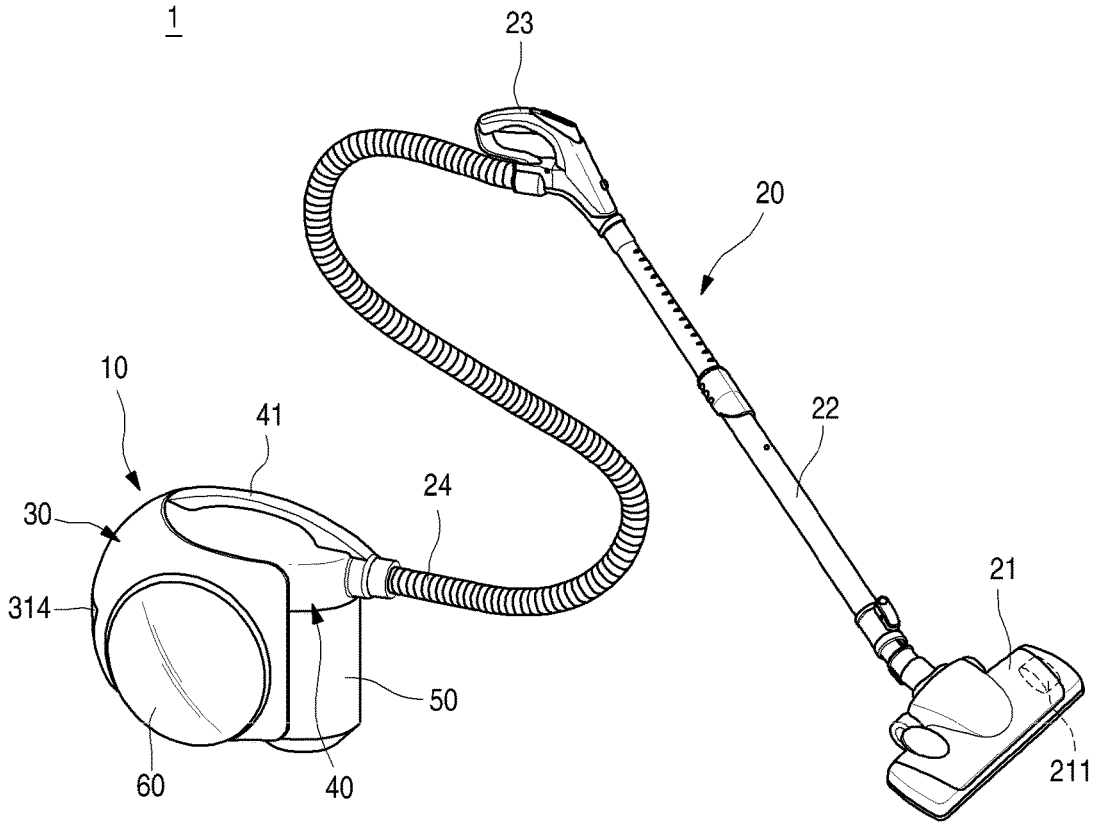
FIG. 1 is a perspective view of a vacuum cleaner according to an embodiment of the present invention.
Figure 2:
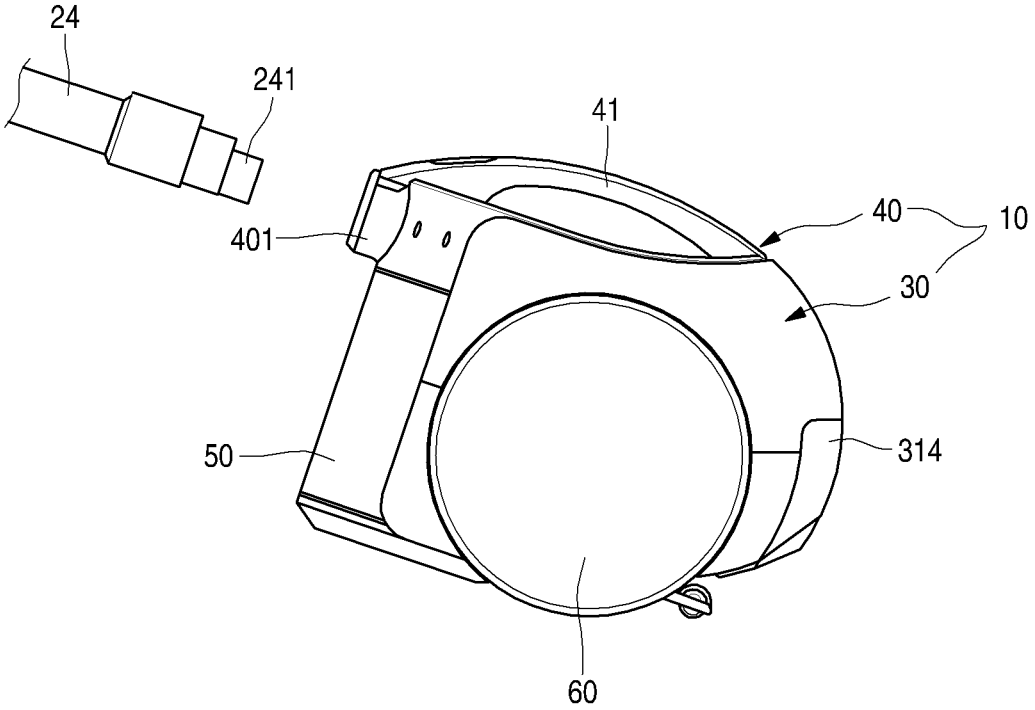
FIG. 2 is a view illustrating a state in which a cleaner body and a suction unit are separated.

FIG. 1 is a perspective view of a vacuum cleaner according to an embodiment of the present invention. And FIG. 2 is a view illustrating a state in which a cleaner body 10 and a suction unit are separated.

As illustrated in the drawings, a vacuum cleaner 1 according to an embodiment of the present invention includes a cleaner body 10 and a suction unit 20.

A motor for generating a suction force is provided inside the cleaner body 10. And when the motor is driven and the suction force is generated, the suction unit 20 may guide air containing dust into the cleaner body 10.

The suction unit 20 may include a suction part 21 for suctioning the dust on a surface to be cleaned, e.g., a floor surface and a connection part for connecting the suction part 21 with the cleaner body 10. The connection part may include an extension pipe 22 which is connected to the suction part 21, a handle 23 which is connected to the extension pipe 22 and a suction hose 24 which connects the handle 23 with the cleaner body 10.

A fitting portion 241 which enhances airtightness when being coupled with a connector 401 of the cleaner body 10 may be provided at the suction hose 24.

The fitting portion 241 may serve to install or separate the suction hose 24 at/from the connector 401. The fitting portion 241 may be formed in multi-stages as illustrated in the drawings.

The cleaner body 10 includes a body part 30 and a cover member 40 which form an entire exterior.

The cleaner body 10 may further include a moving wheel 60 which is rotatably coupled to the body part 30. A pair of moving wheels 60 may be provided and may be coupled to both sides of the body part 30, respectively. And the moving wheel 60 supports the body part 30 to be rotatable about a rotating center of the moving wheel 60.

A grip portion 41 which is gripped by a user may be provided at the cover member 40. The user may grip the grip portion 41 when lifting or tilting the body part 30, or opening and closing the cover member 40.

A rear cover 314 which is openable and closable may be provided at a rear surface of the body part 30. The rear cover 314 may be formed to open and close a space inside the body part 30 in which a battery unit 38 and a filter unit 39 are accommodated.

The cleaner body 10 further includes a dust container 50 in which the dust suctioned through the suction unit 20 is stored. The dust container 50 may be formed in a cylindrical shape as illustrated in the drawings, but is not limited thereto. And the dust container 50 may be separably provided at a front surface of the body part 30.

Figure 3:
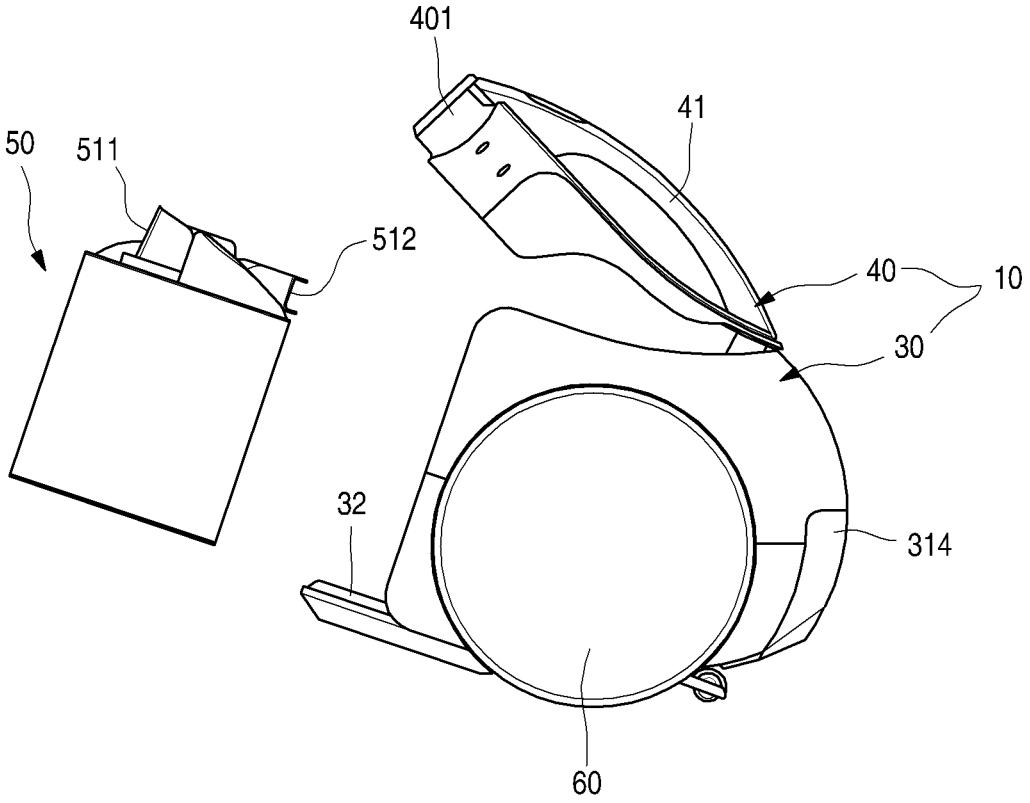
FIG. 3 is a view illustrating a state in which a dust container is separated from the cleaner body.
Figure 4:
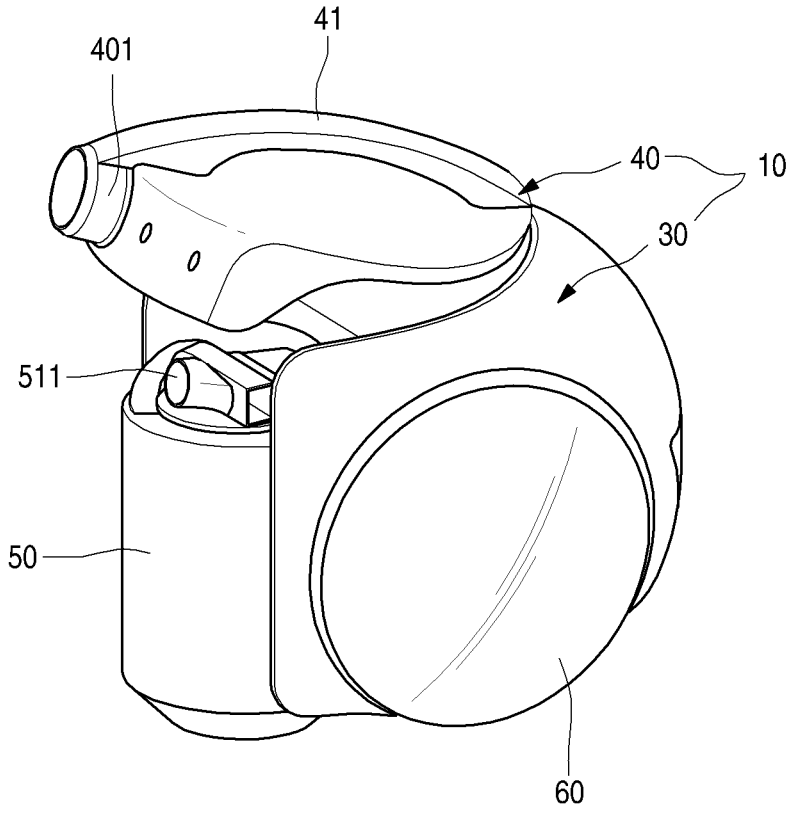
FIG. 4 is a view illustrating a state in which a cover member of the cleaner body is opened.

And FIG. 3 is a view illustrating a state in which the dust container is separated from the cleaner body 10. And FIG. 4 is a view illustrating a state in which the cover member of the cleaner body 10 is opened.

As illustrated in the drawings, the dust container 50 may be separably installed at a seating part 32 formed at a first half portion of the body part 30. The dust container 50 may form a part of the front surface of the body part 30 while being installed at the seating part 32. And the dust container 50 may be installed or separated by opening and closing of the cover member 40.

A suction port 511 through which the dust is suctioned may be provided at the dust container 50. The suction port 511 may be disposed at an upper surface portion of the dust container 50. Accordingly, the air introduced through the suction port 511 is guided downward and then moved to a dust collecting space inside the dust container 50.

The dust container 50 may be separably installed at the body part 30. The dust collecting space in which the dust introduced through the suction port 511 is collected may be formed inside the dust container 50.

The dust container 50 may be provided at a front of the body part 30, and at least a part of a side surface portion of the dust container 50 may be formed of a transparent material to allow the user to check the dust collected in the dust collecting space.

While the dust container 50 is seated on the seating part 32, the side surface portion may be exposed through the front surface of the body part 30. At this point, an exposed portion of the dust container 50 is formed from a transparent upper end of the side surface portion of the dust container 50 to a lower end thereof, and thus the entire dust collecting space may be checked without separating the dust container 50.

A dust separation structure which separates the dust from the air suctioned through the suction unit 20 may be provided inside the dust container 50, and the dust separated by the dust separation structure may be collected in a lower portion of the dust container 50.

The connector 401 is directly connected to the suction hose 24, and the air containing the dust may be introduced therethrough. That is, one side of the connector 401 is coupled to the suction hose 24, and the other side thereof is coupled to the suction port 511. Therefore, the connector 401 connects the suction hose 24 with the suction port 511.

The connector 401 may be in communication with the dust container 50. Accordingly, the air introduced into the suction hose 24 may be introduced into the dust container 50 via the connector 401.

The suction port 511 through which the dust is introduced may be provided at one side of the dust container 50. As illustrated in the drawings, the suction port 511 may be provided at an upper portion of the dust container 50. And the suction port 511 may be formed to be directed forward. Here, the term "forward" may be a portion, at which the suction hose 24 is located, based on the cleaner body 10.

As illustrated in the drawings, the connector 401 may be disposed at the upper portion of the dust container 50. Since both of the suction port 511 and the connector 401 are disposed at the upper portion of the dust container 50, a passage length of the air introduced from the suction hose 24 may be minimized.

The cleaner body 10 further includes the cover member 40 which is movably provided at the body part 30. The cover member 40 may form at least a part of an upper surface of the cleaner body 10 and may be formed to open and close an upper surface of the body part 30. At this point, a rear end of the cover member 40 may be shaft-coupled to the body part 30 to be rotatable, and thus the user may open the cover member 40 by gripping and rotating the grip portion 41.

The connector 401 may be provided at the cover member 40. Therefore, the connector 401 may be moved along with the cover member 40. The cover member 40 may shield at least one side of the dust container 50. The cover member 40 may shield at least one side of the dust container 50 and may also be coupled to the dust container 50. The cover member 40 may be coupled to the dust container 50 when being closed and may be separated from the dust container 50 when being opened. For example, the cover member 40 may be coupled to the upper portion of the dust container 50.

While the cover member 40 is in a closed state, the fitting portion 241 of the suction hose 24 connected to the connector 401 of the cover member 40 may be in communication with the suction port 511 of the dust container 50.

Therefore, the dust and the air suctioned through the suction unit 20 may pass through the connector 401 of the cover member 40 and then may be introduced into the dust container 50 through the suction port 511.

And while the cover member 40 is in an opened state, the fitting portion 241 of the suction hose 24 may be maintained in a connected state to the connector 401 of the cover member 40, and the cover member 40 and the dust container 50 may be separated. Therefore, while the cover member 40 is in the opened state, the dust container 50 may be separable from the seating part 32.

Hereinafter, the cleaner body 10 will be more specifically described.

Figure 5:
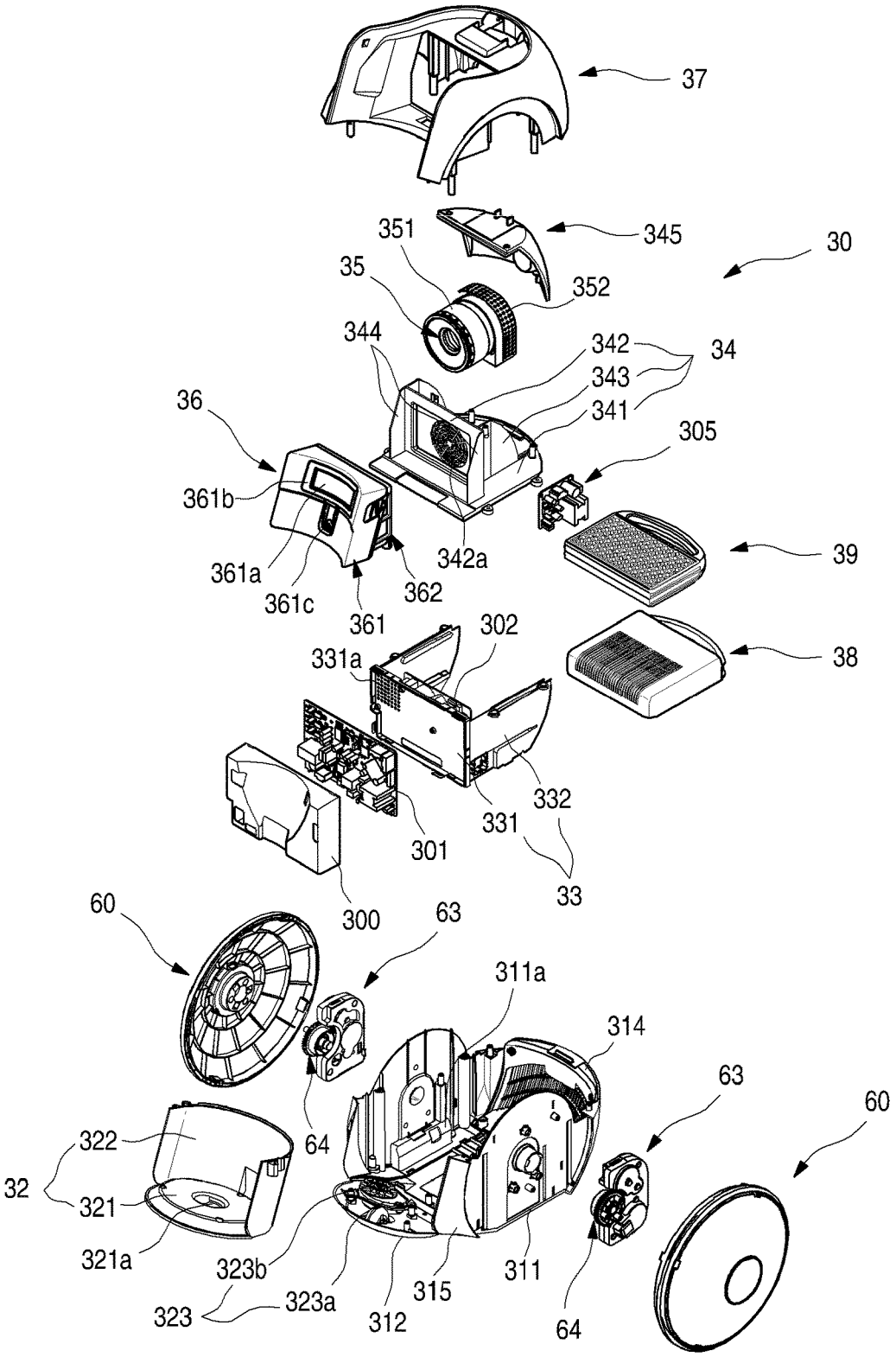
FIG. 5 is an exploded perspective view of the cleaner body.
Figure 6:
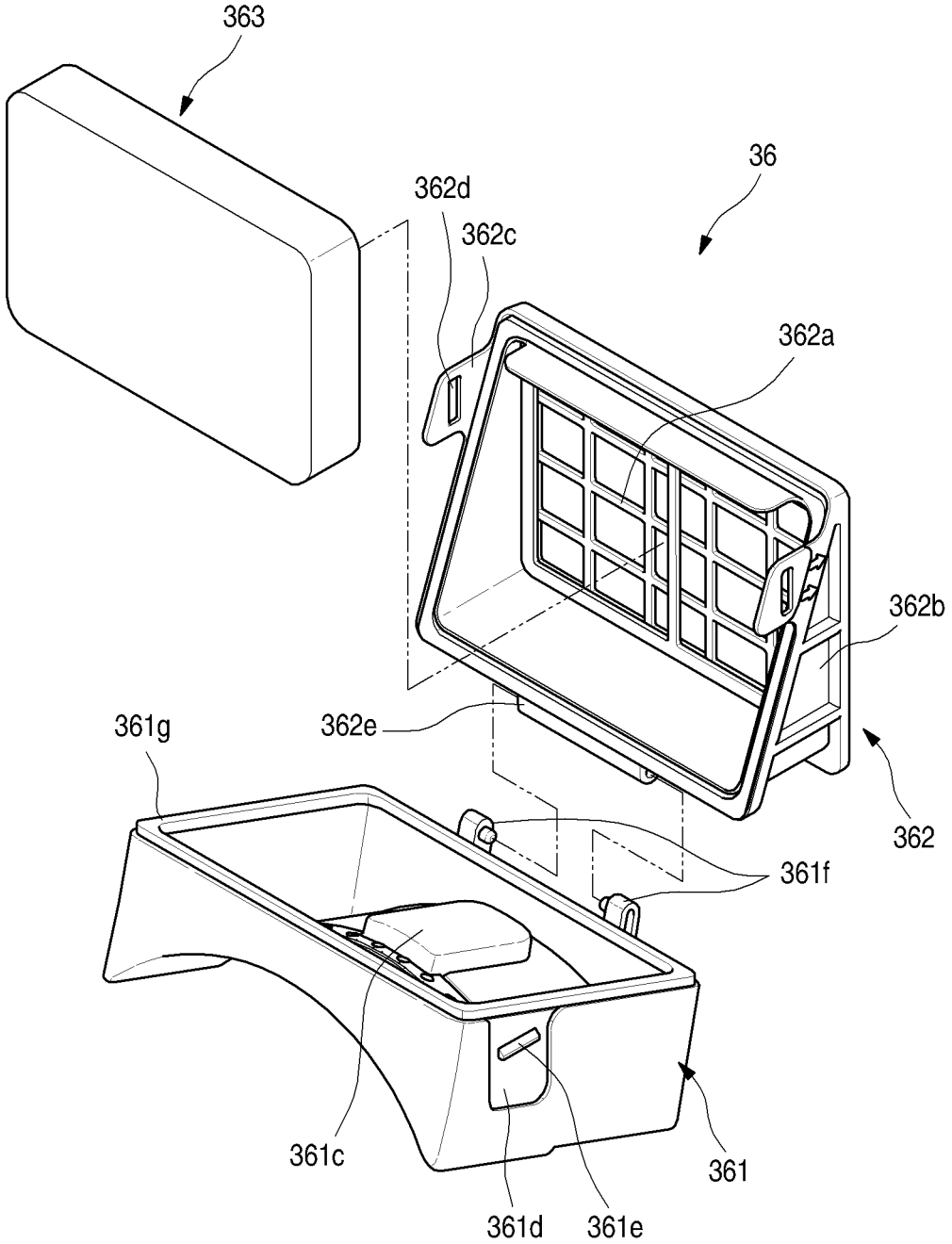
FIG. 6 is an exploded perspective view illustrating a state in which a prefilter assembly according to the embodiment of the present invention is opened.
Figure 7:
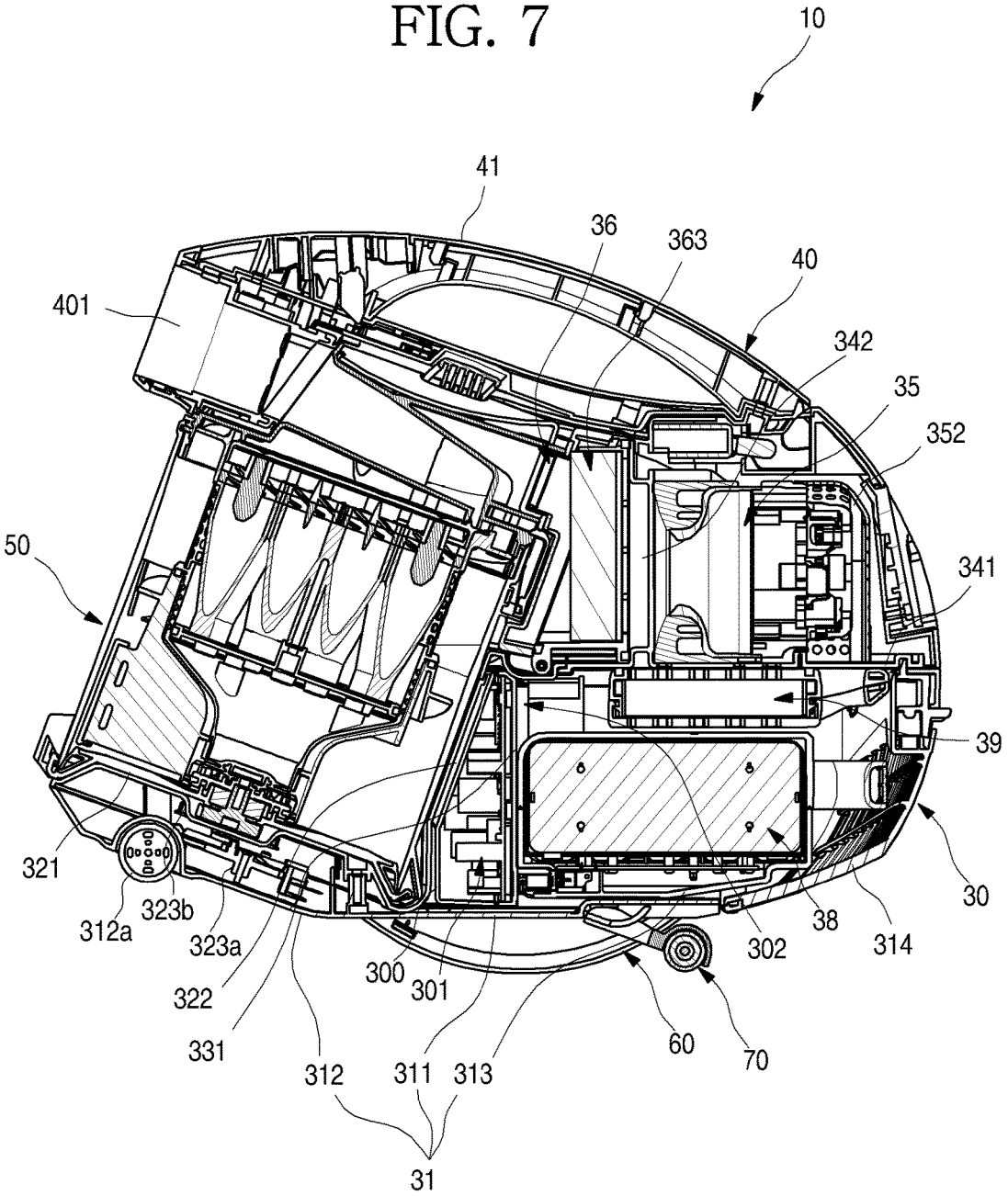
FIG. 7 is a cross-sectional view of the cleaner body.
Figure 8:
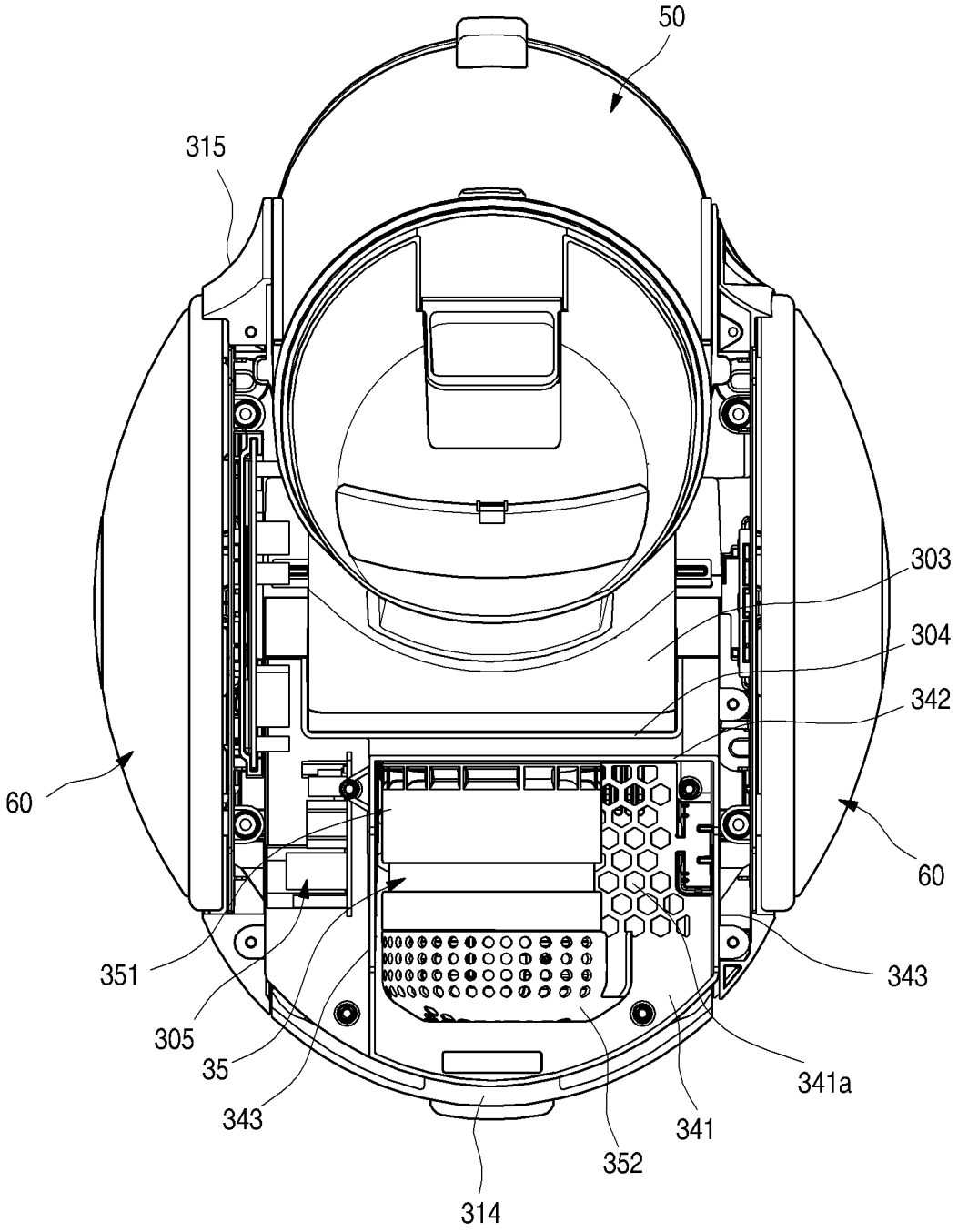
FIG. 8 is a plan view of the cleaner body from which the cover member is removed.

FIG. 5 is an exploded perspective view of the cleaner body 10. And FIG. 6 is an exploded perspective view illustrating a state in which a prefilter assembly according to the embodiment of the present invention is opened. And FIG. 7 is a cross-sectional view of the cleaner body 10. And FIG. 8 is a plan view of the cleaner body 10 from which the cover member is removed.

As illustrated in the drawings, the cleaner body 10 includes the body part 30 and the cover member 40 and may be formed so that the dust container 50 is installed at the body part 30.

And the body part 30 may include a base 31 which forms a bottom of the cleaner body 10 and provides a space in which the dust container 50, the battery unit 38, the filter unit 39 and a main motor 35 are installed.

The base 31 may include a first half portion 312, a center portion 311 and a second half portion 313, may be formed to have a predetermined width and thus may provide the space in which the dust container 50, the battery unit 38, the filter unit 39 and so on are installed.

The center portion 311 may be formed in a flat surface shape and may be disposed between the first half portion 312 and the second half portion 313. At this point, the first half portion 312 and the second half portion 313 may be formed to extend slantly based on the center portion 311 and may be formed to be gradually higher in a direction which becomes distant from an end of the center portion 311.

A terminal installing portion 311*a* at which a power supply terminal 307 is disposed may be formed at one end of the center portion 311, i.e., a position adjacent to the moving wheel 60. The terminal installing portion 311*a* may be formed to be recessed, such that a lower surface thereof is opened, and may also be formed to be connected to a terminal of a charging device when the battery unit 38 of the vacuum cleaner 1 is charged.

And a rear wheel unit 70 may be provided at a position of the center portion 311 adjacent to the second half portion 313. The rear wheel unit 70 may prevent the cleaner body 10 from being overturned backward while the vacuum cleaner 1 is being used. The rear wheel unit 70 may allow the base 31 to be maintained at a set angle while being in a stopped state. To this end, the rear wheel unit 70 may be formed to be in contact with the ground and the center portion 311 while the cleaner body 10 is in the stopped state which is not travelled, thereby elastically supporting the cleaner body 10.

The first half portion 312 is formed at a front end of the center portion 311. The first half portion 312 extends from an end of the center portion 311 so as to be inclined upward, and the seating part 32 which forms the space for accommodating the dust container 50 may be provided at the first half portion 312.

The seating part 32 may include a lower surface portion 321 which forms a bottom thereof and a circumferential portion 322 which extends upward along a circumference of the lower surface portion 321. The circumferential portion 322 is formed to be opened forward, such that the dust container 50 is installed therein.

A compression motor assembly 323 for driving a dust compressing unit 56 inside the dust container 50 may be provided between the lower surface portion 321 and the first half portion 312. When the dust container 50 is installed at the seating part 32, the compression motor assembly 323 and the dust compressing unit 56 which will be described below in detail are connected to each other, and thus the dust compressing unit 56 is in a drivable state.

The compression motor assembly 323 may include a compression motor 323*a* which provides a rotating force and a compression gear 323*b* which is connected to a rotating shaft of the compression motor 323*a*. The compression gear 323*b* may be located at a position which is eccentric to one side from a center of the lower surface portion 321. And an opened lower surface hole 321*a* may be formed at the lower surface portion 321, and a first transmission gear 591 which will be described below may be located at the lower surface hole 321*a* when the dust container 50 is seated. Therefore, when the dust container 50 is installed, the compression gear 323*b* is coupled to the first transmission gear 591 so as to transmit power of the compression motor 323*a*.

A front wheel 312*a* may be installed at a lower surface of the first half portion 312. The front wheel 312*a* is located at a front side slightly further than a center of the first half portion 312 and allows the cleaner body 10 to be easily moved over an obstacle when the obstacle such as a carpet and a door sill is located in front of the cleaner body 10 which is being moved. And when the cleaner body 10 is tilted forward, the front wheel 312*a* may be rotated in a contacting state with the ground so that the cleaner body 10 is prevented from being overturned forward.

The second half portion 313 may also be formed to be inclined upward from a rear end of the center portion 311. Therefore, when the cleaner body 10 starts to move forward to travel, the vacuum cleaner 1 is inclined using the moving wheel 60 as an axis, and thus the cleaner body 10 is easily rotated.

And at least a part of a rear opening 317 opened and closed by the rear cover 314 may be formed at the second half portion 313. The rear cover 314 forms the same curved surface as that of each of a lower decoration 315 and an upper decoration 37 which form an exterior of each of the second half portion 313 and the cleaner body 10 while shielding the rear opening 317. The rear cover 314 may be formed as a part of the second half portion 313 to have the same slope or curved surface as that of the second half portion 313.

The rear cover 314 may form a part of the rear surface of the body part 30. And a lower end of the rear cover 314 may be rotatably coupled to the second half portion 313 and may open and close the rear opening 317 by rotation. And a grille through which the air separated from the dust while passing through the inside the cleaner body 10 is discharged may be formed at the rear cover 314, and thus the air from which the dust is filtered may be discharged.

Meanwhile, a base frame is installed at a center of the base 31. The base frame is formed to divide a space in which the dust container 50 is disposed, a space in which the main motor 35 is provided and a space in which the battery unit 38 and the filter unit 39 are provided.

Specifically, the base frame may include a lower frame 33 and an upper frame 34.

The lower frame 33 is installed at the center portion 311 and may include a first barrier 331 which divides forward and backward a part of an internal space of the body part 30 and one pair of side walls 332 which extend from both ends of the first barrier 331, respectively. And the main motor 35, a wheel motor assembly 63, the compression motor assembly 323, an obstacle detecting member 44 and a main PCB 301 for controlling a general driving of the vacuum cleaner 1 may be provided at a front surface of the first barrier 331.

A lower seating member 300 may be provided at the front surface of the first barrier 331. The lower seating member 300 may be formed so that a center thereof is recessed to support a side surface of the dust container 50 when the dust container 50 is installed. And the main PCB 301 installed at the front surface of the first barrier 331 may be accommodated inside the lower seating member 300.

A noise filter 302 for removing noise of input power supplied to the main PCB 301 is provided at a rear surface of the first barrier 331. The noise filter 302 may be an EMI filter.

At this point, a first barrier hole 331*a* serving as a passage of the air is formed at the first barrier 331 between the main PCB 301 and the noise filter 302. Therefore, the main PCB 301 and the noise filter 302 may be naturally cooled by the air passing through the first barrier hole 331*a*.

The lower frame 33 is opened upward and downward while being installed at the base 31, and the upper frame 34 is installed at an upper end of the lower frame 33. And the upper frame 34 shields an opened upper surface of the lower frame 33 and forms the space in which the battery unit 38 and the filter unit 39 are accommodated. And the space in which the main motor 35 for suctioning the air is provided is also formed.

Specifically, the upper frame 34 may include a cover plate 341, a second barrier 342 and a second side wall 343.

The second barrier 342 divides an upper space of the body part 30 into a front portion and a rear portion, forms at a front thereof a space in which a prefilter assembly 36 connected to the dust container 50 is provided and also forms at a rear thereof a space in which the main motor 35 is provided.

And a second barrier hole 342*a* may be formed at the second barrier 342, and thus fine dust may be filtered while the air passed through the dust container 50 passes through the prefilter assembly 36 when the main motor 35 is driven, and the air filtered while passing through the prefilter assembly 36 passes through the main motor 35.

A front barrier wall 344 which extends forward is formed at both ends of the second barrier 342 and forms a space in which the prefilter assembly 36 is accommodated.

The prefilter assembly 36 may include a prefilter case 361 which is in close contact with the dust container 50 and a prefilter body 362 which is coupled with the prefilter case 361 and in which a filter member 363 is accommodated.

The prefilter case 361 and the prefilter body 362 may form a space therein to accommodate the filter member 363 while being coupled to each other and may also be rotatably coupled to each other to be opened and closed. Therefore, the filter member 363 may be installed at or separated from the prefilter body 362 after the prefilter case 361 is opened.

The filter member 363 serves to secondarily filter the fine dust which is not filtered by the dust container 50 in which the dust and foreign substances are primarily filtered and is formed to remove the fine dust in the air introduced into the main motor 35. Meanwhile, the air passed through the filter member 363 and the main motor 35 may cool the battery unit 38 and then may be discharged to an outside after the fine dust therein is tertiarily filtered in the filter unit 39 which will be described in detail.

The prefilter assembly 36 will be described in more detail with reference to FIG. 6. The prefilter assembly 36 has a structure in which the filter member 363 is accommodated in the prefilter body 362 and which is shielded by the prefilter case 361.

The prefilter case 361 may be exposed forward while the prefilter assembly 36 is installed at the upper frame 34. And a front surface of the prefilter case 361 is formed to have a curved surface corresponding to an outer surface of the dust container 50. Therefore, when the dust container 50 is installed at the body part 30, the exposed front surface of the prefilter case 361 surrounds and supports the outer surface of the dust container 50. At this point, the front surface of the prefilter case 361 may be formed to be inclined and thereby to be in contact with the outer surface of the dust container 50 according to an inclined installation state of the dust container 50. Therefore, when the dust container 50 is installed, the dust container 50 may be maintained in a stably supported state due to the front surface of the prefilter case 361.

A filter hole 361*a* is formed at a position of the prefilter case 361 corresponding to a discharge port 512 of the dust container 50. The filter hole 361*a* may be formed to have a size and shape corresponding to those of the discharge port 512. And a case gasket 361*b* which is in close contact with a circumference of the discharge port 512 is formed around the filter hole 361*a* so that the dust container 50 and the prefilter case 361 are in close contact with each other and thus a leakage of the air is prevented.

A locker groove 361*c* is further formed at the prefilter case 361. The locker groove 361*c* accommodates an upper locker 57 which is disposed to protrude from the outer surface of the dust container 50 when the dust container 50 is installed at the body part 30. Therefore, the locker groove 361*c* may be formed to correspond to a protruding shape of the upper locker 57.

A first restricting portion 361*d* which allows the prefilter body 362 to be maintained in a closed state may be formed at both side surfaces of the prefilter case 361. The first restricting portion 361*d* may be formed in a recessed shape to accommodate a second restricting portion 362*c* which will be described below, and a restricting protrusion 361*e* may be formed at the first restricting portion 361*d* to protrude.

Meanwhile, a case gasket 361*g* may be further provided at a circumference of an opened rear end of the prefilter case 361. The case gasket 361*g* may be in close contact with a front surface of the second barrier 342 and may allow the air passing through the prefilter assembly 36 to pass through the second barrier hole 342*a* without a leakage.

A first rotation coupling portion 361*f* may be formed at a lower end of the prefilter case 361. The first rotation coupling portion 361*f* serves to allow the prefilter case 361 and the prefilter body 362 to be rotatably connected, and one pair of first rotation coupling portions 361*f* may protrude from the lower end of the prefilter case 361. And a second rotation coupling portion 362*e* may be located between the pair of first rotation coupling portions 361*f*, and the first rotation coupling portions 361*f* may be rotatably shaft-coupled to both ends of the second rotation coupling portion 362*e*.

The prefilter body 362 may include a body grille 362*a* of which a front surface is opened and a rear surface is formed in a grille shape and which is in close contact with the second barrier 342 and a body flange 362*b* which extends along a perimeter of the body grille 362*a* and accommodates the prefilter case 361.

If necessary, a gasket may be provided at the perimeter of the body grille 362*a* so that the second barrier 342 and the prefilter body 362 are airtightly in close contact with each other. And the body grille 362*a* may be formed in the grille shape so that the air introduced through the filter hole 361*a* passes through the filter member 363 and then passes through the second barrier hole 342*a*.

The body flange 362*b* may be in close contact with an outer surface of the prefilter case 361 and may be formed such that a width of a lower end thereof is greater than that of an upper end thereof and a side surface thereof is inclined in order to allow the prefilter case 361 to be coupled in an inclined state. And the second restricting portion 362*c* which is seated on the first restricting portion 361*d* may be formed at both side surfaces of the body flange 362*b*.

The second restricting portion 362*c* may be formed to protrude forward from both sides of the body flange 362*b* and may be formed in a shape which is accommodated in the first restricting portion 361*d*. And a restricting hole 362*d* is formed at the second restricting portion 362*c*. The restricting hole 362*d* serves to allow the restricting protrusion 361*e* to be inserted therein when the second restricting portion 362*c* is accommodated in the second restricting portion 362*c*, thereby allowing the prefilter case 361 and the prefilter body 362 to be maintained in a closed state.

And the second rotation coupling portion 362*e* may be formed at the lower end of the body flange 362*b*. The second rotation coupling portion 362*e* is rotatably coupled to the first rotation coupling portion 361*f* and also formed so that the prefilter case 361 and the prefilter body 362 are rotated about the first rotation coupling portion 361*f* and the second rotation coupling portion 362*e*, respectively. Therefore, the prefilter case 361 may be opened and closed by being rotated about a lower end of the prefilter body 362 and may replace the filter member 363 after the prefilter body 362 is opened.

Various types of filters which may collect a variety of fine dust may be used as the filter member 363, and the filter member 363 may be formed in a shape which is accommodated in an inner space of the prefilter body 362.

The prefilter assembly 36 may be installed on the upper frame 34 while accommodating the filter member 363, may support the dust container 50 while being installed on the upper frame 34 and may allow the air passed through the dust container 50 to be secondarily filtered and then to be supplied to the main motor 35.

One pair of second side walls 343 may extend backward from a rear surface of the second barrier 342. The second side walls 343 may form the space in which the main motor 35 is disposed and may also form a space in which a sub-PCB 305 is disposed.

Specifically, the main motor 35 may be provided between the pair of second side walls 343, and the sub-PCB 305 may be installed at an outer surface of one of the second side walls 343. That is, as illustrated in FIG. 8, the main motor 35 and the sub-PCB 305 may be respectively disposed at the spaces divided based on the second side walls 343.

Meanwhile, the second barrier hole 342*a* may be formed at an area between the pair of second side walls 343. Therefore, all of the air passing through the second barrier hole 342*a* may pass through the main motor 35.

And a plate hole 341*a* may be formed at the cover plate 341 which forms a bottom of the upper frame 34. The plate hole 341*a* may be formed at an area between the pair of the second side walls 343. Therefore, the air introduced into the space for accommodating the main motor 35 through the second barrier hole 342*a* may be introduced into the space, which is formed at the lower frame 33 to accommodate the battery unit 38, through the plate hole 341*a* and may cool the battery unit 38.

The main motor 35 is provided at a space formed by the upper frame 34 and located at a rear side further than a center of gravity of the body part 30 and a center of the moving wheel 60. Accordingly, due to an installation structure of the main motor 35, a load is applied so that a rear end of the body part 30 is lowered by a weight of the main motor 35 while an external force is not provided.

And since the main motor 35 is disposed long in forward and backward directions, the center of gravity of the body part 30 may be located at a rear side further than the rotating center of the moving wheel 60 and may provide a rotational moment for clockwise rotating the body part 30.

Meanwhile, the main motor 35 has a structure in which a fan and a motor are coupled inside a case for guiding the flow of the air. Various structures which force the flow of the air may be applied as such a structure of the main motor 35.

And the main motor 35 may be installed at and fixed to the upper frame 34 by a motor supporting member 351. The motor supporting member 351 may be formed of a rubber material or a material having elasticity, may reduce vibration generated when the main motor 35 is driven and thus may reduce a noise.

A motor cover 352 which surrounds at least a part of the main motor 35 may be further provided at a rear of the main motor 35. A plurality of holes may be formed at the motor cover 352, and thus the air forcibly blown by the main motor 35 may pass therethrough. And a sound absorbing material may be further provided between the motor cover 352 and the main motor 35 and may reduce the noise generated when the main motor 35 is driven.

And the main motor 35 is disposed at the space formed by the upper frame 34 to be leaned to one side at which the sub-PCB 305 is provided. That is, the main motor 35 is disposed adjacent to one of the pair of second side walls 343 at which the sub-PCB 305 is installed. Accordingly, a relatively wide space may be formed between the main motor 35 and one of the second side walls 343 which is distant from the sub-PCB 305.

At least a part of the plate hole 341*a* may be exposed through an area between the main motor 35 and the second side wall 343 which is distant from the sub-PCB 305. Also, the first barrier hole 331*a* may also be formed at an area of the same extension line as that of the plate hole 341*a*.

Therefore, the air discharged through the main motor 35 may be discharged through the motor cover 352. Since one of both lateral directions is blocked by the adjacent second side wall 343, the air naturally flows through a space between the other second side wall 343 each of which has the plate hole 341*a*. Since the air is allowed to smoothly flow to the first barrier hole 331*a*, the flow noise may be reduced.

Meanwhile, a frame cover 345 may be provided at the upper frame 34. The frame cover 345 may be formed to shield an opened upper surface of the upper frame 34. Therefore, while the frame cover 345 is installed, the space in which the main motor 35 is accommodated may be sealed, and all of the air introduced through the second barrier hole 342*a* by the driving of the main motor 35 may pass through the main motor 35 and then may be discharged to the plate hole 341*a*.

Meanwhile, the sub-PCB 305 may be provided at one of the pair of the second side walls 343. The sub-PCB 305 controls driving of a sub-motor 201 which drives an agitator inside the suction unit 20. A BLDC motor which is inexpensive and is easily controlled may be used as the sub-motor 201, and the sub-PCB 305 may decrease a voltage of the input power to be suitable for the sub-motor 201 and then may supply the input power to the sub-motor 201.

The sub-PCB 305 may be provided at a separate space of the upper frame 34 separately from the main PCB 301 and thus may be installed if necessary. That is, when the sub-motor 201 is not provided at the suction unit 20, the sub-PCB 305 may not be installed, and thus the main PCB 301 may be commonly used.

Meanwhile, an upper portion of the cleaner body 10 may be formed by the upper decoration 37. The upper decoration 37 may shield an opened upper portion of the base 31 and thus may shield internal elements installed at the base 31. And the upper decoration 37 forms a part of an exterior of the upper surface of the cleaner body 10 and forms an upper exterior of the cleaner body 10 except a portion thereof shielded by the cover member 40, the moving wheel 60 and the dust container 50.

And the upper decoration 37 may be coupled to the lower decoration 315 which will be described below and may form a part of an exterior of a side surface of the cleaner body 10 by being coupled to the lower decoration 315.

Figure 9:
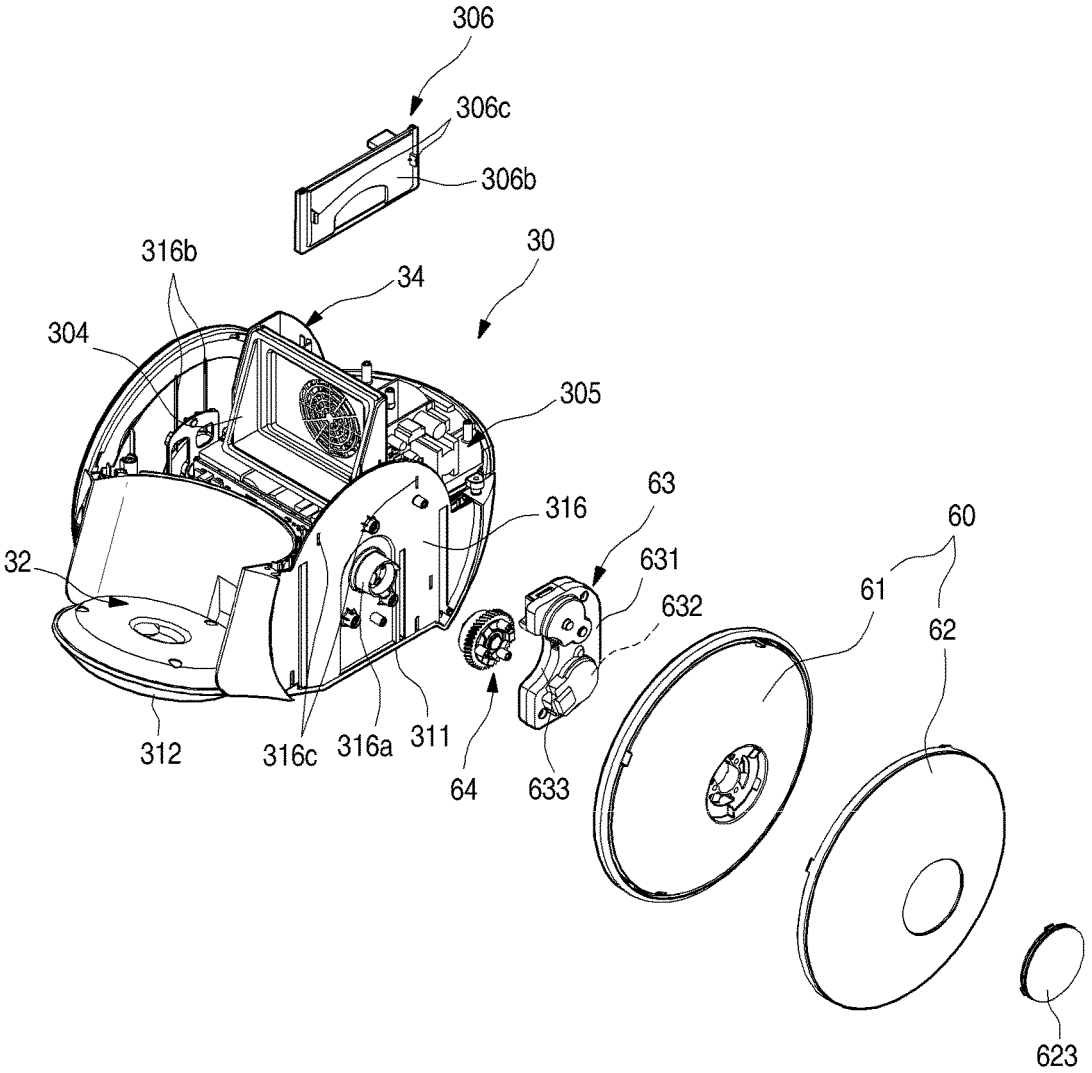
FIG. 9 is an exploded perspective view illustrating a coupling structure of the cleaner body, a moving wheel and a detecting part when being seen in one direction.
Figure 10:
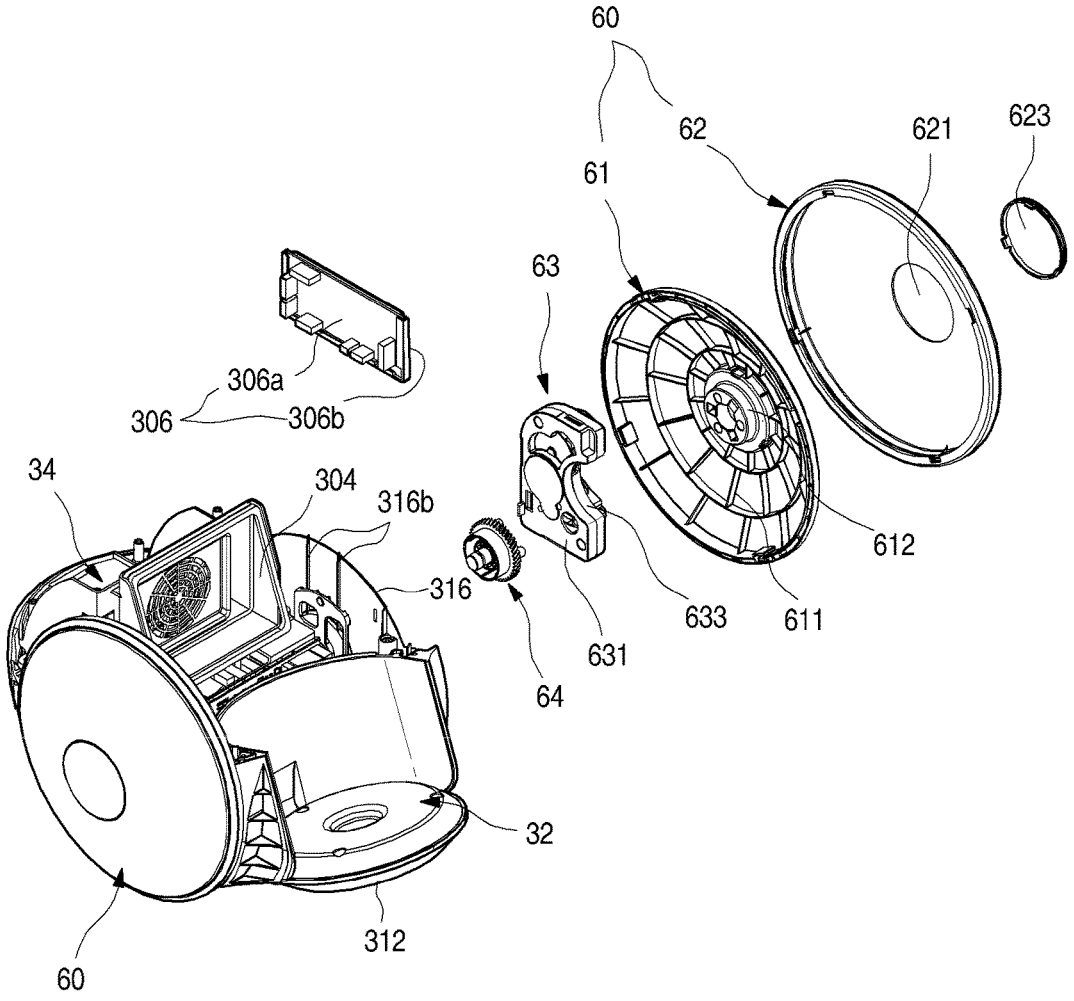
FIG. 10 is an exploded perspective view illustrating the coupling structure of the cleaner body, the moving wheel and the detecting part when being seen in another direction.
Figure 11:
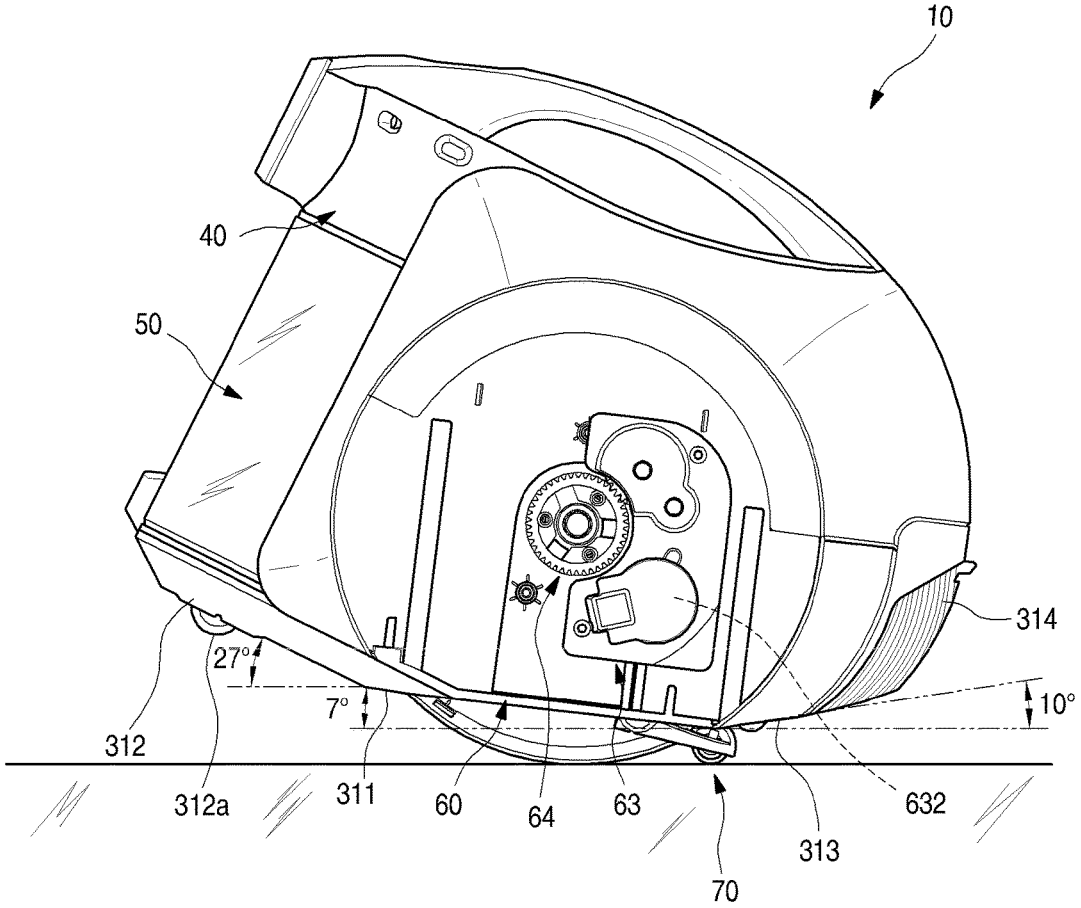
FIG. 11 is a side view illustrating an installing state between the cleaner body and a wheel gear assembly.
Figure 12:
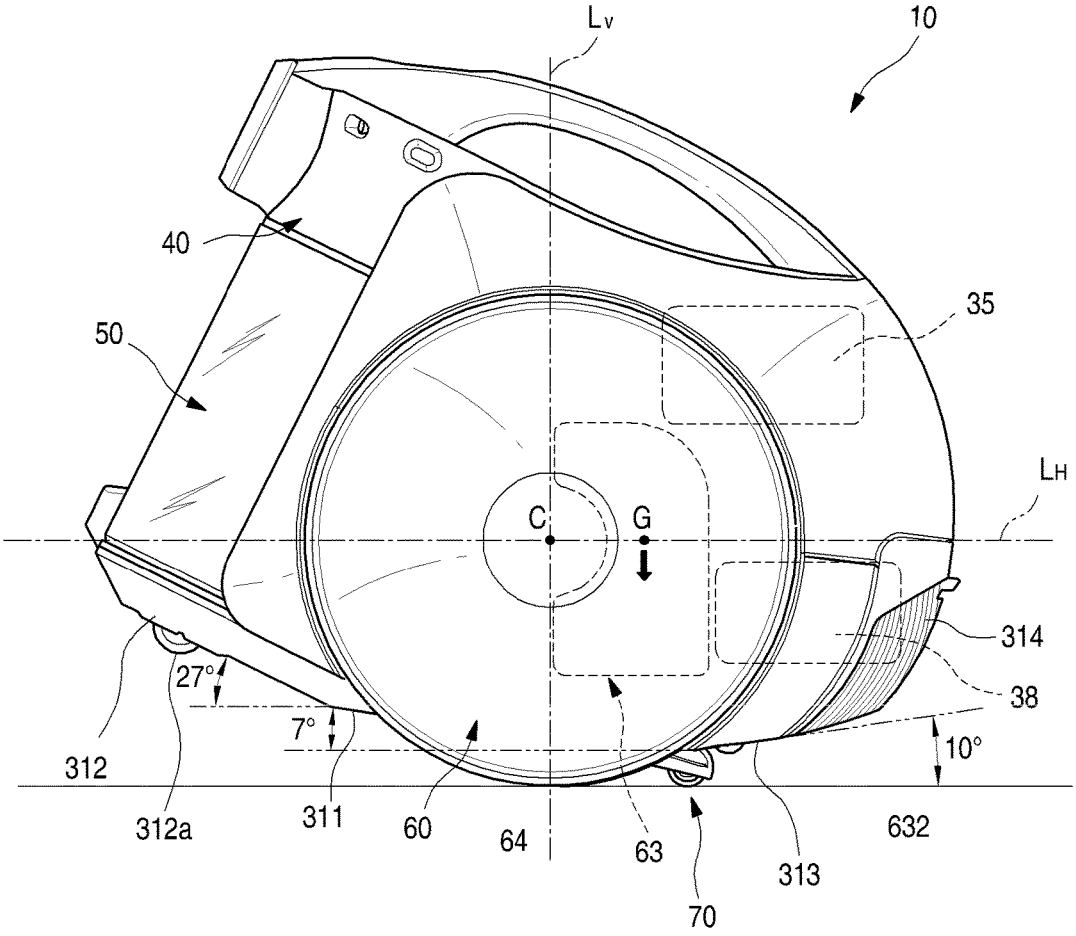
FIG. 12 is a side view of the cleaner body.

FIG. 9 is an exploded perspective view illustrating a coupling structure of the cleaner body 10, the moving wheel and a detecting part when being seen in one direction. And FIG. 10 is an exploded perspective view illustrating the coupling structure of the cleaner body 10, the moving wheel and the detecting part when being seen in another direction. FIG. 11 is a side view illustrating an installing state between the cleaner body 10 and a wheel gear assembly. And FIG. 12 is a side view of the cleaner body 10.

As illustrated in the drawings, one pair of side portions 316 formed to extend upward are formed at both side ends of the base 31, respectively. The side portions 316 may provide a space in which the moving wheel 60 and the wheel motor assembly 63 for driving the moving wheel 60 are installed. The pair of side portions 316 may be provided at both of left and right sides, and a structure in which the wheel motor assembly 63 is installed may be the same as that in which the moving wheel 60 is installed.

Each of the side portions 316 may extend to a position higher than the center of the moving wheel 60 and may be formed smaller than the moving wheel 60. A wheel boss 316*a* in which the moving wheel 60 is rotatably installed may be provided at a center of each of the side portions 316. The wheel boss 316*a* may extend from the side portion 316 toward the center of the moving wheel 60. While the moving wheel 60 is installed at the wheel boss 316*a*, the moving wheel 60 may be rotated by the wheel motor assembly 63 and a wheel gear 64. And the cleaner body 10 may also be in a rotatable state using the wheel boss 316*a* as an axis.

And the wheel motor assembly 63 may be provided at a lateral side of the wheel boss 316*a*. When the moving wheel 60 is installed at the wheel boss 316*a*, the wheel motor assembly 63 may be shielded by the moving wheel 60. That is, the wheel motor assembly 63 may be provided at a space formed between the side portion 316 and the moving wheel 60.

The wheel motor assembly 63 may include a wheel motor 632, a wheel motor case 631 and a plurality of moving gears (not shown) which are provided inside the wheel motor case 631 to transmit power to the wheel gear 64.

The wheel motor 632 may be configured with a BLCD motor of which rotation is easily controlled and which is light. And the plurality of moving gears which connect a rotating shaft of the wheel motor 632 with the wheel gear 64 of the moving wheel 60 decelerates rotation of the wheel motor 632 and then transmits the rotation to the moving wheel 60.

Meanwhile, the wheel motor assembly 63 may be installed at a rear side further than the rotating center of the moving wheel 60. Specifically, a case installing groove 633 which is recessed inward may be formed at the wheel motor case 631. The case installing groove 633 is recessed in a shape corresponding to the wheel boss 316*a* and formed to accommodate at least a part of the wheel boss 316*a*. That is, while the wheel motor assembly 63 is installed, the case installing groove 633 is installed to surround a second half portion of an outer surface of the wheel boss 316*a* and disposed at a rear side of the wheel boss 316*a*. Therefore, the wheel motor assembly 63 may allow the center of gravity of the cleaner body 10 to be located at a further rear side while being installed at the cleaner body 10.

And the wheel motor 632 is located at a lower portion of the wheel motor case 631, and the plurality of moving gears are located above the wheel motor 632. That is, since the wheel motor 632 which is relatively heavy is disposed at the lower side, the center of gravity of the cleaner body 10 may be located at a further lower side.

The lower decoration 315 which forms the exterior of the body part 30 exposed to an outside of the moving wheel 60 may be installed at the side portion 316. The lower decoration 315 may be formed along at least a part of a circumference of the moving wheel 60, may be formed to have a curved surface which is continued to a curved surface of the moving wheel 60 and thus may form a smooth exterior.

A plurality of reinforcing ribs 316*b* which vertically extend may be further formed at an inner surface of the side portion 316, i.e., a surface thereof opposite to a surface at which the wheel boss 316*a* is formed. Since the plurality of reinforcing ribs 316*b* are formed, the side portion 316 may be prevented from being damaged by a load which is laterally applied. And the moving wheel 60 may be maintained in a stably coupled state.

Meanwhile, a detecting part 306 may be further provided at one side of the inner surface of the side portion 316. The detecting part 306 may detect a moving state or a posture of the cleaner body 10 and may control the driving of the moving wheel 60. The detecting part 306 serves to detect movement of the cleaner body 10 and may include a gyro sensor or an acceleration sensor which is typically widely used. Of course, instead of the gyro sensor or the acceleration sensor, various sensors or devices which detect the movement of the cleaner body 10 may be used as the detecting part 306.

The detecting part 306 may be installed at an upper portion of the inner surface of the side portion 316. The detecting part 306 may include a detection PCB 360*a* on which the gyro sensor is mounted and a detecting part fixing member 306*b* which fixes the detection PCB 360*a* and is installed at the side portion 316. And one pair of fixing hooks 306*c* may be provided at the detecting part fixing member 306*b* and may be inserted and fixed into detecting part fixing holes 316*c* formed at the side portion 316.

Meanwhile, the detection PCB 360*a* may be formed to control driving of the wheel motor 632 provided at both sides thereof. That is, a configuration for controlling the gyro sensor and the wheel motor 632 may be configured with one PCB.

As described above, the detecting part 306 may be installed at and fixed to the side portion 316, and an installation position of the detecting part 306 may be disposed at one side which is distant from the rotating center of the moving wheel 60 used as the rotating shaft of the cleaner body 10. Therefore, when the cleaner body 10 is travelled or stopped, a rotation angle, i.e., a slope of the cleaner body 10 may be effectively detected.

While the cleaner body 10 is in the stopped state, the center of gravity thereof is located at a rear of the center of the moving wheel 60. Therefore, the cleaner body 10 is maintained in a state which is intended to be clockwise rotated based on the center of the moving wheel 60. And the cleaner body 10 is maintained in a supported state by the rear wheel unit 70 which is in contact with the ground. Accordingly, a bottom surface of the cleaner body 10, in particular, the first half portion 312 may be maintained at a predetermined angle.

In this state, the detecting part 306 determines whether the cleaner body 10 is being travelled or stopped through the slope of the cleaner body 10, i.e., the angle of the first half portion 312.

Specifically, the wheel motor assembly 63, the battery unit 38 and the main motor 35 may be disposed at a rear of the center of the moving wheel 60. Therefore, the center G of gravity of the cleaner body 10 is located at a rear side further than the rotating center C of the moving wheel 60, and thus the cleaner body 10 is naturally in the state which is intended to be clockwise rotated based on the center of the moving wheel 60.

And the second half portion 313 of the cleaner body 10 may be supported by the rear wheel unit 70 installed at the second half portion 313 of the base 31. Therefore, the cleaner body 10 may be prevented from being excessively rotated clockwise and may be stably maintained at a set angle $\alpha$.

In particular, due to a characteristic of the vacuum cleaner 1, the dust is accumulated in the dust container 50 after the vacuum cleaner 1 is used. In consideration of this fact, the center of gravity of the cleaner body 10 is always located at the second half portion thereof and supported by the rear wheel unit 70, and thus the cleaner body 10 may maintain a constant slope with respect to the ground while being in the stopped state, regardless of an amount of the dust.

In this state, when the detecting part 306 detects an angle of the first half portion 312 and confirms that the first half portion 312 maintains the set angle $\alpha$, it is determined that the cleaner body 10 maintains a set posture in the stopped state. Therefore, the main PCB 301 controls the wheel motor assembly 63 not to be operated, thereby maintaining the stopped state of the cleaner body 10.

Meanwhile, when the user grips and moves forward the handle 23 to use the vacuum cleaner 1, the cleaner body 10 is inclined due to a position of the handle 23. That is, the cleaner body 10 is counterclockwise rotated so that the first half portion 312 is moved further downward.

At this point, the detecting part 306 detects a change in the angle of the first half portion 312 and determines a fact that the movement of the vacuum cleaner 1 starts according to the change in the angle. Therefore, the main PCB 301 may determine that the cleaner body 10 is moved and thus may rotate the moving wheel 60 by driving the wheel motor assembly 63.

And when the movement of the cleaner body 10 is stopped again, the cleaner body 10 is rotated to an initial state by the center of gravity, and the detecting part 306 checks a fact that the angle of the first half portion 312 coincides with the set angle $\alpha$ in the stopped state. Therefore, the main PCB 301 may determine that the movement of the cleaner body 10 is completed and may control the wheel motor assembly 63 to be stopped.

Meanwhile, as illustrated in FIG. 11, the bottom surface of the cleaner body 10, i.e., the center portion 311, the first half portion 312 and the second half portion 313 of the base 31 may have a predetermined angle. The angle of each of the center portion 311, the first half portion 312 and the second half portion 313 may be set variously. Hereinafter, the angle of the base 31 in the stopped state of the cleaner body 10 will be described.

For example, the first half portion 312 may be formed to be inclined at an angle of 27° with respect to the ground. The first half portion 312 may hardly collide with the ground by allowing the first half portion 312 to have the angle of 27° even when the suction hose 24 is pulled and the cleaner body 10 is rotated. Of course, the first half portion 312 may be in contact with the ground due to an unexpected operation. In this case, the movement of the cleaner body 10 may be smoothly performed by a rolling motion of the front wheel 312*a*. Also, the first half portion 312 may be easily moved over the carpet, the door sill or the like due to the slope of the first half portion 312 while the cleaner body 10 is being travelled.

And the center portion 311 may be formed to be inclined at an angle of 7° with respect to the ground while the cleaner body 10 is in the stopped state. When the moving wheel 60 is rotated by the driving of the wheel motor 632 and thus the cleaner body 10 is travelled, the cleaner body 10 is counterclockwise rotated by an angle of about 7°. Therefore, while the cleaner body 10 is being travelled, the center portion 311 is maintained in a horizontal state with the ground, and thus the bottom of the vacuum cleaner 1 may be prevented from being caught by foreign substances or the like in a room.

And the second half portion 313 may be formed to be inclined at an angle of 10° with respect to the ground while the cleaner body 10 is in the stopped state. Therefore, the cleaner body 10 may be clockwise rotated by the center of gravity of the cleaner body 10 which is eccentric to a rear side while the cleaner body 10 is in the stopped state and then may be seated on the ground.

That is, in the stopped state, the cleaner body 10 is already in a state in which the second half portion 313 thereof is moved down due to the center of gravity and thus may be maintained in the stably supported state by the rear wheel unit 70, regardless of the amount of the dust stored in the dust container 50.

Also, due to the inclined second half portion 313, the second half portion 313 may be prevented from colliding with the ground when the suction hose 24 is pulled and the cleaner body 10 is rotated, and thus rotation of the cleaner body 10 may be prevented from being restricted.

Meanwhile, the moving wheel 60 may include a wheel frame 61 which is rotatably installed at the wheel boss 316*a* of the side portion 316 and at which the wheel gear 64 is installed, and a wheel decoration 62 which forms an exterior of the moving wheel 60 by being coupled to an outer surface of the wheel frame 61.

The wheel frame 61 forms a substantive framework of the moving wheel 60 and performs the rolling motion while being in contact with the ground, and a plurality of ribs 611 for reinforcing an entire strength may be radially provided at an inside surface and an outer surface thereof. Also, a wheel gear installing portion 612 to which the wheel gear 64 is fixed is formed at a center of the wheel frame 61. The wheel gear 64 may be rotatably installed at the wheel boss 316*a* while being fixed to the wheel frame 61.

Meanwhile, a wheel opening 621 is formed at a center of the wheel decoration 62, and a coupling member by which the wheel gear 64 and the wheel frame 61 are coupled may be fastened through the wheel opening 621. And a wheel cap 623 may be installed at the wheel opening 621 and may shield the wheel opening 621.

Meanwhile, in FIG. 12, the cleaner body 10 may be divided into a front side and a rear side by a vertical extension line $L_v$, which extends vertically to the ground (or the floor surface), based on the rotating center C of the moving wheel 60.

And the cleaner body 10 may be divided into an upper side and a lower side by a horizontal extension line $L_H$, which extends horizontally with the ground (or the floor surface), based on between the main motor 35 and the battery unit 38.

The cleaner body 10 may be divided into four areas, i.e., four quadrants by the vertical extension line $L_v$ and the horizontal extension line $L_H$. Hereinafter, main configurations of the cleaner body 10 will be described based on the vertical extension line $L_v$ and the horizontal extension line $L_H$.

The main motor 35 may be located at a first quadrant of the cleaner body 10, i.e., a rear of the vertical extension line $L_v$ and an upper side of the horizontal extension line $L_H$. And the battery unit 38 may be located at a fourth quadrant of the cleaner body 10, i.e., the rear of the vertical extension line $L_v$ and a lower side of the horizontal extension line $L_H$. And a hole formed at a position at which the connector 401 or the suction hose 24 is connected may be located at a second quadrant of the cleaner body 10, i.e., a front of the vertical extension line $L_v$ and the upper side of the horizontal extension line $L_H$. And at least a part of a bottom surface of the dust container 50 may be located at a third quadrant of the cleaner body 10, i.e., the front of the vertical extension line $L_v$ and the lower side of the horizontal extension line $L_H$.

Due to such an arrangement, the center G of gravity of the entire cleaner body 10 may be located at the rear of the vertical extension line $L_v$. At this time, the center G of gravity may be located at any one of the upper side and the lower side of the horizontal extension line $L_H$. However, the center G of gravity should be located at a position at which a rear end of the cleaner body 10 or the rear wheel unit 70 is rotatable to be in contact with the ground.

Also, the center G of gravity may be disposed so that the rear end of the cleaner body 10 or the rear wheel unit 70 is in contact with the ground while the vacuum cleaner 1 is in the stopped state, regardless of the amount of the dust collected in the dust container 50 by using the vacuum cleaner 1.

Also, the wheel motor assembly 63 may also be located at the rear of the vertical extension line $L_v$ so that the center G of gravity is more easily disposed at the rear side.

Figure 13:
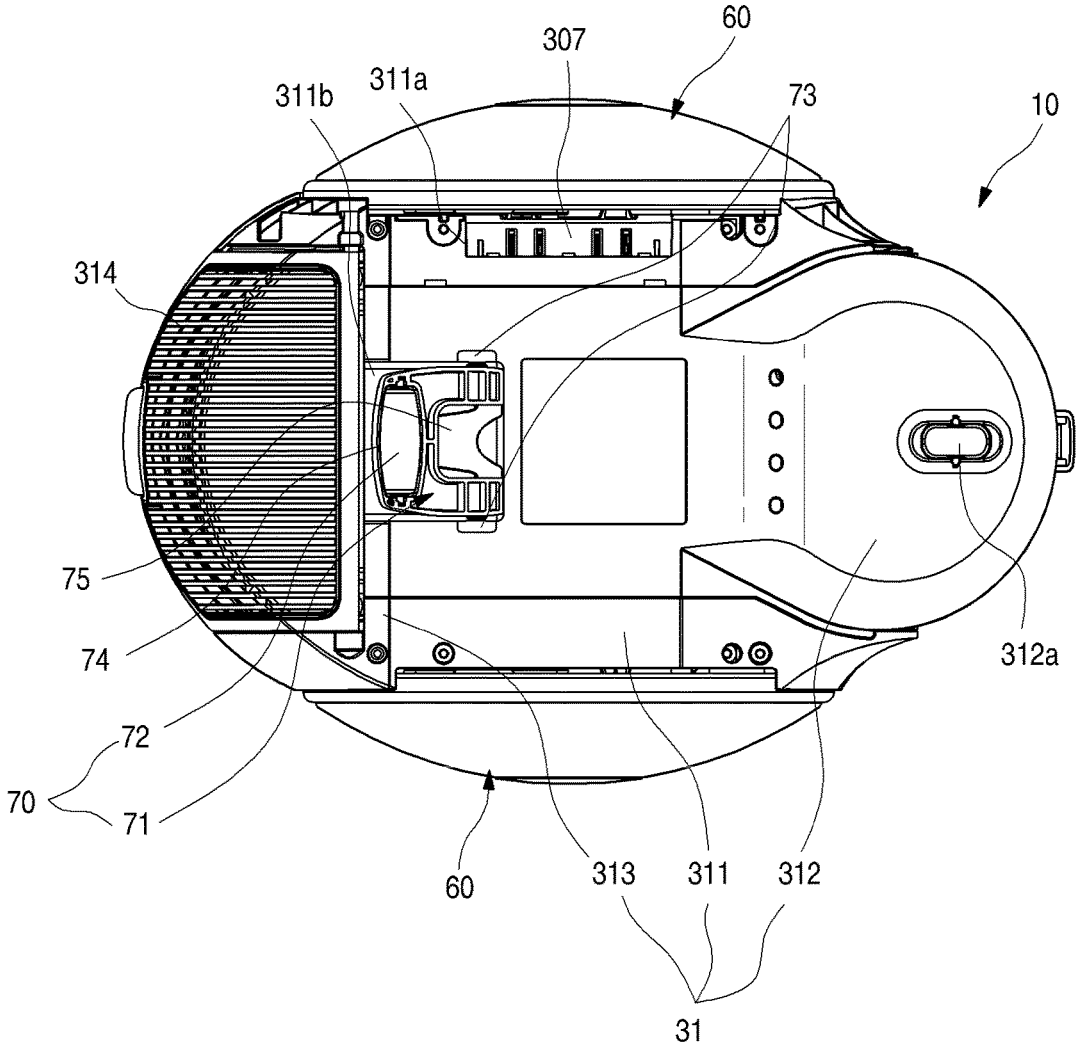
FIG. 13 is a bottom view of the cleaner body.
Figure 14:
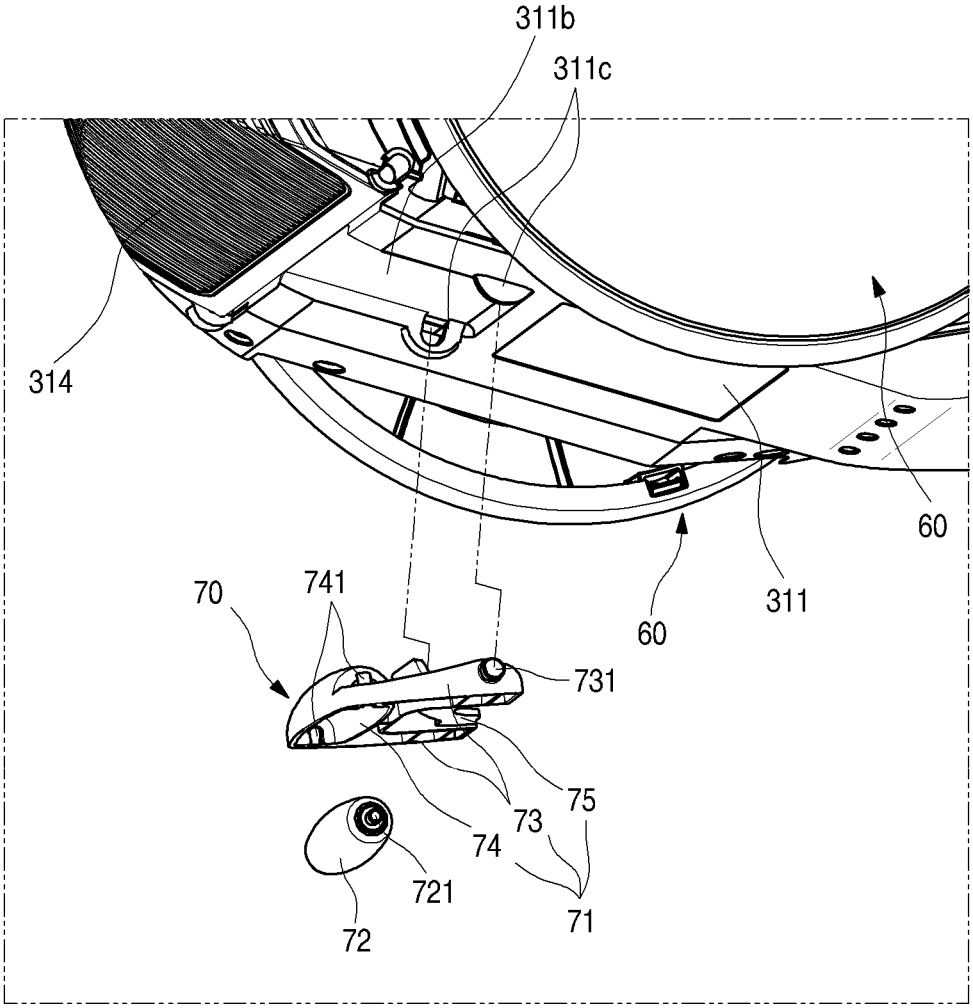
FIG. 14 is an exploded perspective view illustrating a coupling structure of a rear wheel unit according to the embodiment of the present invention.
Figure 15:
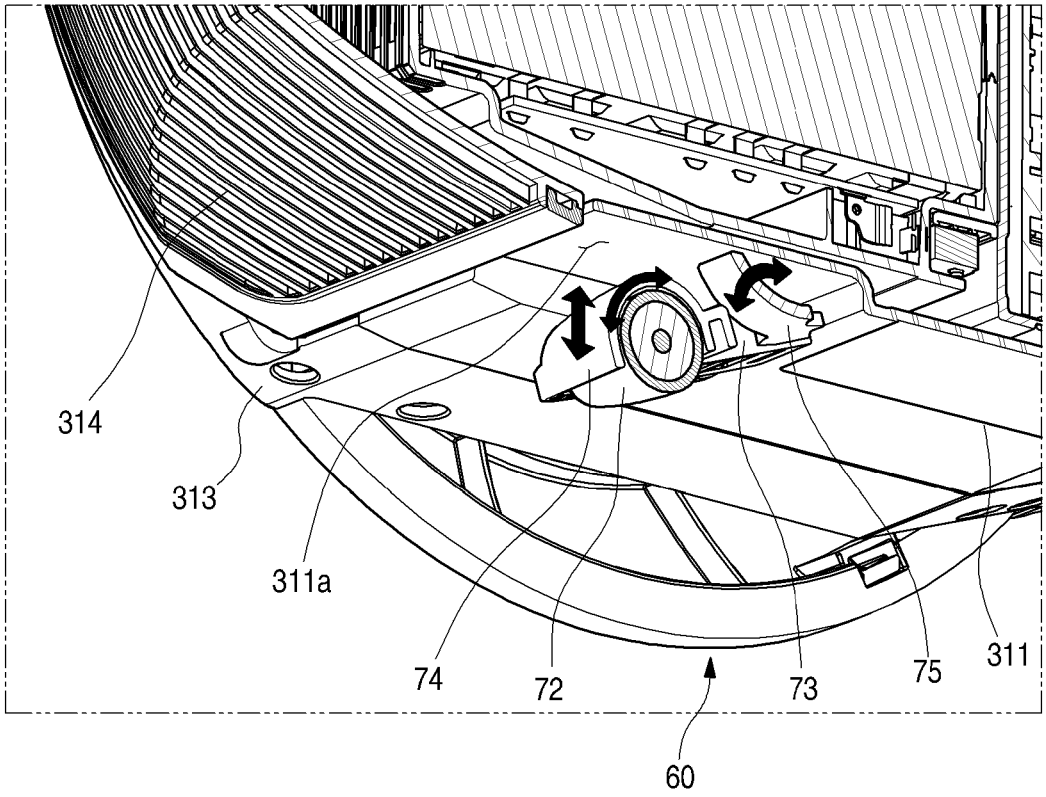
FIG. 15 is a cross-sectional view illustrating an operating state of the rear wheel unit.

FIG. 13 is a bottom view of the cleaner body 10. And FIG. 14 is an exploded perspective view illustrating a coupling structure of the rear wheel unit 70 according to the embodiment of the present invention. And FIG. 15 is a cross-sectional view illustrating an operating state of the rear wheel unit 70.

As illustrated in the drawings, the rear wheel unit 70 may be provided at the base 31. A base recessing portion 311*b* which is recessed inward is formed at the rear end of the center portion 311 of the base 31. And a wheel installing portion 311*c* for installing the rear wheel unit 70 is formed at a front end of each of both side surfaces of the base recessing portion 311*b*.

The rear wheel unit 70 is in contact with the ground while the cleaner body 10 is not moved and allows the cleaner body 10 to be maintained in a set posture. And the rear wheel unit 70 is in contact with the ground while the cleaner body 10 is rotated so that the first half portion 312 is lifted, also provides elasticity for reverse rotation of the cleaner body 10 and thus may prevent the cleaner body 10 from being excessively rotated or overturned.

The rear wheel unit 70 may include a wheel supporter 71 and a rear wheel 72. The wheel supporter 71 allows the rear wheel 72 to be rotatably installed and also is in contact with a lower surface of the base 31, thereby providing predetermined elasticity.

Specifically, the wheel supporter 71 may include one pair of legs 73 which are provided at both of left and right sides thereof, a wheel accommodating portion 74 which connects front ends of the legs 73 and at which the rear wheel 72 is installed and an elastic portion 75 which is provided between the legs 73 and is in contact with the base 31 to provide the elasticity.

The legs 73 serve to install the wheel supporter 71 and may be provided at both sides which are spaced apart from each other, and a leg protrusion 731 which protrudes outward may be formed at an upper end of each of the legs 73. The leg protrusion 731 may be inserted inside the wheel installing portion 311*c*, and the wheel supporter 71 may be installed to be rotatable using the leg protrusion 731 as an axis.

The wheel accommodating portion 74 is provided at the front end of each of the pair of the legs 73 and formed to connect between the pair of legs 73. And the wheel accommodating portion 74 is formed in a shape which is opened downward and provides a space in which the rear wheel 72 is accommodated. And a shaft installing portion 741 at which a rotating shaft 721 of the rear wheel 72 is rotatably connected may be further formed at each of both ends of the wheel accommodating portion 74. Therefore, the rear wheel 72 may be rotated while being accommodated inside the wheel accommodating portion 74.

The elastic portion 75 may be provided between the legs 73 and may extend from a first half portion of each of the legs 73 toward a second half portion thereof. And the elastic portion 75 may extend with a predetermined curvature so that an extending end thereof is directed to the base 31. Also, the elastic portion 75 may be formed in a plate shape and may extend to be elastically deformed when being in contact with the base 31.

The extending end of the elastic portion 75 may be in contact with the base 31 while the vacuum cleaner 1 is stopped. At this time, the rear wheel 72 may be in contact with the rear wheel 72. Therefore, the cleaner body 10 may be supported by the pair of moving wheels 60 and the rear wheel 72 located at a rear of the moving wheel 60 and may be maintained in a stable state.

And when the cleaner body 10 is rotated using the moving wheel 60 as an axis by moving the cleaner body 10, the elastic portion 75 may be elastically deformed and thus may prevent the cleaner body 10 from being excessively rotated or overturned. And when the vacuum cleaner 1 is moved and then stopped and thus an external force which rotates the vacuum cleaner 1 is removed, the cleaner body 10 is returned to its original position due to a restoring force of the elastic portion 75.

Meanwhile, the terminal installing portion 311*a* which allows the power supply terminal 307 to be installed and exposed downward is formed at one side of the base 31 corresponding to the power supply terminal 307. The terminal installing portion 311*a* is formed so that a lower surface thereof is opened, and the power supply terminal 307 may be provided therein. And the terminal installing portion 311*a* may be located adjacent to one of the moving wheels 60. Accordingly, by seating and fixing the moving wheel 60 at the charging device, the power supply terminal 307 and the charging device may be aligned with each other.

Figure 16:
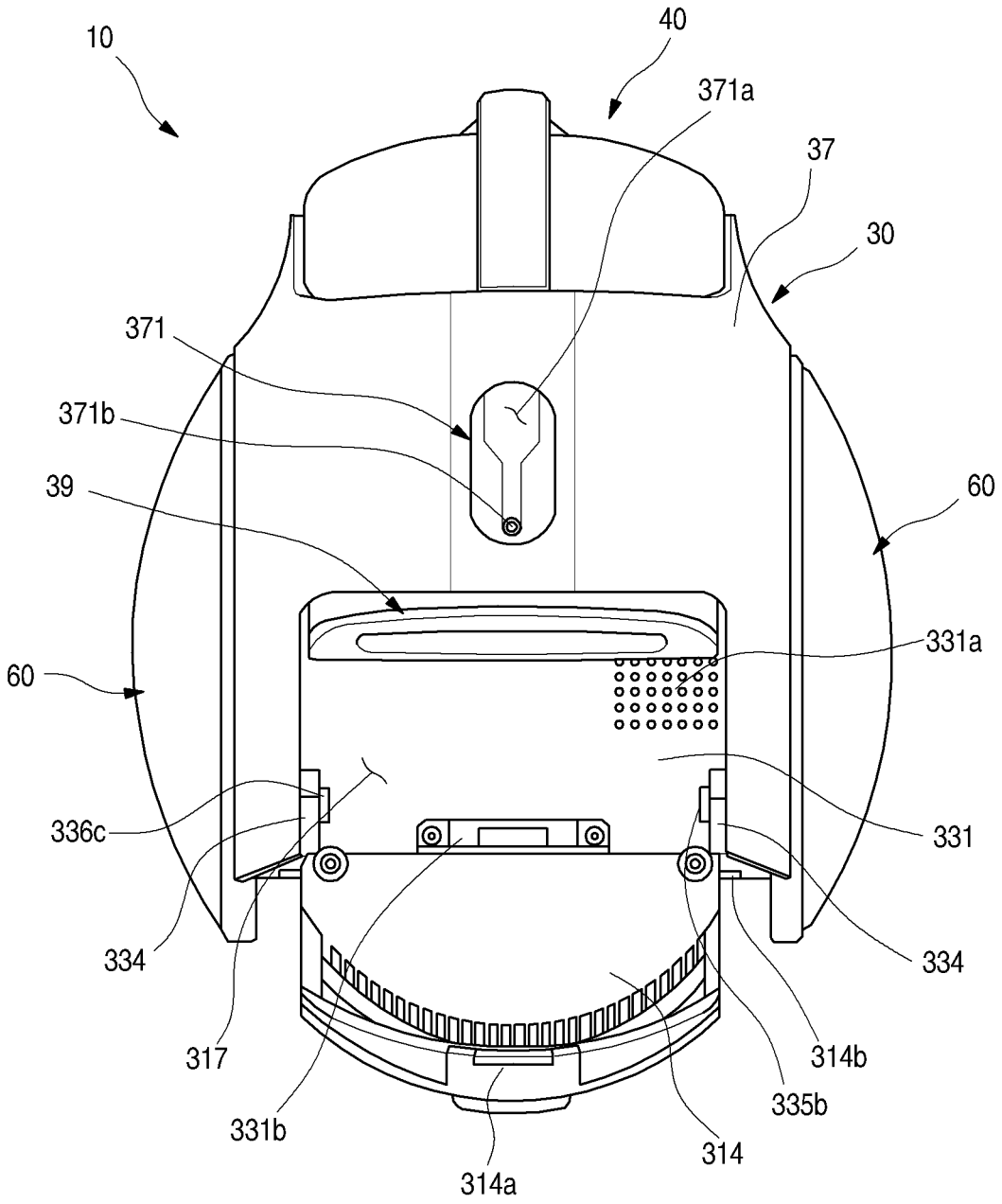
FIG. 16 is a rear view illustrating a state in which a rear cover of the cleaner body is opened.
Figure 17:
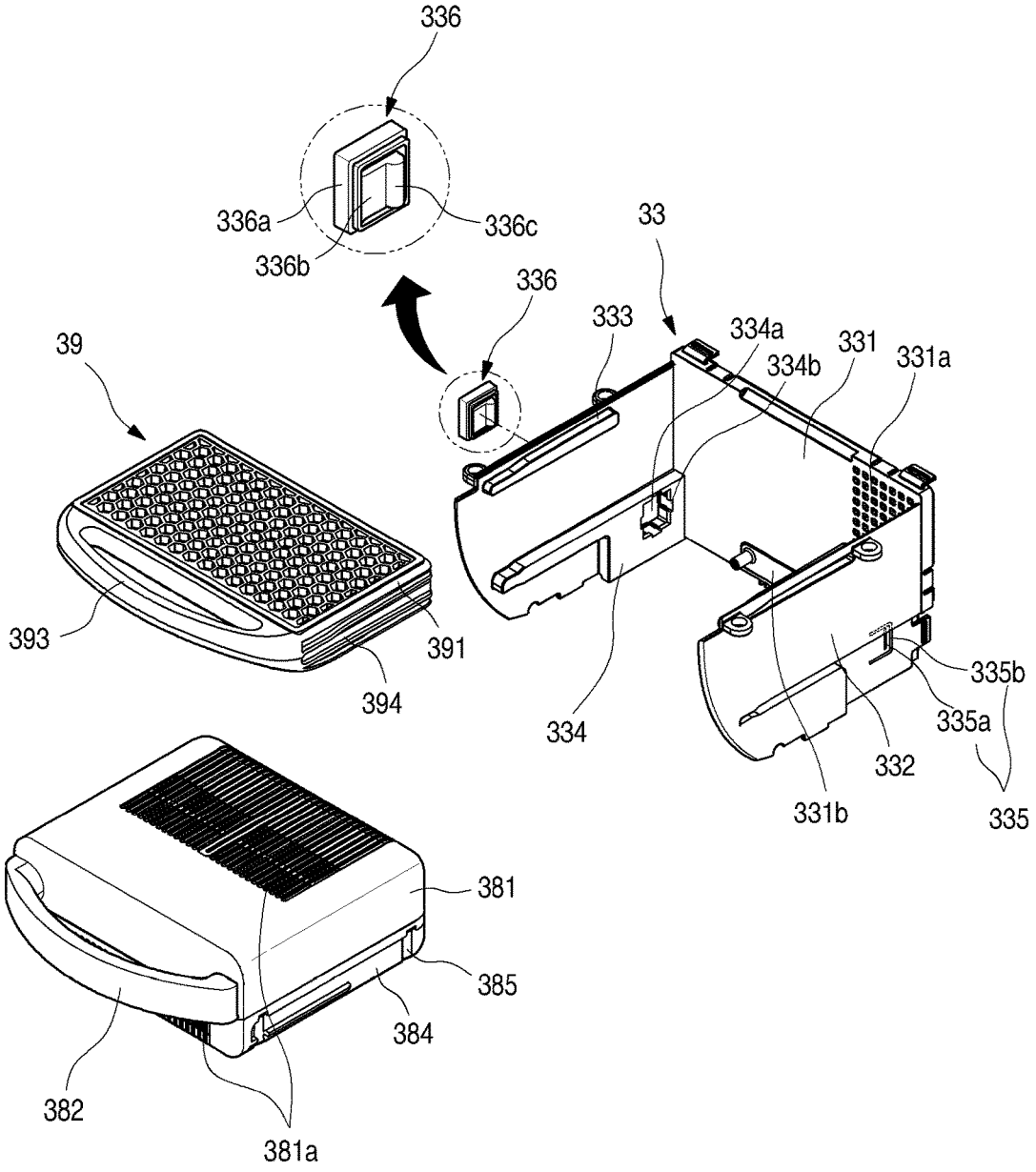
FIG. 17 is an exploded perspective view illustrating a coupling structure of a battery and a filter according to the embodiment of the present invention.

FIG. 16 is a rear view illustrating a state in which the rear cover of the cleaner body 10 is opened. And FIG. 17 is an exploded perspective view illustrating a coupling structure of a battery and a filter according to the embodiment of the present invention.

As illustrated in the drawings, the rear cover 314 may be provided at a rear surface of the cleaner body 10. The rear cover 314 may be rotatably installed at the base 31 and may be formed to open and close the rear opening 317 formed by the base 31 and the upper decoration 37 by rotation thereof.

A rear cover restricting portion 314*a* which is selectively fixed to a rear end of the upper decoration 37 may be formed at an upper end of the rear cover 314. Therefore, the rear cover 314 may be opened and closed by an operation of the rear cover restricting portion 314*a*.

And a cover rotating shaft 314*b* is formed to protrude from each of both sides of the lower end of the rear cover 314. The cover rotating shaft 314*b* may be coupled to the base 31, and the rear cover 314 may open and close the rear opening 317 by being rotated about the cover rotating shaft 314*b* when the rear cover 314 is opened and closed.

Meanwhile, a space in which a filter and the battery unit 38 are provided may be formed at the second half portion of the cleaner body 10, i.e., a rear of the center of the moving wheel 60. And the space in which the filter unit 39 and the battery unit 38 are accommodated may be defined by the lower frame 33. The lower frame 33 includes the first barrier 331 and the first side wall 332, and the space in which the filter unit 39 and the battery unit 38 are provided may be formed by coupling between the base 31 and the upper frame 34.

The filter unit 39 may include a filter case 391 which forms an exterior and a filter member 392 which is provided inside the filter case 391. The filter member 392 serves to filter ultra-fine dust (defined as particles smaller than dust and fine dust) contained in the air passed through the dust container 50 and the main motor 35, and a HEPA filter may be generally used as the filter member 392. Of course, if necessary, various types of filters which filter the ultra-fine dust may be used as the filter member 392.

The filter case 391 may be disposed at an upper portion of the space and may be formed to be in contact with a bottom surface of the upper frame 34 while being in an installed state. Therefore, all of the air introduced into the space through the plate hole 341*a* of the upper frame 34 may be purified while passing through the filter unit 39, may cool the battery unit 38 and then may be discharged to an outside.

Some of the air introduced into the space through the plate hole 341*a* may be moved forward through the first barrier hole 331*a* of the first barrier 331 and may cool the noise filter 302 and the main PCB 301 during the above-described process.

A filter handle 393 may be formed at a rear end of the filter case 391. The filter handle 393 may be exposed when the rear cover 314 is opened, and thus the user may separate the filter unit 39 from the space by gripping and pulling the filter handle 393.

And a filter groove 394 may be formed at each of both side surfaces of the filter case 391. The filter groove 394 may extend from the rear end of the filter case 391 in a lengthwise direction and may be inserted into a filter guide 333 formed at the second side wall 343.

That is, when the filter case 391 is installed in the space, the filter case 391 is inserted while the filter grooves 394 are aligned between the filter guides 333 formed at both side surfaces thereof. Therefore, the filter case 391 may be completely inserted into the space along the filter guides 333. In this state, the filter case 391 may be maintained in an installed state to be in contact with the bottom surface of the upper frame 34.

The battery unit 38 may supply electric power necessary to drive the vacuum cleaner 1. The battery unit 38 may be configured with a secondary cell which is chargeable and dischargeable. Of course, a power cord (not shown) for supplying commercial electric power may be separately connected to the battery unit 38.

Meanwhile, although not illustrated, in the case of a model in which the battery unit 38 is not provided, a cord reel (not shown) on which an electric wire for supplying the electric power is wound may be provided instead of the battery unit 38. The center of gravity may be moved backward by the cord reel.

The battery unit 38 may include a battery case 381 and a secondary cell 383 which is accommodated inside the battery case 381. The secondary cell 383 may be arranged to be aligned in the battery case 381.

The battery case 381 may be formed in a size which is accommodated in the space, and a battery grille 381*a* may be formed at an upper surface and a lower surface thereof and a position thereof corresponding to the rear cover 314. Therefore, the air passed through the filter unit 39 and introduced into the space may cool the secondary cell 383 while passing through an inside of the battery case 381 via the battery grille 381*a*.

And a battery handle 382 which is gripped by the user when the battery unit 38 is inserted into or withdrawn from the space may be formed at a rear surface of the battery case 381. And battery grooves 384 may be formed at both side surfaces of the battery case 381. The battery grooves 384 may be recessed from both of the side surfaces of the battery case 381 and may extend backward from front ends thereof.

A battery guide 334 formed at a lower portion of the first side wall 332 is inserted into the battery groove 384. When the battery unit 38 is installed, the battery guide 334 may be inserted along the battery groove 384, and thus the battery unit 38 may be correctly installed.

Meanwhile, a battery restricting portion 335 and a battery restricting member 336 may be provided at the battery guides 334 of both sides of the first side wall 332, respectively. The battery restricting portion 335 and the battery restricting member 336 may serve to allow the battery unit 38 to be maintained in an installed state inside the space, may be located at positions facing each other and may be caught and restricted by battery restricting grooves 385 formed at both side surfaces of the battery case 381.

Specifically, the battery restricting portion 335 may include a first elastic portion 335*a* which is formed by cutting a part of the first side wall 332 and a first restricting protrusion 335*b* which is formed at an end of the first elastic portion 335*a*. Therefore, while the battery unit 38 is inserted, the first elastic portion 335*a* may be elastically deformed, and when the battery unit 38 is completely inserted, the first restricting protrusion 335*b* is caught and restricted by the battery restricting grooves 385 and thus may restrict one side of the battery unit 38.

Meanwhile, the battery restricting member 336 is installed at and fixed to the first side wall 332 which faces the battery restricting portion 335. A side hole 334*a* which is formed in a shape corresponding to the battery restricting member 336 is opened at the first side wall 332 at which the battery restricting member 336 is installed. And a restricting member fixing portion 334*b* to which a perimeter of the battery restricting member 336 is fitted and fixed may be formed at the side hole 334*a*. Therefore, the battery restricting member 336 may be installed and fixed by the fitting, and a hook may be formed at an end of the restricting member fixing portion 334*b*, and thus the battery restricting member 336 may be maintained in a fixed state.

The battery restricting member 336 may be formed of a different type of material from that of the battery restricting portion 335. For example, the battery restricting portion 335 may be integrally formed with the lower frame 33 and may be injection-molded with an ABS material. And the battery restricting member 336 may be injection-molded with a POM material. The battery restricting member 336 and the battery restricting portion 335 may be separately formed of different materials from each other, thus may prevent a damage of a restricting portion when the battery unit 38 is installed and may be more effectively coupled.

The battery restricting member 336 may include a restricting member flange 336*a* formed in a quadrangular shape corresponding to the side hole 334*a*. The restricting member flange 336*a* may be maintained in an installed and fixed state to the side hole 334*a* by a perimeter of the battery restricting portion 335. And the battery restricting member 336 may include a second elastic portion 336*b* and a second restricting protrusion 336*c*.

The second elastic portion 336*b* and the second restricting protrusion 336*c* may be formed in shapes corresponding to the first elastic portion 335*a* and the first restricting protrusion 335*b*. That is, the second elastic portion 336*b* may be formed by cutting an inside of the battery restricting member 336, may extend in a predetermined length and may have elasticity. And the second restricting protrusion 336*c* may be formed at an end of the extending second elastic portion 336*b*.

Therefore, while the battery unit 38 is inserted, the second elastic portion 336*b* may be elastically deformed, and when the battery unit 38 is completely inserted, the second restricting protrusion 336*c* may be caught and restricted by the battery restricting grooves 385 and thus may restrict the battery unit 38.

Meanwhile, a battery terminal 331*b* which is connected to the battery unit 38 while the battery unit 38 is completely inserted may be provided at a lower end of the first barrier 331. The battery terminal 331*b* may protrude in an insertion direction of the battery unit 38 and may be formed to be coupled to a front surface of the battery unit 38. And the battery terminal 331*b* may be electrically connected to the battery unit 38 and may supply the electric power for driving the internal elements of the vacuum cleaner 1.

A holder 371 may be provided above the rear opening 317 which is shielded by the rear cover 314. The holder 371 serves to fix, install and accommodate the extension pipe 22 when the vacuum cleaner 1 is not used and may be formed so that an opening 371*a* formed therein becomes narrower from an opening upper side thereof toward a lower side thereof.

And the holder 371 may be molded separately from the upper decoration 37 and may be inserted and installed into the upper decoration 37. And the holder 371 may be additionally fixed to the body part 30 by a holder fixing member 371*b* and may be prevented from being damaged when a shock and a load are generated due to the installation of the extension pipe 22. The holder 371 may be formed of a metallic material. The holder 371 may be molded by a die-casting and may have a higher strength.

Figure 18:
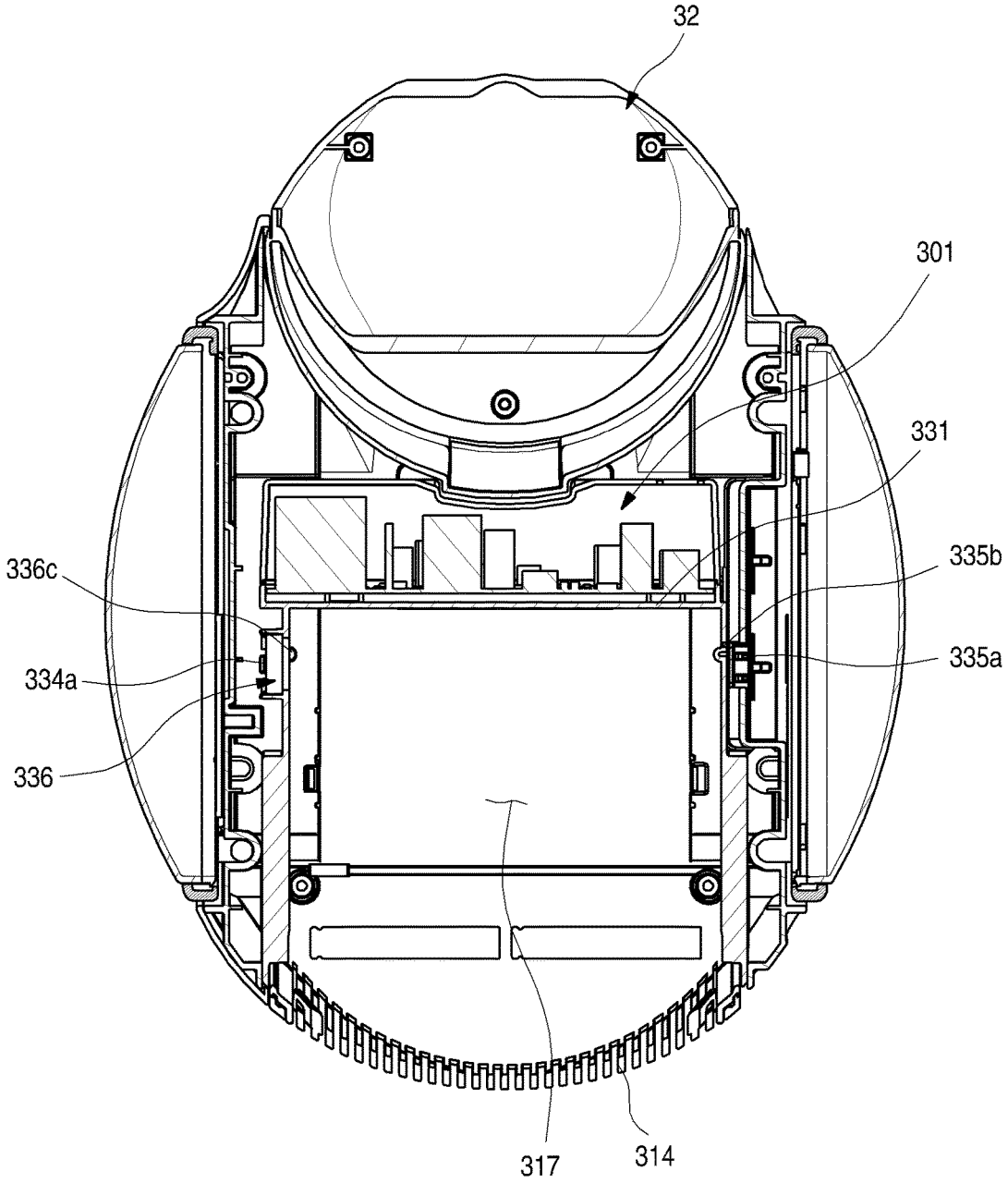
FIG. 18 is a cross-sectional view of the cleaner body before the battery is installed.

FIG. 18 is a cross-sectional view of the cleaner body 10 before the battery is installed. And FIG. 19 is a cross-sectional view of the cleaner body 10 in a state in which the battery is installed.

As illustrated in FIG. 18, before the battery unit 38 is installed, the battery restricting portion 335 and the battery restricting member 336 are disposed at positions which face each other. And the first elastic portion 335*a* and the second elastic portion 336*b* are in a state in which the external force is not applied thereto, and the first restricting protrusion 335*b* and the second restricting protrusion 336*c* are in a protruding state to an internal space of the lower frame 33.

In this state, the user may open the rear cover 314 to expose the space and then may install the battery unit 38. After the rear cover 314 is opened, the battery unit 38 is inserted inside the space. At this point, the battery unit 38 may be slidingly inserted while the battery guide 334 and the battery groove 384 are aligned. When the battery unit 38 is completely inserted, the front surface of the battery unit 38 may be coupled to the battery terminal 331*b* and may supply the electric power to the internal elements of the cleaner body 10.

Figure 19:
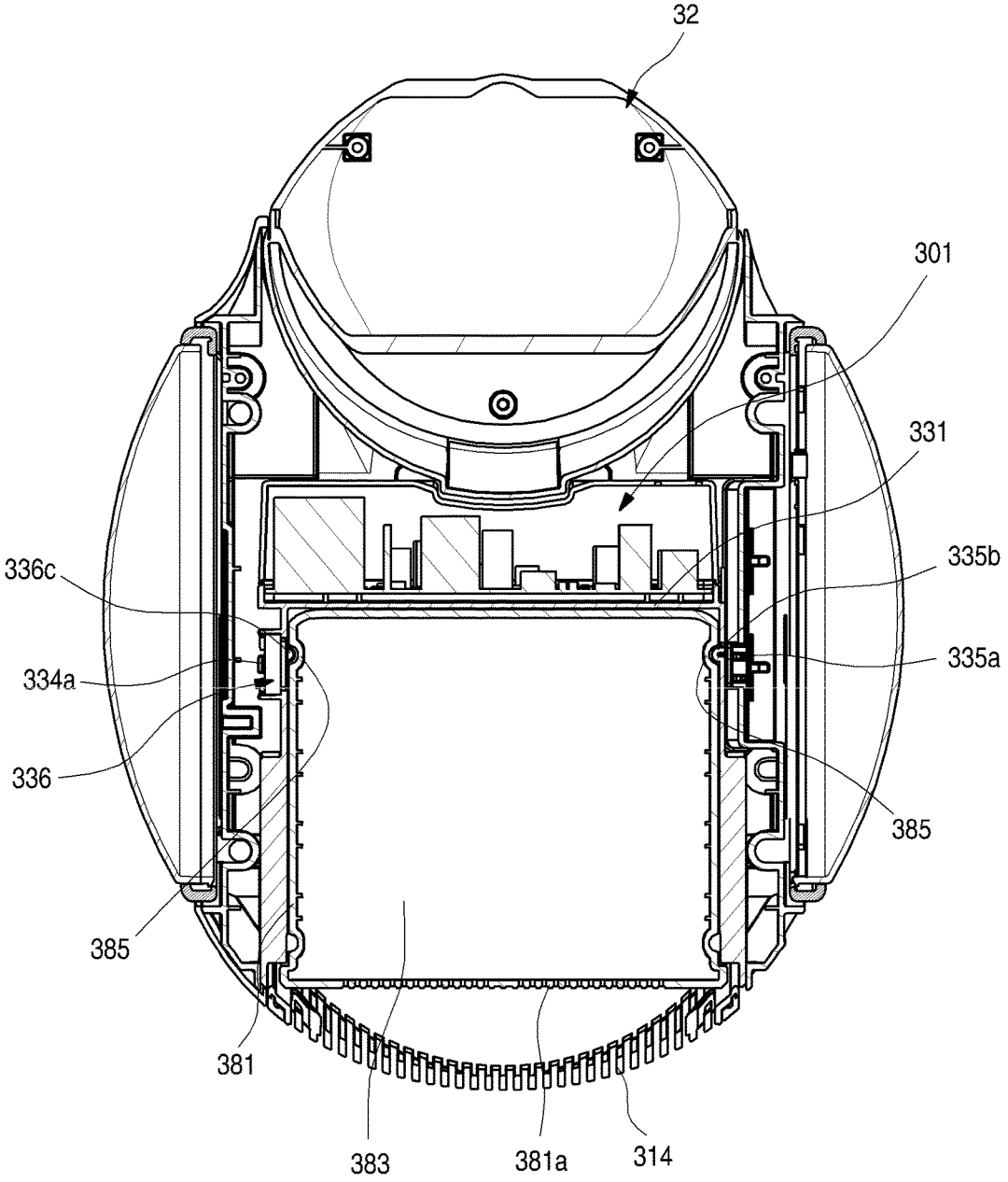
FIG. 19 is a cross-sectional view of the cleaner body in a state in which the battery is installed.

While the battery unit 38 is completely inserted and installed, the front surface of the battery unit 38 is in a contacting state with the first barrier 331, as illustrated in FIG. 19. While the battery unit 38 is being inserted, the first elastic portion 335*a* and the second elastic portion 336*b* are elastically deformed outward. And in a state in which the battery unit 38 is inserted, the first restricting protrusion 335*b* and the second restricting protrusion 336*c* may be inserted into the battery restricting grooves 385 formed at both side surfaces of the battery case 381 and may be maintained in a fixed state.

Figure 20:
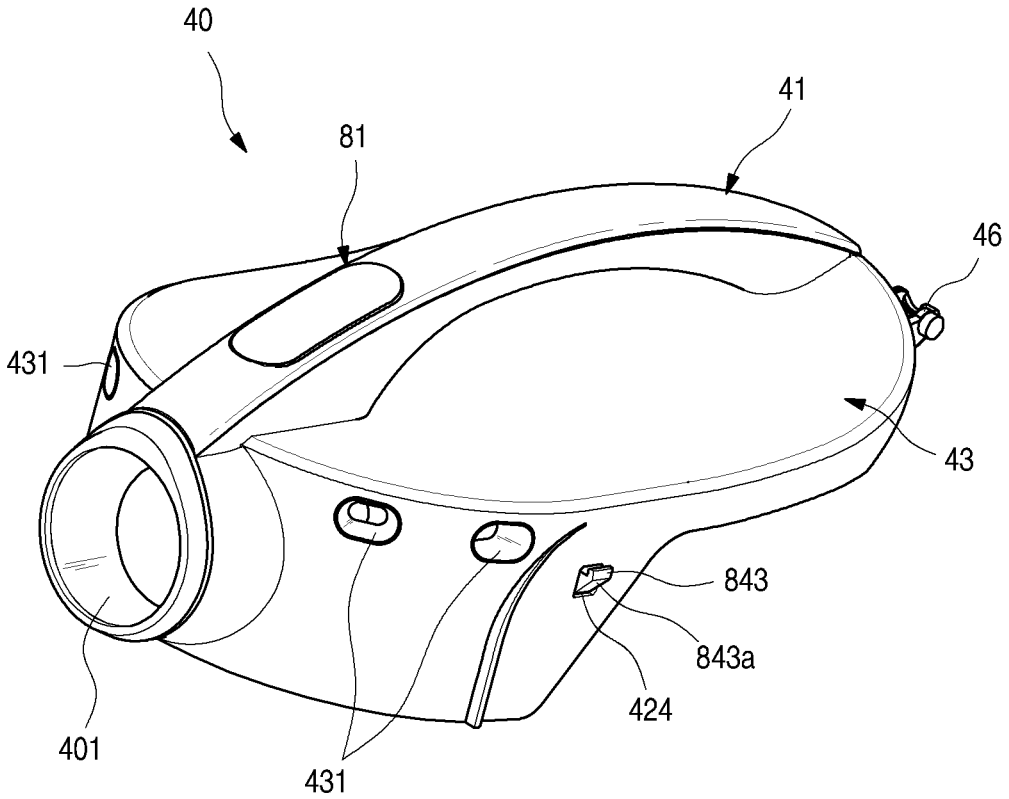
FIG. 20 is a perspective view of the cover member.
Figure 21:
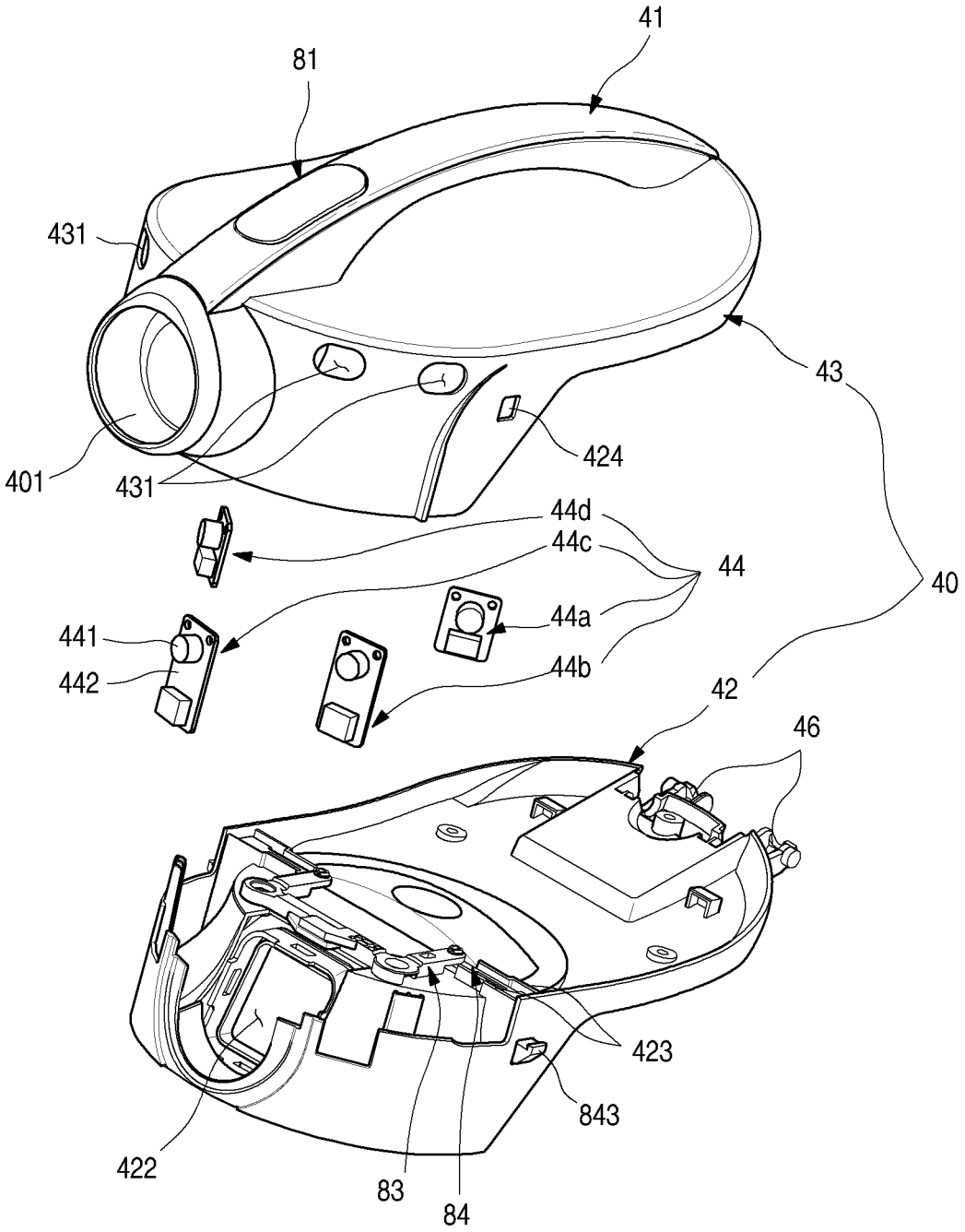
FIG. 21 is an exploded perspective view of the cover member.
Figure 22:
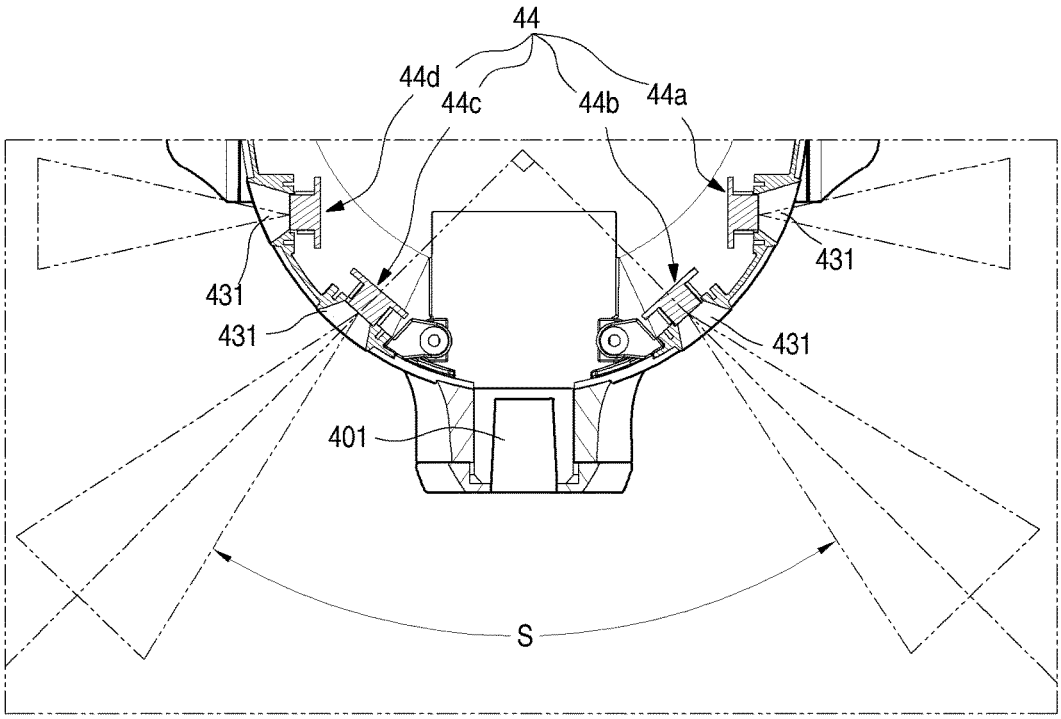
FIG. 22 is a partial cross-sectional view illustrating a coupling structure of the cover member and an obstacle detecting member.

FIG. 20 is a perspective view of the cover member. And FIG. 21 is an exploded perspective view of the cover member. And FIG. 22 is a partial cross-sectional view illustrating a coupling structure of the cover member and the obstacle detecting member.

As illustrated in the drawings, the cover member 40 may form the upper portion of the cleaner body 10 and may be formed to have a structure which shields an upper end of the upper decoration 37 and an upper end of the dust container 50.

The cover member 40 may generally include a cover base 42 and an outer cover 43. The cover base 42 forms a lower surface of the outer cover 43 and substantially shields the dust container 50 and the opened upper surface of the body part 30.

A cover member coupling portion 421 is formed at a rear end of the cover base 42, and the cover member coupling portion 421 may be shaft-coupled to an upper end of the body part 30, more specifically, the rear end of the upper decoration 37. And a connecting hole 422 which is connected to the connector 401 may be formed at a front end of the cover base 42.

The obstacle detecting member 44 may be provided at the cover base 42. The obstacle detecting member 44 serves to check an obstacle while the cleaner body 10 is being travelled and may be disposed along a front surface of the cover base 42.

A plurality of obstacle detecting members 44 may be provided at a center of the front surface of the cover base 42, i.e., both of left and right sides based on the connector 401. That is, two obstacle detecting members 44 may be provided at each of the left and right sides based on the center of the cover base 42, and each of the obstacle detecting members 44 may be formed to have a detection range of about 25° using a laser sensor 441. And the plurality of obstacle detecting members 44 may be disposed so that adjacent obstacle detecting members 44 are directed in different directions from each other.

The obstacle detecting members 44 may include front sensors 44*b* and 44*c* and side sensors 44*a* and 44*d*. The front sensors 44*b* and 44*c* serve to detect the obstacle located at a front of the cleaner body 10. When the obstacle is appeared at the front of the cleaner body 10 while the cleaner body 10 is travelled, the front sensors 44*b* and 44*c* detect the obstacle. And the side sensors 44*a* and 44*d* serve to detect the obstacle located at a lateral side of the cleaner body 10. When the obstacle is appeared at the lateral side adjacent to the cleaner body 10 while the cleaner body 10 is travelled, the side sensors 44*a* and 44*d* detect the obstacle. In particular, the side sensors 44*a* and 44*d* allow the cleaner body 10 to be travelled without a collision with a corner of a wall surface through a combination of the front sensors 44*b* and 44*c*.

More specifically, the front sensors 44*b* and 44*c* may be respectively located at both of left and right sides of the connector 401 and may be disposed to emit light in a diagonal direction between the front and the lateral side. That is, as illustrated in FIG. 22, centers of the front sensors 44*b* and 44*c* may be located at positions which are clockwise and counterclockwise rotated at 45° with respect to a center of the connector 401. Therefore, the centers of the front sensors 44*b* and 44*c* may form an angle of 90° with respect to each other.

And since the detection range of each of the obstacle detecting members 44 is about 25°, a non-detected area S is generated between the front sensors 44*b* and 44*c*. The non-detected area S may have an angle of 65°. The non-detected area S is an area at which the suction hose 24 may be located while the cleaner body 10 is travelled and which prevents the suction hose 24 from being regarded as the obstacle by the front sensors 44*b* and 44*c*. That is, even when the user moves the suction hose 24 while performing a cleaning operation, the front sensors 44*b* and 44*c* may be prevented from erroneously recognizing the suction hose 24 as the obstacle, and thus the cleaner body 10 may be prevented from being abnormally travelled.

The side sensors 44*a* and 44*d* are located at a rear side further than the front sensors 44*b* and 44*c* and disposed to emit the light toward the lateral side of the cleaner body 10. That is, the side sensors 44*a* and 44*d* may be disposed at both sides based on the connector 401 to form an angle of about 90°. Therefore, the side sensors 44*a* and 44*d* may detect the obstacle appeared at the lateral side of the cleaner body 10.

Meanwhile, each of the side sensors 44*a* and 44*d* may be formed to have a detecting distance shorter than that of each of the front sensors 44*b* and 44*c*. For example, each of the front sensors 44*b* and 44*c* may be formed to have a detection distance L1 of about 600 mm toward the front side, and each of the side sensors 44*a* and 44*d* may be formed to have a detection distance L2 of about 350 mm toward the lateral side.

Since the obstacle located at the front of the cleaner body 10 has a high possibility of interfering with the cleaner body 10 while the cleaner body 10 is travelled, it is necessary to detect the obstacle which is located at a long distance. In the case of the obstacle which is located at the lateral side, there is a low possibility of interfering with the cleaner body 10 while the cleaner body 10 is travelled, and when a distant object located at the lateral side is recognized as the obstacle, it may be impossible that the cleaner body 10 is normally travelled.

In particular, when the detection distance L2 of each of the side sensors 44*a* and 44*d* is set shorter than that L1 of each of the front sensors 44*b* and 44*c*, the cleaner body 10 may smoothly escape from a wall surface or a corner when passing the wall surface or the corner.

Meanwhile, the obstacle detecting members 44 may include the laser sensor 441 and a sensor substrate 442 on which the laser sensor 441 is installed. Elements for driving or controlling the laser sensor 441 may be further installed on the sensor substrate 442. Of course, instead of the laser sensor 441, various means, such as an ultrasonic sensor, a proximity sensor and a vision camera, which detect the obstacle located at the front side may be used as the obstacle detecting members 44.

And a locking assembly 80 which enables the cover member 40 to be selectively restricted may be further provided between the cover base 42 and the outer cover 43. The locking assembly 80 may include a push member 81, and a main link 83 and a sub-link 84 which are interlocked with the push member 81.

The outer cover 43 forms an exterior of the cover member 40 and forms an exterior of the upper portion of the cleaner body 10 while the cover member 40 is closed. The connector 401 connected to the fitting portion 241 of the suction hose 24 is formed at a front end of the outer cover 43. The connector 401 is connected to the connecting hole 422 and allows the dust and the air suctioned through the suction unit 20 to be introduced toward the dust container 50.

A detecting hole 431 may be formed at a front surface of the outer cover 43 based on the connector 401. The detecting hole 431 may be opened at a position corresponding to the laser sensor 441 and may be formed so that the light for detecting the obstacle is transmitted and received therethrough.

Meanwhile, the detecting hole 431 may be opened at a position corresponding to each of the front sensors 44*b* and 44*c* and the side sensors 44*a* and 44*d* and may be formed so that both of internal side surfaces thereof are inclined. Accordingly, the light may be emitted by a set angle range.

And if necessary, a hole cover 432 which is formed of a material through which the light of the laser sensor 441 is transmitted and which shields the detecting hole 431 may be further provided at the detecting hole 431. A plurality of detecting holes 431 may be formed at the same height and may be located at positions symmetric to each other based on the connector 401. As described above, the detecting holes 431 and the obstacle detecting members 44 may be disposed at a front surface of the cover member 40, which is not shielded by the body part 30 but is exposed forward, to detect the obstacle while the cleaner body 10 is travelled.

The grip portion 41 may be formed at an upper surface of the outer cover 43. The grip portion 41 may extend from one side of the connector 401 to a rear end of the outer cover 43. And the push member 81 which is pushed by the user to selectively restrict the cover member 40 may be provided at the grip portion 41. By an operation of the push member 81, a cover restricting protrusion 843 may selectively protrude toward both sides of the cover member 40 and may selectively restrict the cover member 40 to the body part 30.

Figure 23:
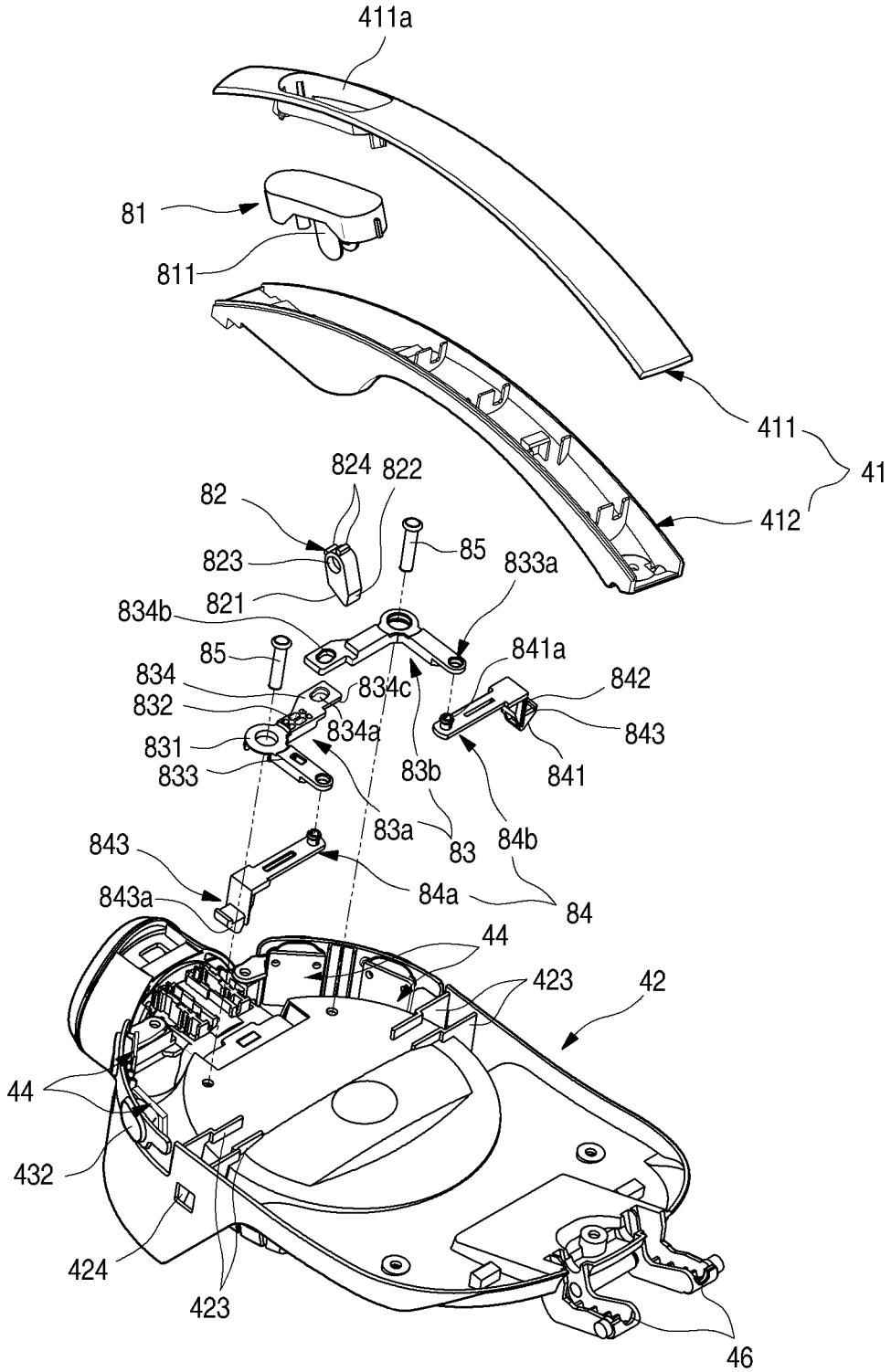
FIG. 23 is an exploded perspective view illustrating a coupling structure of a locking assembly according to the embodiment of the present invention.

FIG. 23 is an exploded perspective view illustrating a coupling structure of the locking assembly according to the embodiment of the present invention.

As illustrated in the drawing, the locking assembly 80 may include the push member 81 which is pushed by the user, a transmission member 82 which transmits the operation of the push member 81, the main link 83 which is rotated by the transmission member 82 and the sub-link 84 which is horizontally moved by rotation of the main link 83.

The push member 81 may be accommodated inside the grip portion 41 and may be disposed to be movable vertically. The grip portion 41 may be formed by coupling a grip portion cover 411 with a grip portion body 412, and the push member 81 may be installed at the grip portion body 412. A cover opening 411*a* may be formed at the grip portion cover 411, and the push member 81 may be exposed through the cover opening 411*a*.

A transmission member installing portion 811 which extends downward is formed at a lower surface of the push member 81. The transmission member 82 is installed at the transmission member installing portion 811. The transmission member 82 and the push member 81 may be shaft-coupled to each other. When the push member 81 is vertically moved, the transmission member 82 may be vertically moved together while being rotated at a predetermined angle.

And a transmission member inclined portion 821 may be formed at a lower surface of the transmission member 82. The transmission member inclined portion 821 serves to be in contact with the main link 83 which will be described below and to move the main link 83 and is formed so that a width thereof is increased upward from a lower end thereof to form an inclined surface.

The main link 83 and the sub-link 84 may be coupled and interlocked with each other, and one pair of main links 83 and one pair of sub-links 84 may be provided at both of left and right sides based on a center of the cover base 42, respectively. That is, the main links 83 and the sub-links 84 may include a first main link 83*a* and a first sub-link 84*a* which are provided at the left side based on FIG. 23 and a second main link 83*b* and a second sub-link 84*b* which are provided at the right side.

The main link 83 may be rotatably coupled to the cover base 42 by a fastening boss 85. The main link 83 includes a through portion 831 through which the fastening boss 85 passes, a first extending portion 832 which extends from the through portion 831 toward a center thereof at which the transmission member 82 is located and a second extending portion 833 which extends from the through portion 831 in a direction vertical to the first extending portion 832.

Meanwhile, a connecting portion 834 formed at the first extending portion 832 of each of the first main link 83*a* and the second main link 83*b* may be formed to be overlapped with each other. An extending portion hole 834*b* and an extending portion protrusion 834*a* which are rotatably coupled to each other are formed at the first extending portions 832, and thus the first main link 83*a* and the second main link 83*b* may be interlocked with each other.

Also, an extending portion inclined surface 834*c* corresponding to the transmission member inclined portion 821 is formed at one end of the first extending portion 832, i.e., one side thereof which is in contact with the transmission member 82. The extending portion inclined surface 834*c* is maintained in a contacting state with the transmission member inclined portion 821, and the transmission member inclined portion 821 is vertically moved along the extending portion inclined surface 834*c* according to the vertical movement of the transmission member 82, and thus the first extending portion 832 may be moved forward and backward. The first main link 83*a* and the second main link 83*b* may be rotated according to the forward and backward movement of the first extending portion 832.

The sub-link 84 may be rotatably coupled to an end of the second extending portion 833. That is, the first sub-link 84*a* and the second sub-link 84*b* are coupled to ends of the pair of second extending portions 833, respectively. And link holes 833*a* may be formed at the ends of the second extending portions 833, and link protrusions 841*a* which are coupled into the link holes 833*a* may be formed at the first sub-link 84*a* and the second sub-link 84*b*. Therefore, when the main link 83 is rotated, the sub-link 84 may be interlocked therewith.

A link guide 423 may be formed at the cover base 42. The link guide 423 is formed at a position corresponding to that of each of the first sub-link 84*a* and the second sub-link 84*b*, and a space in which the first sub-link 84*a* and the second sub-link 84*b* are accommodated is formed therein. The link guide 423 may be formed in the form of one pair of ribs and may guide the sub-link 84 to be movable while the sub-link 84 is located therebetween.

Each of the first sub-link 84*a* and the second sub-link 84*b* may include a third extending portion 841 which is accommodated in the link guide 423 and a fourth extending portion 842 which is vertically bent from the third extending portion 841. And the cover restricting protrusion 843 which protrudes laterally may be formed at the third extending portion 841.

An inclined surface 843*a* may be formed at a side surface of the cover restricting protrusion 843. The inclined surface 843*a* may be formed so that a width thereof is increased from a lower end thereof toward an upper end thereof. Therefore, while the cover member 40 is closed, the inclined surface 843*a* of the cover restricting protrusion 843 may be inserted inward while being in contact with a side wall of the upper decoration 37 and then may protrude outward to be restricted when reaching a protrusion restricting hole 376 (in FIG. 28) of the upper decoration 37. To this end, an upper end of the cover restricting protrusion 843 may be formed in a flat shape.

And a protrusion entrance 424 through which the cover restricting protrusion 843 is inserted and withdrawn may be formed at a side surface of the cover base 42 corresponding to a position of the link guide 423. When the second sub-link 84*b* is horizontally moved, the cover restricting protrusion 843 may be inserted and withdrawn through the protrusion entrance 424. The cover restricting protrusion 843 is caught and restricted by the protrusion restricting hole 376 (in FIG. 28) of the body part 30 while protruding from the protrusion entrance 424 and allows the cover member 40 to be maintained in a closed state.

Meanwhile, although not illustrated, an elastic member such as a spring may be provided at at least one of the push member 81, the main link 83 and the sub-link 84. Due to the elastic member, the cover restricting protrusion 843 may be maintained in a protruding state while the external force by a user's operation is not provided.

Figure 24:
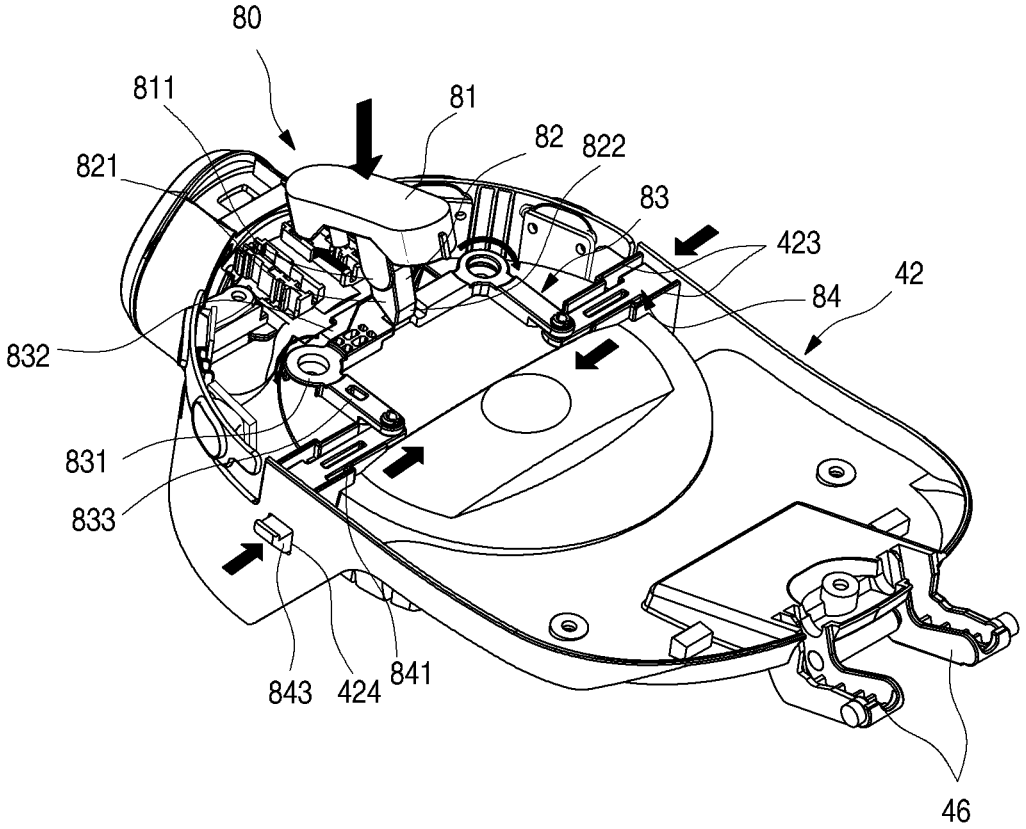
FIG. 24 is a perspective view illustrating a state before the locking assembly is operated.
Figure 25:
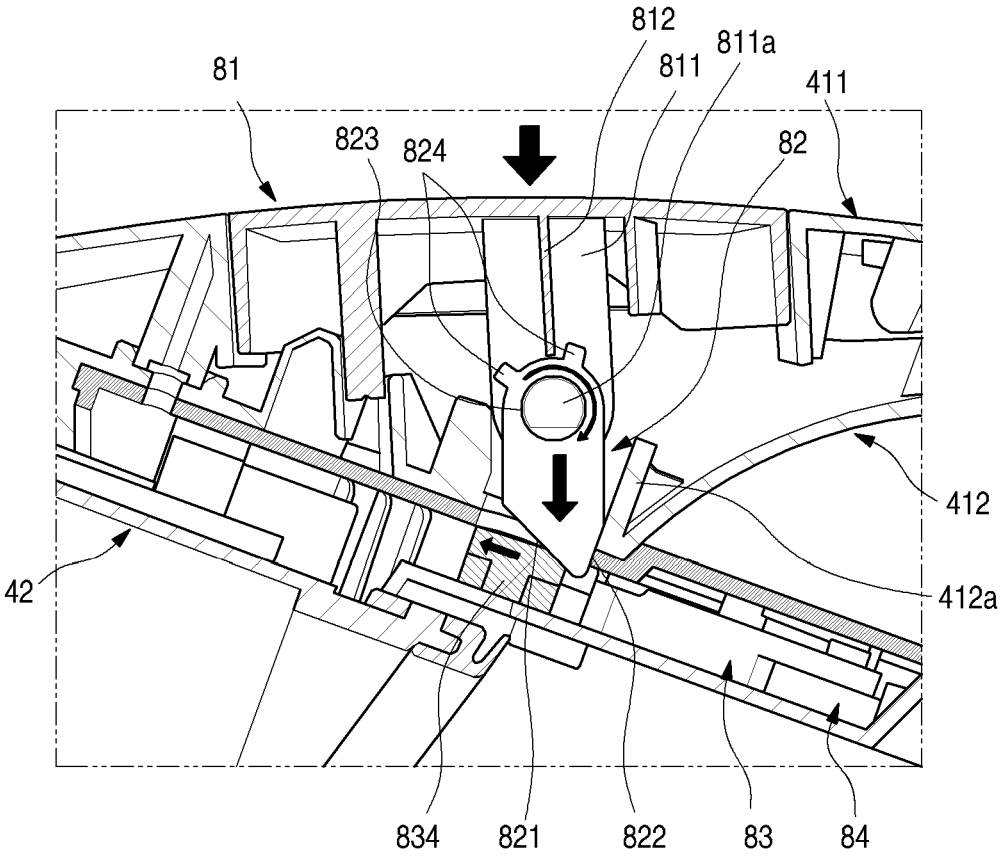
FIG. 25 is a cross-sectional view illustrating the state before the locking assembly is operated.
Figure 54:
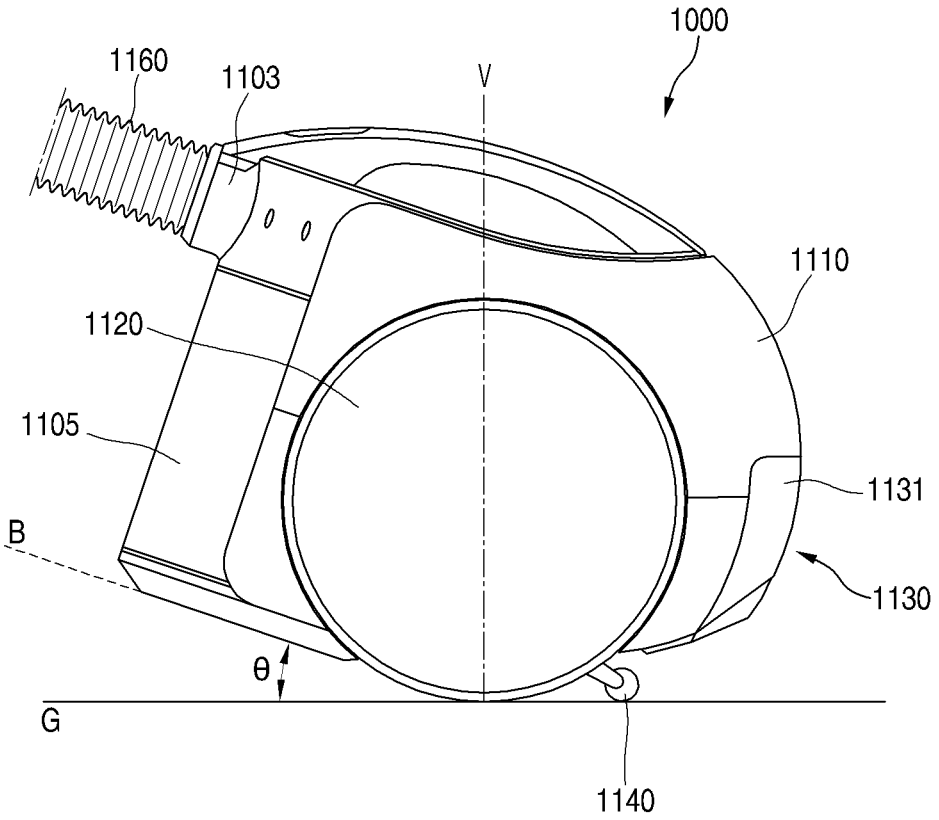
FIG. 54 is a view illustrating a state in which the body part is inclined backward.

FIG. 24 is a perspective view illustrating a state before the locking assembly is operated. And FIG. 54 is a cross-sectional view illustrating the state before the locking assembly is operated.

As illustrated in the drawings, while the push member 81 is not operated by the user, the transmission member 82 may be maintained in the contacting state with the main link 83. At this point, the transmission member 82 is located at the uppermost side, and the transmission member inclined portion 821 is in a contacting state with the extending portion inclined surface 834*c*.

Also, a guide inclined surface 822 may be further formed at a lower end of the transmission member 82. The guide inclined surface 822 may be in contact with a transmission member guide 412*a* formed at the cover base 42. That is, when the transmission member 82 is moved downward, the transmission member 82 allows the guide inclined surface 822 to be moved along the transmission member guide 412*a*. At this point, the transmission member guide 412*a* extends to vertically cross the main link 83, and thus the transmission member 82 may be moved in a direction which crosses the main link 83 when being moved downward and may operate the main link 83.

At this point, the first main link 83*a* and the second main link 83*b* are maintained on the same extension line, and the main link 83 is maintained in a state in which the external force is not applied. The cover restricting protrusion 843 is maintained in a caught and restricted state by the protrusion restricting hole 376 (in FIG. 28) of the body part 30 while protruding from the protrusion entrance 424 and thus allows the cover member 40 to be maintained in the closed state.

In this state, the user pushes the push member 81 to open the cover member 40. Due to the operation of the push member 81, the main link 83 and the sub-link 84 are interlocked with each other, and the cover member 40 is in an openable state.

Figure 26:
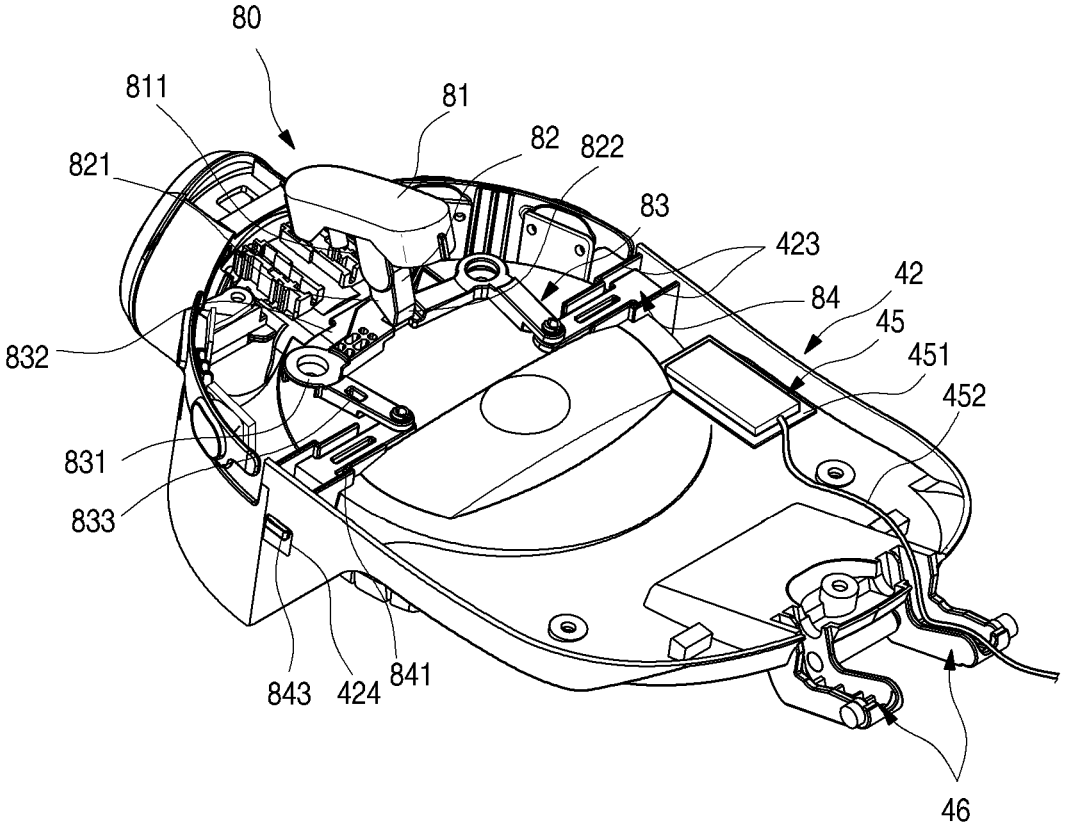
FIG. 26 is a perspective view illustrating an operating state of the locking assembly.
Figure 27:
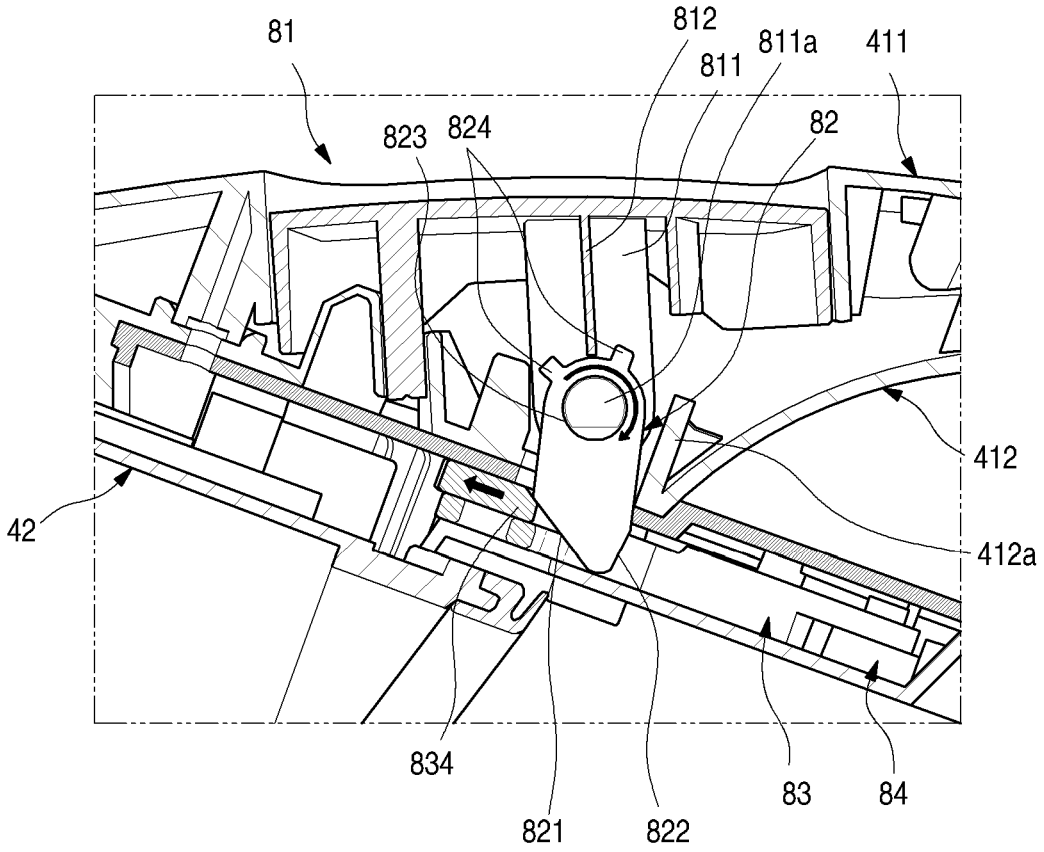
FIG. 27 is a cross-sectional view illustrating the operating state of the locking assembly.

FIG. 26 is a perspective view illustrating an operating state of the locking assembly. And FIG. 27 is a cross-sectional view illustrating the operating state of the locking assembly.

As illustrated in the drawings, when the user pushes the push member 81, the transmission member 82 is moved downward. At this point, the transmission member 82 may be rotated by a rotating shaft 811*a* formed on the transmission member installing portion 811 and may vertically push the main link 83. At this point, to prevent the transmission member 82 from being excessively rotated or separated, one pair of separation preventing protrusions 824 may protrude from an upper end of the transmission member 82 to be spaced apart from each other at a predetermined distance, and a separation preventing rib 812 of the push member 81 may be disposed between the separation preventing protrusions 824.

When the transmission member 82 is moved downward while the transmission member inclined portion 821 is in contact with the extending portion inclined surface 834*c*, the extending portion inclined surface 834*c* performs a relative motion along the transmission member inclined portion 821. That is, the first extending portion 832 is pushed up forward. At this point, since the first main link 83*a* and the second main link 83*b* are connected with each other, the first extending portion 832 is also moved forward together.

When the first extending portion 832 is moved forward, the main link 83 is rotated using the through portion 831 as an axis, and the second extending portions 833 are moved in a direction which become closer to each other. Therefore, the first sub-link 84*a* and the second sub-link 84*b* which are connected to the second extending portion 833 are horizontally moved inward. Due to the horizontal movement of the sub-link 84, the cover restricting protrusion 843 formed at the sub-link 84 is also moved horizontally toward an inside of the protrusion entrance 424.

In this state, since the cover restricting protrusion 843 is located inside the cover member 40, the restriction by the protrusion restricting hole 376 (in FIG. 28) of the body part 30 may be released. Therefore, the user may rotate the cover member 40 while gripping the grip portion 41 of the cover member 40 and may open an inside of the body part 30 or may separate the dust container 50 from the body part 30.

Meanwhile, as illustrated in FIG. 26, a display 45 for displaying an operating state of the vacuum cleaner 1 may be provided at the cover member 40. The display 45 may be formed to display information on an upper surface of the cover member 40 and may be disposed at a lateral side of the grip portion 41 so that the user may easily check a state of the vacuum cleaner 1 from an upper side while using the vacuum cleaner 1.

The display 45 may be formed in various types such as a liquid crystal display, a combination of a plurality of LEDs and a seven-segment and may be formed to allow the information to be visible. The display 45 may be defined as a single configuration for outputting an image and may also be defined to include a display PCB 451 on which the display 45 is mounted.

The display 45 may be installed on the cover base 42 and may be formed to be shielded by the outer cover 43. At this point, the whole or a part of the outer cover 43 may be formed to transmit light. Therefore, when the display 45 shielded by the outer cover 43 is operated, the information may be displayed to an outside through the outer cover 43.

To this end, the entire outer cover 43 may be formed of a material which transmits the light. Otherwise, only a part thereof corresponding to the display 45 may be formed to transmit the light. Of course, an opening may be formed at the outer cover 43, and the display 45 may be installed at the opening to be directly exposed to the outside or to be shielded by a separate transparent cover.

The display 45 may be installed and fixed to an upper surface of the cover base 42. The display 45 may be connected to the main PCB 301 by a display cable 452. Therefore, the display 45 may be driven by the electric power and the information transmitted from the main PCB 301.

The display 45 may display the operating state of the vacuum cleaner 1 and may be formed to display, for example, a battery residual value of the battery unit 38 or an operable time with the current battery residual value. Also, the display 45 may display an abnormal operation state of the vacuum cleaner 1 or information about a replacement of the dust container 50 or the like.

Figure 28:
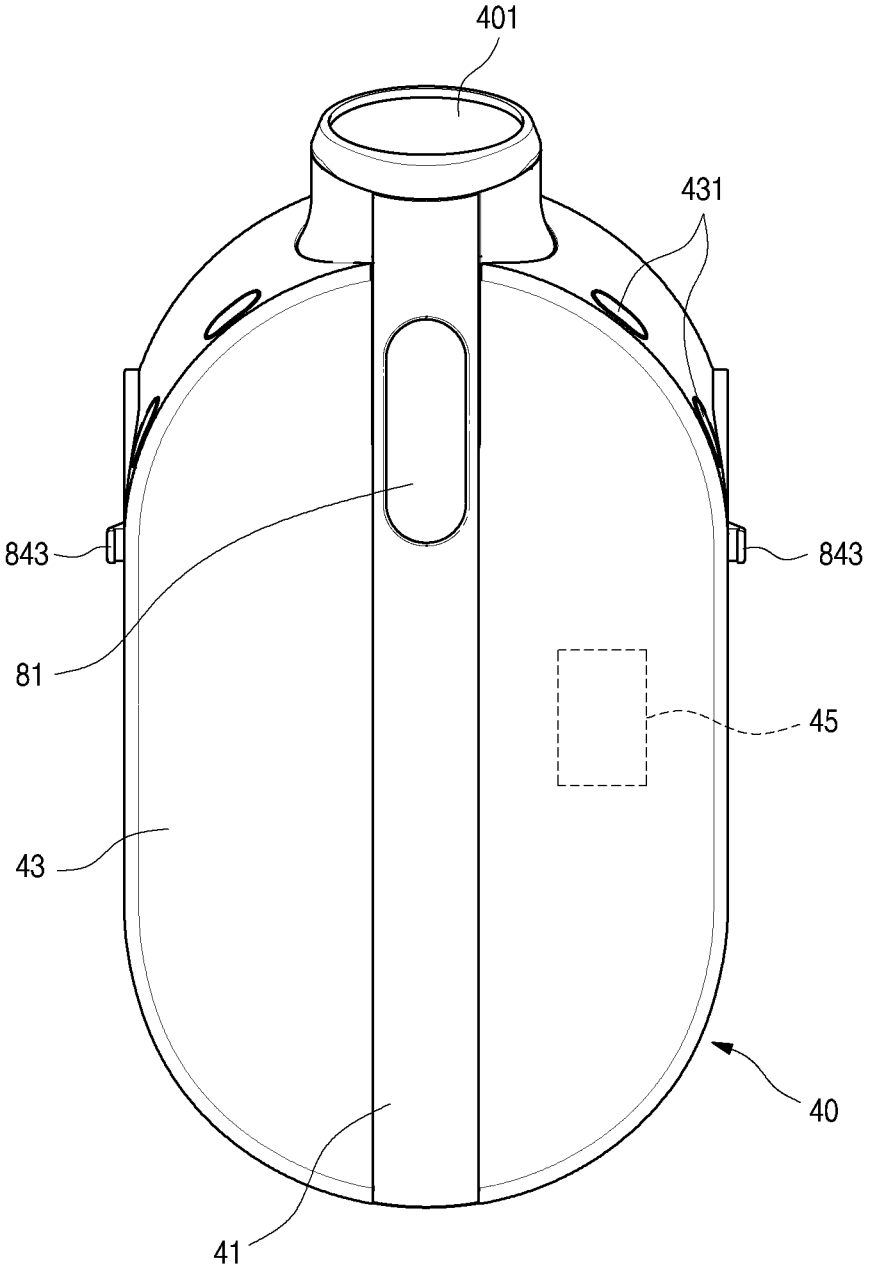
FIG. 28 is a plan view of the cover member in which a display according to the embodiment is in an OFF state.
Figure 29:
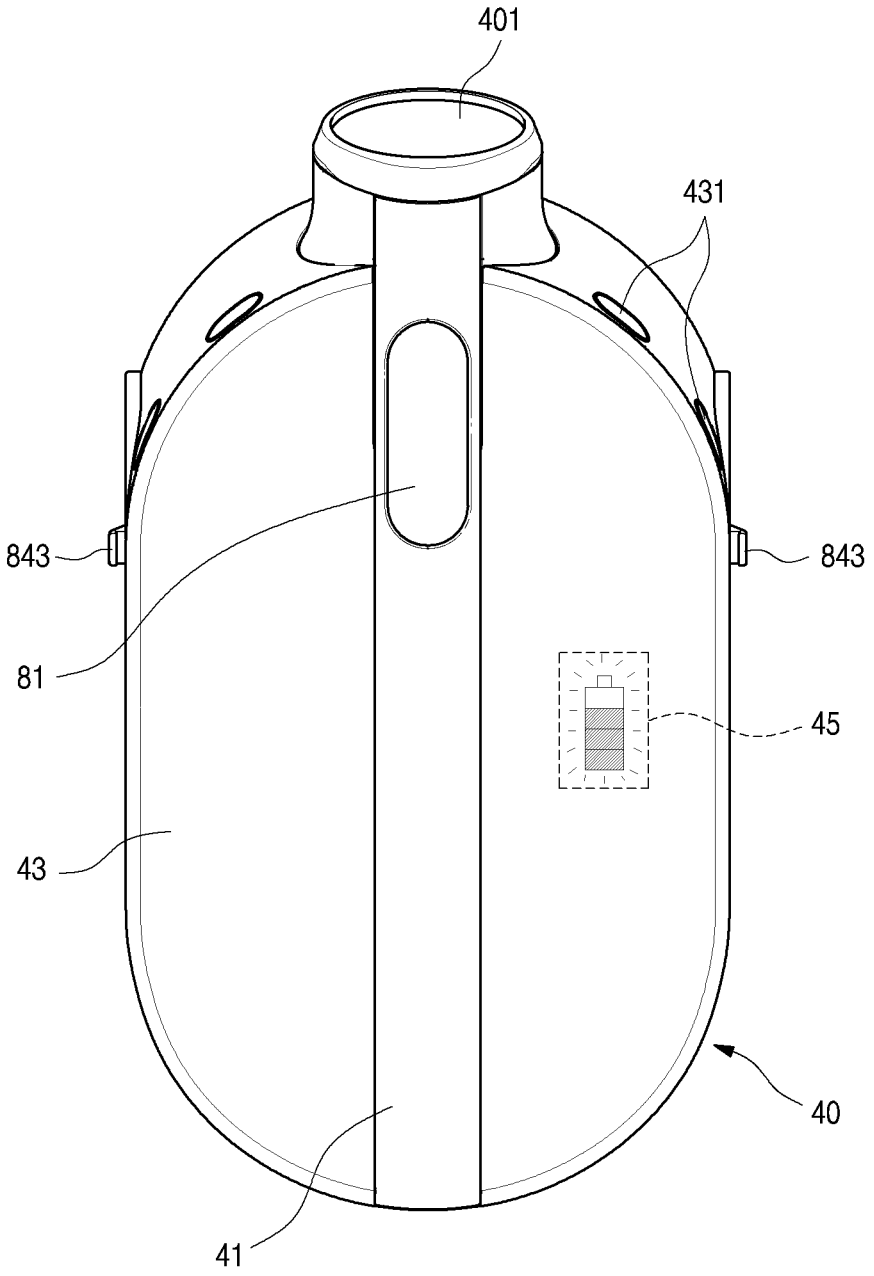
FIG. 29 is a plan view of the cover member in which the display according to the embodiment is in an ON state.

FIG. 28 is a plan view of the cover member in which the display according to the embodiment is in an OFF state. And FIG. 29 is a plan view of the cover member in which the display according to the embodiment is in an ON state.

Referring to the drawings, while the vacuum cleaner 1 is not operated, the display 45 is in an OFF state. In this state, as illustrated in FIG. 28, the display 45 is covered by the outer cover 43 and is thus invisible from the outside, and only an exterior of the outer cover 43 may be exposed.

When an operation of the vacuum cleaner 1 starts by an user's operation, the display 45 is turned on, and an image output on the display 45 may be visible to the outside through the outer cover 43. That is, when the display 45 becomes bright due to an output of the image on the display 45, light of the display 45 may pass through the outer cover 43 and thus the image on the display 45 may be visible to the outside.

The display 45 may display a state of the battery unit 38 of the vacuum cleaner 1 in the form of a picture. The user may check the state of the battery unit 38 through the image output on the display 45 and may decide charging of the battery unit 38 or performing of a cleaning operation.

Of course, the display 45 may display a variety of information other than the charging state of the battery unit 38.

Figure 30:
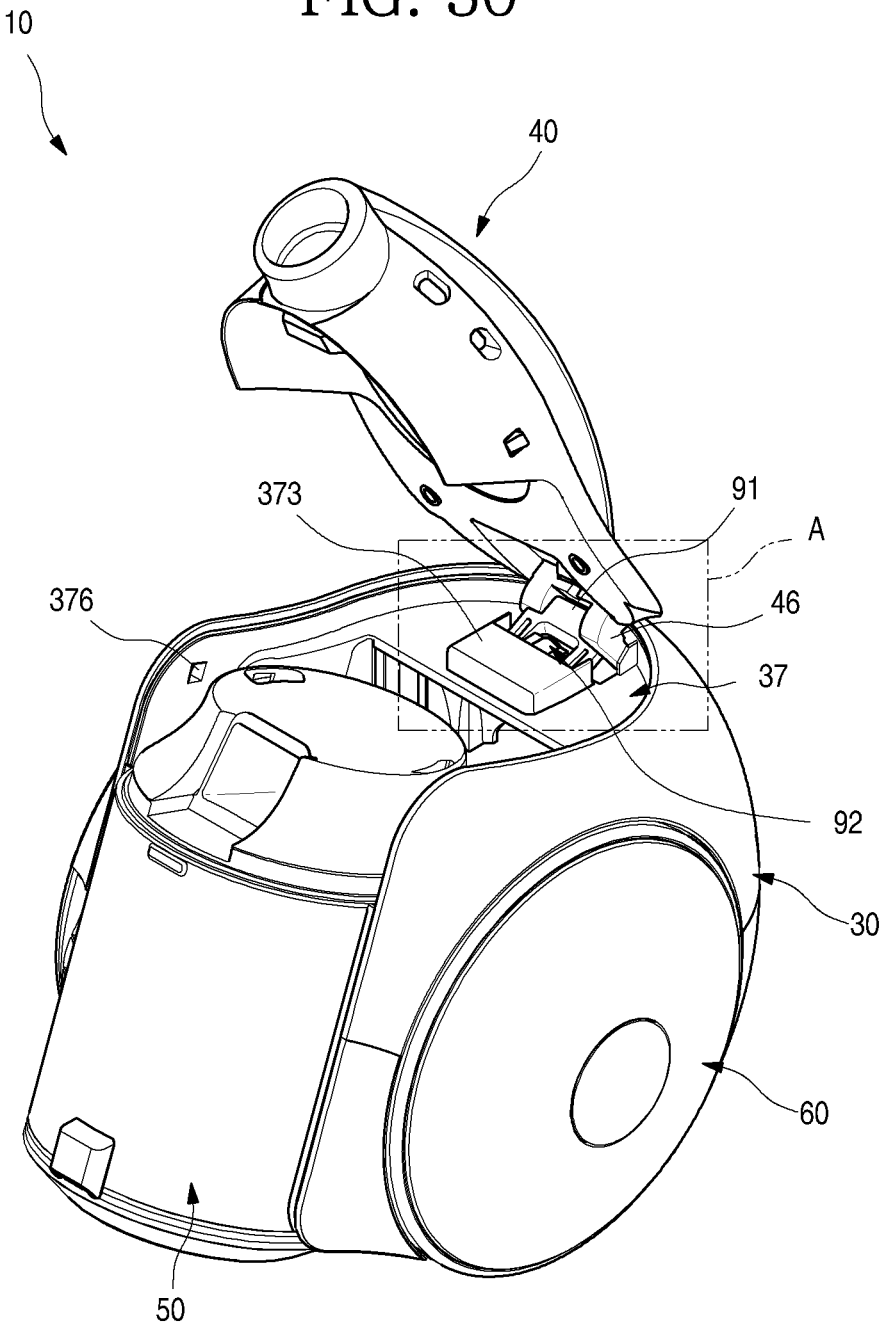
FIG. 30 is a perspective view illustrating a state in which the cover member is opened.
Figure 31:
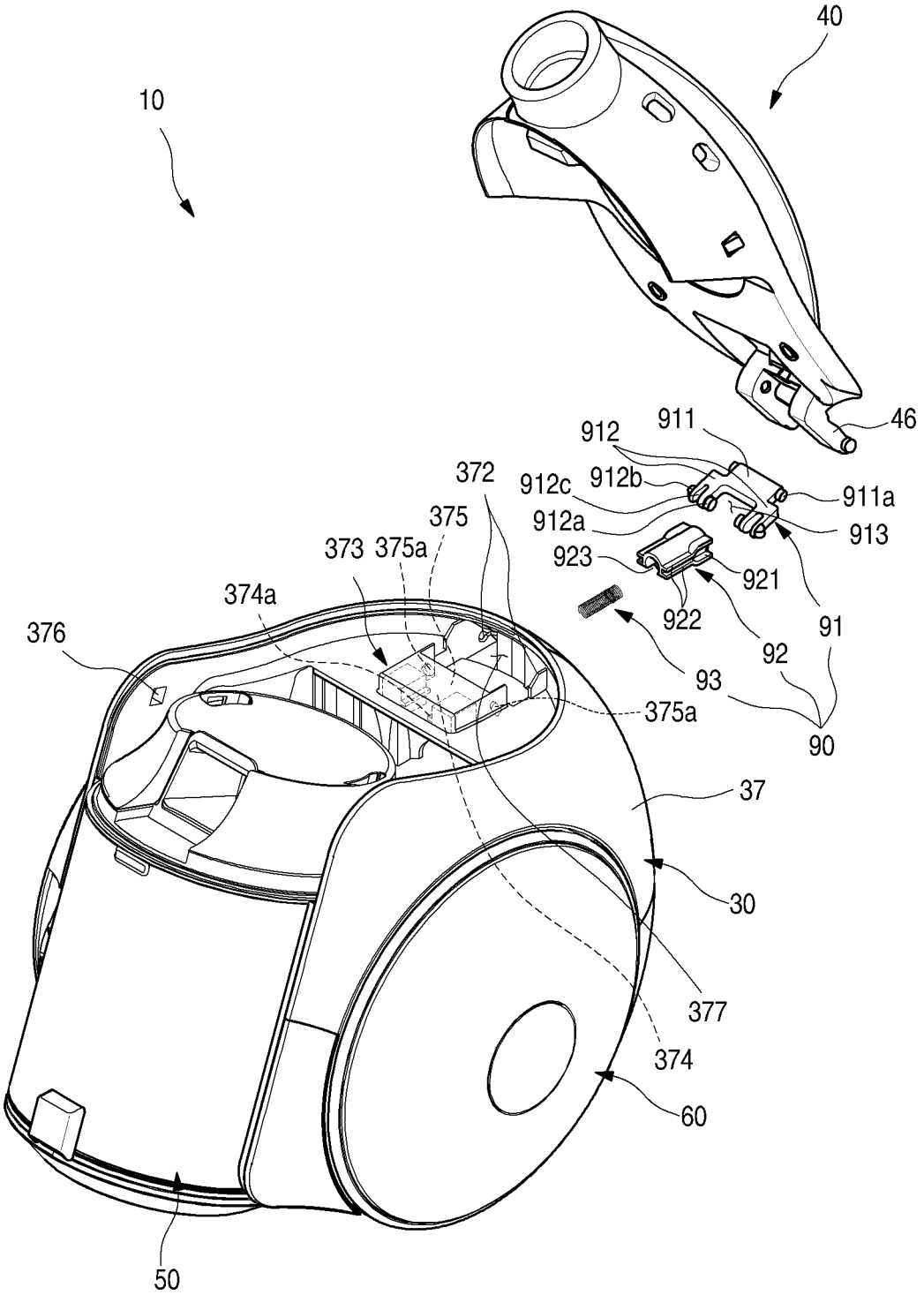
FIG. 31 is an exploded perspective view illustrating a coupling structure of a link assembly according to the embodiment of the present invention.

FIG. 30 is a perspective view illustrating a state in which the cover member is opened. And FIG. 31 is an exploded perspective view illustrating a coupling structure of a link assembly according to the embodiment of the present invention.

As illustrated in the drawings, the cover member coupling portion 421 is formed at the rear end of the cover member 40, and the cover member coupling portion 421 may be coupled into a cover member coupling hole 372 formed at the upper decoration 37 of the body part 30. When the cover member coupling portion 421 is coupled into the cover member coupling hole 372, the cover member 40 may be rotatably installed. The cover member 40 may be rotated using the cover member coupling portion 421 as an axis and may open and close the inside of the body part 30.

The cover member 40 may also be opened and closed when the dust container 50 is separated. When the cover member 40 is maintained in an opened state during such an operation, the dust container 50 may be more easily separated.

In particular, since a structure at which the fitting portion 241 of the suction hose 24 is installed is provided at a front end of the cover member 40, the cover member 40 is structurally naturally closed due to a weight of the suction hose 24.

In this state, a link assembly 90 which connects the rear end of the cover member 40 with an inside of the upper decoration 37 may be provided to maintain the opened state of the cover member 40.

The link assembly 90 may include a rotating link 91 which is installed at the cover member coupling portion 421, a slider 92 which is coupled to the rotating link 91 to be slidably moved when the rotating link 91 is rotated and a spring 93 which elastically supports the slider 92.

The rotating link 91 may include a rotating portion 911 which is rotatably installed at the cover member coupling portion 421 and supporting portions 912 which extend from both side ends of the rotating portion 911 to be spaced apart from each other.

The rotating portion 911 may be inserted between one pair of the cover member coupling portions 421, and a rotating shaft 911*a* which laterally protrudes from each of both side ends of the rotating portion 911 may be inserted into a rotating shaft hole 421*a* formed at the cover member coupling portion 421. Therefore, the rotating link 91 may be rotatable about the rotating shaft 911*a* and may be rotated when the cover member 40 is opened and closed.

The supporting portions 912 may extend while being spaced apart from each other, and a space portion 913 in which an end of the slider 92 is accommodated may be formed between the pair of supporting portions 912. A slider fixing portion 912*a* and a supporting protrusion 912*b* may be formed at ends of the pair of the supporting portions 912, respectively.

The slider fixing portion 912*a* protrudes toward the opposite end of the supporting portion 912 and is located inside the space portion 913. The slider fixing portion 912*a* may be inserted into a slider fixing groove 921 of the slider 92. And the slider fixing portion 912*a* may be a rotating shaft of the slider 92 or a rotating shaft of the rotating link 91.

The supporting protrusion 912*b* is formed to protrude laterally from the end of the supporting portion 912 along an outer surface thereof. The supporting protrusion 912*b* may protrude outward and may be selectively caught and restricted by an interference protrusion 375*a* inside a link assembly accommodating portion 373 which will be described below when the cover member 40 is opened and closed.

Meanwhile, a supporting slit 912*c* may be formed at each of the ends of the supporting portions 912. The supporting slit 912*c* enables the ends of the supporting portions 912 to be easily elastically deformed when the supporting protrusion 912*b* and the interference protrusion 375*a* interfere with each other.

A rear end of the slider 92 is disposed inside the space portion 913, and a front end thereof may be accommodated in the link assembly accommodating portion 373 formed at the body part 30.

The slider fixing groove 921 which is recessed inward may be formed at each of left and right side surfaces of the slider 92. The slider fixing groove 921 is formed to be opened backward and formed to accommodate the slider fixing portion 912*a* which is formed in a shaft shape. And the slider 92 may be interlocked with the rotating link 91.

And a slider guide 922 may be formed at a front of the slider fixing groove 921. The slider guide 922 may extend from an end of the slider fixing groove 921 to an end of the slider 92. The slider guide 922 has one pair of ribs respectively provided at both of left and right sides thereof, accommodates a guide rib 374*a* which will be described below and enables the slider 92 to be smoothly moved.

And a spring hole 923 which is recessed inward is formed at a rear surface of the slider 92. The spring 93 may be inserted and installed into the spring hole 923, may be compressed or elastically deformed according to movement of the slider 92 and may provide an elastic force to the slider 92.

Meanwhile, the link assembly accommodating portion 373 may be formed at the upper decoration 37. The link assembly accommodating portion 373 may be provided at the upper surface of the body part 30 and may be formed to have a size which enables the slider 92 and the rotating link 91 to be inserted and withdrawn.

Specifically, a slider accommodating portion 374 in which the slider 92 is accommodated may be formed at a center inside the link assembly accommodating portion 373. And the guide rib 374*a* is formed to protrude from each of both wall surfaces of the slider accommodating portion 374. The guide rib 374*a* may protrude to be inserted into the slider guide 922 and may be formed to extend in an inserting direction of the slider 92. Therefore, the guide rib 374*a* and the slider guide 922 prevent the slider 92 from being separated and enable the slider 92 to be slidingly moved along a set route when the slider 92 is slidingly moved forward and backward.

A link accommodating portion 375 in which the rotating link 91 is selectively inserted may be further formed at the link assembly accommodating portion 373. The link accommodating portion 375 may be located at a rear of the slider accommodating portion 374, may provide a space in which the rotating link 91 is accommodated and may be opened backward.

The interference protrusion 375*a* which protrudes inward may be formed to protrude from an inner wall surface of the link accommodating portion 375. The interference protrusion 375*a* may support the supporting protrusion 912*b* formed at the supporting portion 912 while the cover member 40 is opened and the rotating link 91 is withdrawn and may allow the rotating link 91 to be maintained in a withdrawable state.

At this point, the interference protrusion 375*a* may protrude to be inclined at a predetermined angle and thus may allow the rotating link 91 to be supported in an inclined state when the supporting protrusion 912*b* is supported. That is, when the interference protrusion 375*a* supports the supporting protrusion 912*b*, the cover member 40 may be allowed to be maintained in the inclined state and thus may be maintained in the opened state.

And an opened and closed state of the cover member 40 may be determined by that the supporting protrusion 912*b* is supported by the interference protrusion 375*a* or moved over the interference protrusion 375*a* according to the user's rotating operation of the cover member 40.

Figure 32:
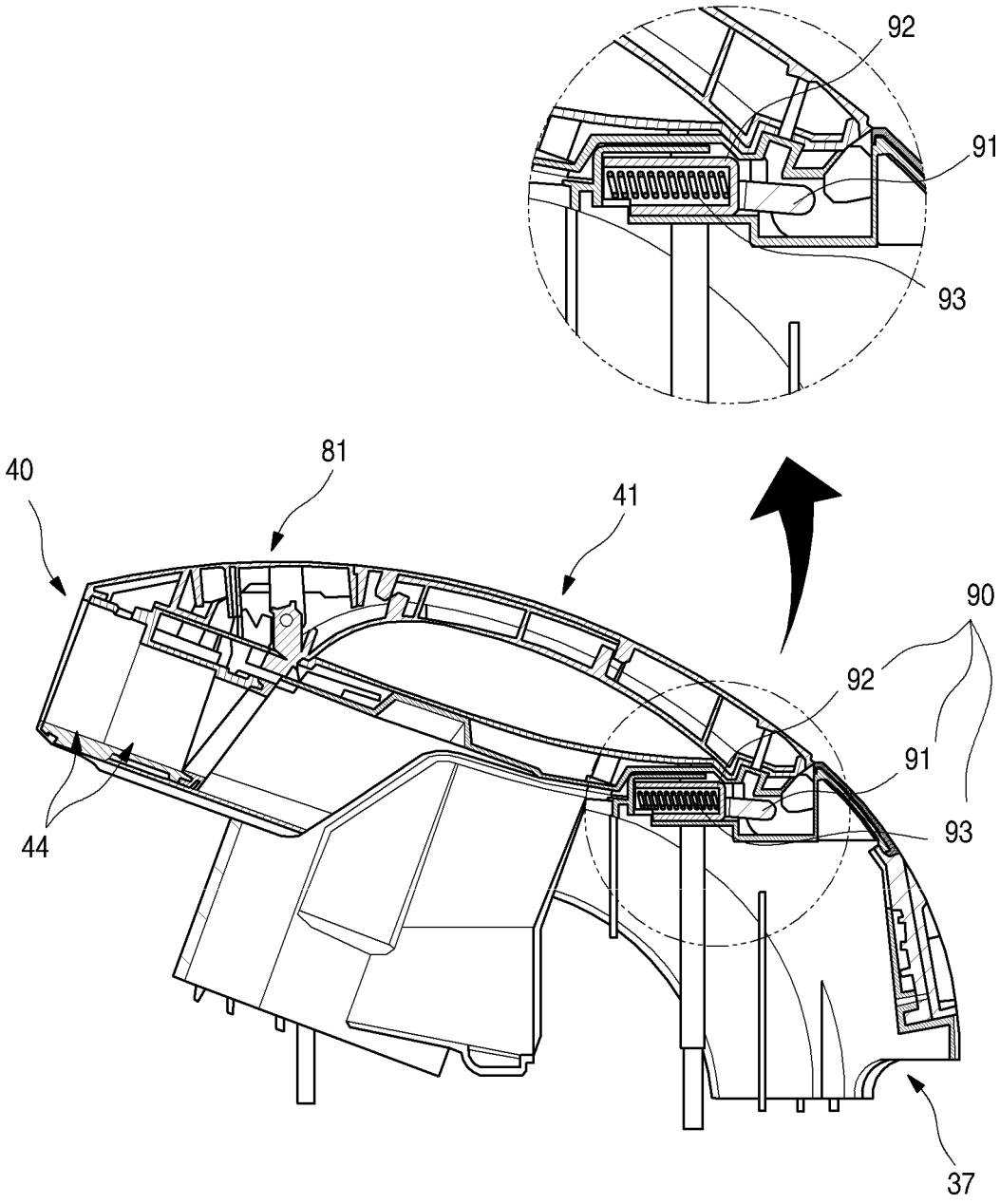
FIG. 32 is a cross-sectional view illustrating a state of the link assembly while the cover member is closed.

FIG. 32 is a cross-sectional view illustrating a state of the link assembly while the cover member is closed.

Referring to the drawing, a state of the link assembly 90 while the cover member 40 is in a closed state will be described. While the cover member 40 is in the closed state, the cover member 40 shields the opened upper surface of the body part 30. A lower end of the cover member 40 is in contact with a lower end of the upper decoration 37, and the link assembly 90 of the cover member 40 is in a restricted state by the upper decoration 37.

And the slider 92 and the rotating link 91 are in an inserted state inside the link assembly accommodating portion 373 of the upper decoration 37, and the rotating link 91 is maintained in a horizontal state with the slider 92 or on the same extension line as that of the slider 92.

At this point, since the slider 92 is completely inserted into the slider accommodating portion 374, the spring 93 is in a maximally compressed state. Therefore, when the user releases the restriction of the locking assembly 80 to open the cover member 40, the slider 92 may be pushed by the elastic force of the spring 93, and thus a force may be naturally applied in a rotating direction of the cover member 40.

In this state, the user pushes the push member 81 and operates the locking assembly 80 to open the cover member 40, and thus the restriction of the cover member 40 and the body part 30 is released and the cover member 40 is in an openable state. And the user may grip the grip portion 41, may rotate the cover member 40 and then may open the cover member 40.

Figure 33:
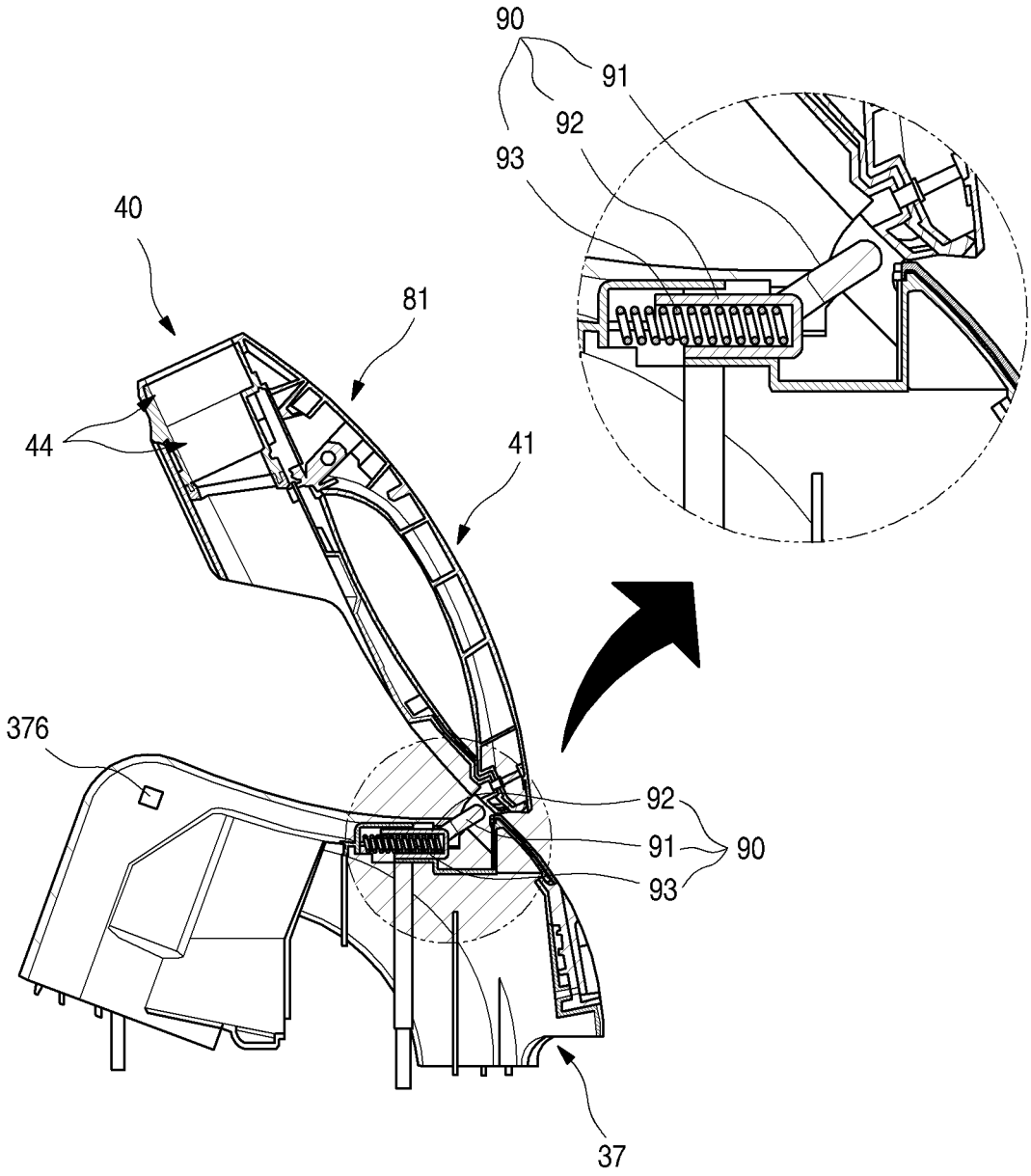
FIG. 33 is a cross-sectional view illustrating the state of the link assembly while the cover member is opened.
Figure 34:
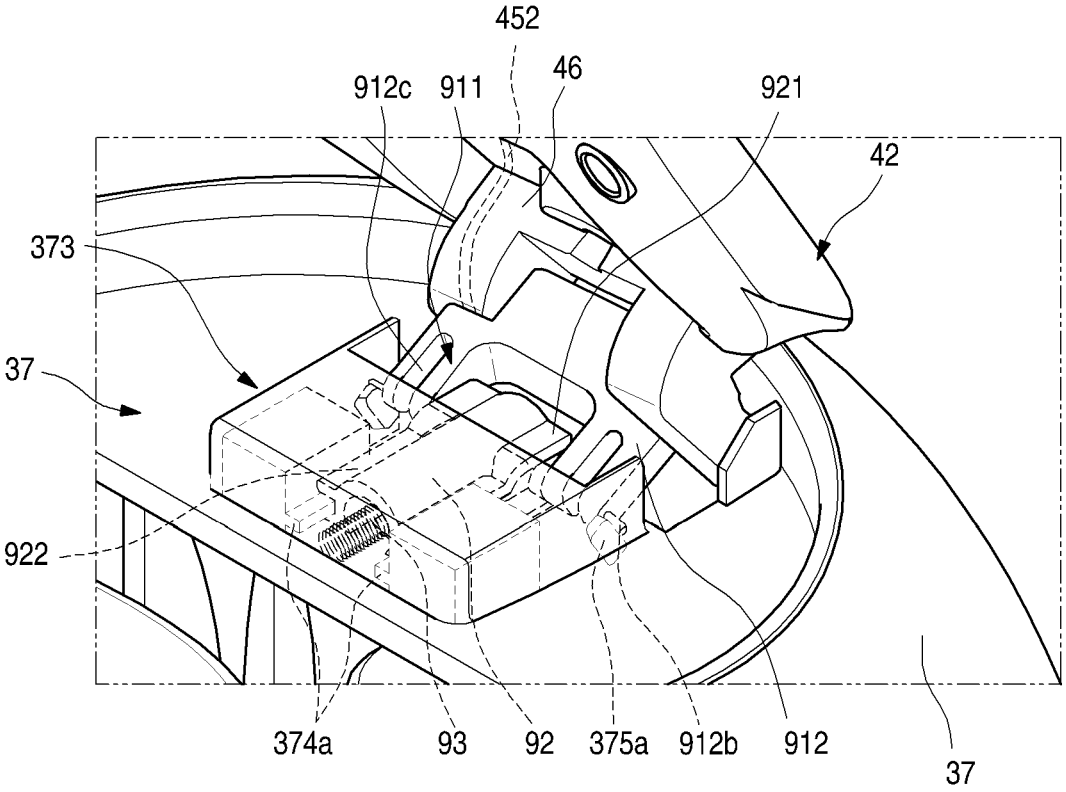
FIG. 34 is an enlarged view of an A portion in FIG. 30.

FIG. 33 is a cross-sectional view illustrating the state of the link assembly while the cover member is opened. And FIG. 34 is an enlarged view of an A portion in FIG. 30.

Referring to the drawings, the state of the link assembly 90 while the cover member 40 is in the opened state will be described. When the cover member 40 is opened by the user, the cover member 40 may be clockwise rotated using the cover member coupling portion 421 as an axis and thus may be opened.

At this point, the rotating link 91 which is rotatably connected to the cover member coupling portion 421 is also rotated together, and the slider 92 connected to the rotating link 91 is slidingly moved backward (to a right side in FIG. 33) by guiding of the slider guide 922 and the guide rib 374*a*. When the slider 92 is moved, the spring 93 which elastically supports the slider 92 provides the elastic force, and thus the slider 92 may be more easily moved.

And the rotating link 91 is horizontally moved along the slider 92 to pull and withdraw the slider 92 and simultaneously rotated counterclockwise. At this point, the supporting protrusion 912*b* of the rotating link 91 is in contact with the interference protrusion 375*a* on the link assembly accommodating portion 373.

When the cover member 40 is completely opened by the user, the rotating link 91 may be in a state illustrated in FIGS. 33 and 34. At this point, the supporting protrusion 912*b* may pass the interference protrusion 375*a* by the user's rotating operation of the cover member 40, and the supporting portion 912 is elastically deformed so that the supporting protrusion 912*b* is moved over the interference protrusion 375*a*.

In this state, the opening of the cover member 40 may be stopped. Even when the user releases the grip portion 41, the supporting protrusion 912*b* is in contact with the interference protrusion 375*a*, and thus the rotating link 91 may be maintained at the set angle. Therefore, the cover member 40 may maintain the opened state at the set angle. While the cover member 40 is opened, the user may separate or install the dust container 50 or may perform any necessary operations in the body part 30.

Meanwhile, in the state illustrated in FIGS. 33 and 34, when it is intended to close the cover member 40 again, the user may grip the grip portion 41 and may push the cover member 40, and thus the cover member 40 may be closed while being rotated counterclockwise.

At this point, at a moment when the counterclockwise rotation of the cover member 40 starts, the supporting protrusion 912*b* may be moved over the interference protrusion 375*a* by a force applied by the user, and the supporting portion 912 may be elastically deformed so that the supporting protrusion 912*b* is easily moved.

The cover member 40 is in a state illustrated in FIG. 32 when being completely rotated and closed. When the cover member 40 is closed, the cover restricting protrusion 843 of the locking assembly 80 is inserted and restricted inside the protrusion restricting hole 376, and the cover member 40 may be maintained in the closed state.

Meanwhile, the display cable 452 may be guided into the body part 30 through a cover member coupling portion 46 which extends backward from a rear end of the cover member 40. The display cable 452 is guided along an inside of the cover member coupling portion 46 not to be exposed to the outside. And since the display cable 452 is guided into the body part 30 through a rear end of the cover member coupling portion 46 which is a rotating center of the cover member 40, it is possible to prevent the display cable 452 from being exposed and also to prevent the display cable 452 from being damaged although an opening and closing operation of the cover member 40 is continuously performed.

Figure 35:
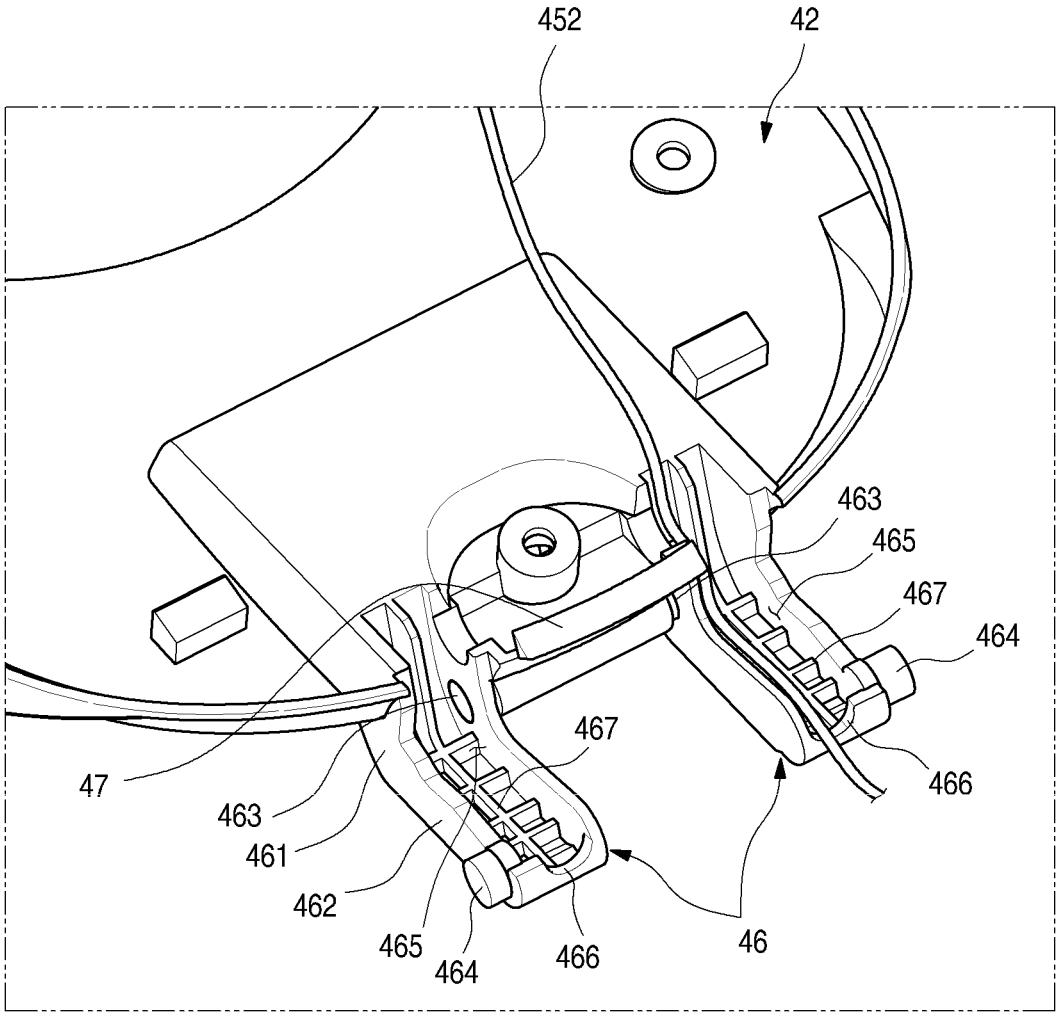
FIG. 35 is a partial perspective view illustrating a structure of a cover member coupling portion and an arrangement of a display cable according to the embodiment of the present invention.

FIG. 35 is a partial perspective view illustrating a structure of the cover member coupling portion and an arrangement of the display cable according to the embodiment of the present invention.

A structure of the cover member coupling portion 46 will be described in detail with reference to the drawing. One pair of cover member coupling portions 46 may extend backward from both of left and right sides, may be inserted into the cleaner body 10 and may be rotatably coupled.

The cover member coupling portion 46 may include a bent portion 461 which extends downward from the rear end of the cover base 42 in a predetermined length and an extending portion 462 which extends backward from an end of the bent portion 461.

A bent portion hole 463 in which the rotating shaft 911*a* of the rotating portion 911 of the rotating link 91 is inserted may be formed at an inner surface of each of the bent portions 461 provided at both of left and right sides. Therefore, one end of the rotating link 91 may be disposed at a space between one pair of bent portions 461 and may be rotatably coupled to the inner surface of the bent portion 461.

And a cover rotating shaft 464 may be formed at both side ends of the extending portion 462. The cover rotating shaft 464 may protrude outward from an outer surface of the extending portion 462 and may be shaft-coupled to the cover member coupling hole 372 of the upper decoration 37. Therefore, the cover member 40 may be rotated about an end of the cover member coupling portion 46, i.e., the cover rotating shaft 464 and may be opened and closed by rotation.

Meanwhile, the cover member coupling portion 46 has a guide space 465 recessed therein. The guide space 465 may be formed from a front end of the cover member coupling portion 46 to the rear end thereof. And a cable hole 466 may be formed at a rear end of the guide space 465, i.e., the rear end of the cover member coupling portion 46.

Therefore, while the cover member 40 is rotatably coupled to the upper decoration 37, the cover member coupling portion 46 is inserted into a decoration opening 377 of the upper decoration 37. And in this state, the cover member coupling portion 46 may allow an inside of the cover member 40 and an inside of the body part 30 to be in communication with each other.

The display cable 452 may be disposed at the guide space 465 of the cover member coupling portion 46. The display cable 452 may be guided along the cover member coupling portion 46, may pass through the cable hole 466 and then may be introduced into the body part 30. And the display cable 452 introduced into the body part 30 may be connected to the main PCB 301. Of course, the display cable 452 may be connected to another PCB or an element for power supply in the body part 30 rather than the main PCB 301.

Meanwhile, a plurality of reinforcing portions 467 may be further formed in the guide space 465. Each of the plurality of reinforcing portions 467 may be formed in a rib shape, and the plurality of reinforcing portions 467 may be formed in an extension direction of the cover member coupling portion 46 and a direction intersecting therewith.

And a stopper 47 may be formed between a space between the cover member coupling portions 46 provided at both of the left and right sides. The stopper 47 may be be in contact with an outer surface of the upper decoration 37 while the cover member 40 is completely opened when a rotating operation is performed to open the cover member 40, may restrict the cover member 40 from being excessively rotated and thus may prevent the rotating link 91 from being broken or separated.

Figure 36:
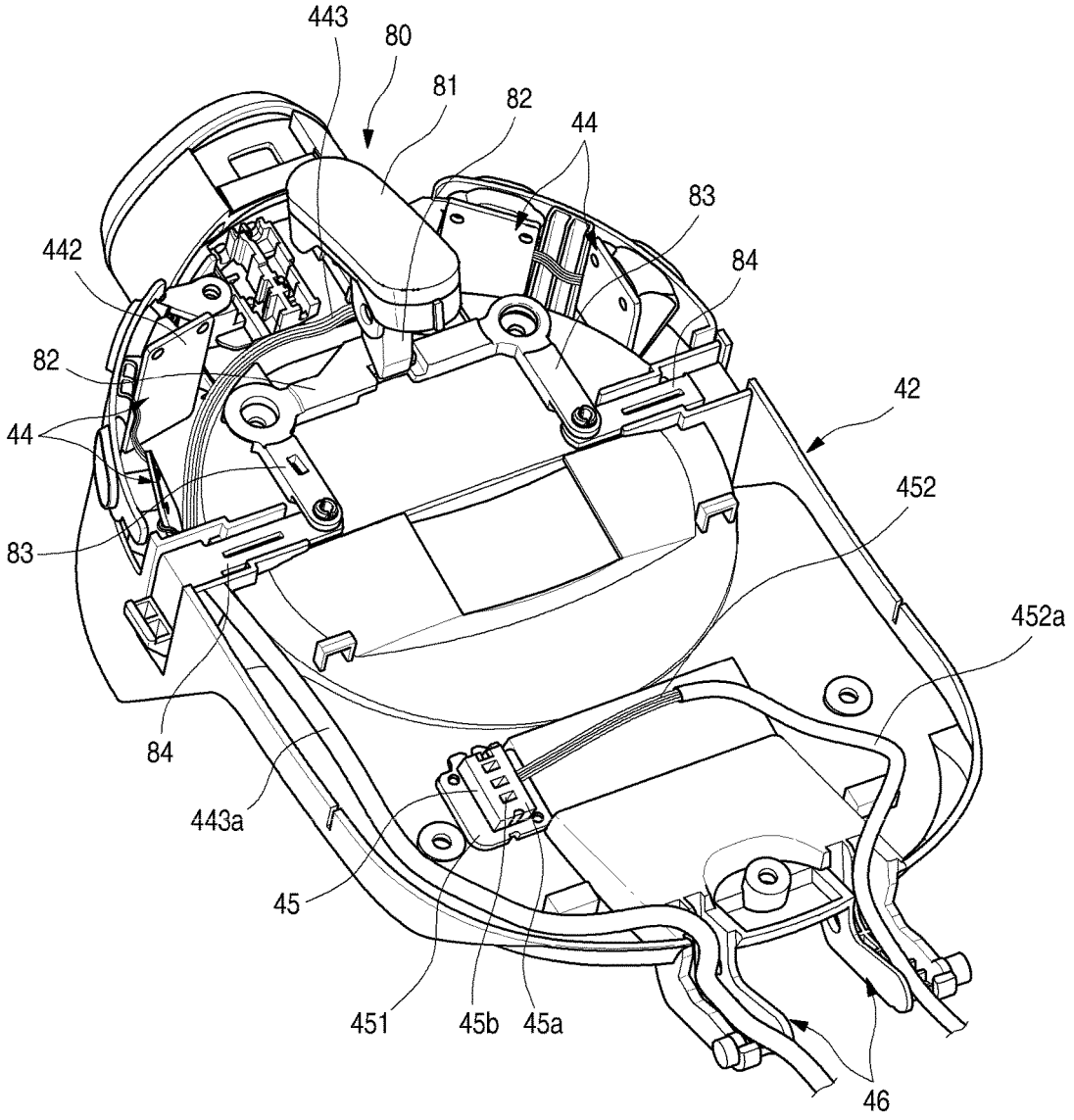
FIG. 36 is a view illustrating a cable arrangement state in a cover base of the cover member.

FIG. 36 is a view illustrating a cable arrangement state in the cover base of the cover member.

As illustrated in the drawing, the locking assembly 80 may be disposed at the cover base 42 of the cover member 40. The locking assembly 80 may include the push member 81, the transmission member 82, the main link 83 and the sub-link 84. At this point, the push member 81 may be installed and fixed to the grip portion 41, and the remaining configurations of the locking assembly 80 except the grip portion 41 may be disposed to interact with each other on the cover base 42.

And the plurality of obstacle detecting members 44 may be disposed at the front surface of the cover member 40. The obstacle detecting members 44 serve to check an obstacle while the cleaner body 10 is travelled and may be disposed along the front surface of the cover base 42.

The plurality of obstacle detecting members 44 may be provided at both of left and right sides based on a center of the front surface of the cover base 42, i.e., the connector 401. That is, two obstacle detecting members 44 may be provided at each of the left and right sides based on the center of the cover base 42. The front surface of the cover member 40 may be formed to be rounded, and the plurality of obstacle detecting members 44 may be formed to emit light rays or ultrasonic waves for detecting the obstacle in a direction vertical to a tangent line of the front surface of the cover member 40. The obstacle detecting member 44 may include a vision camera or a laser sensor, an optical sensor or an ultrasonic sensor which may detect the obstacle located in a travel direction of the vacuum cleaner 1 or at an adjacent position thereof.

The obstacle detecting members 44 may include a plurality of sensor substrates 442 for an operation of a sensor or a detecting device, and a detecting member cable 443 may be connected to each of the plurality of sensor substrates 442. Supplying of electric power and transmitting of a detected signal for operating of the obstacle detecting member 44 may be performed through the detecting member cable 443.

A plurality of detecting member cables 443 may be provided to connect the plurality of sensor substrates 442 and may be guided along an inner circumference of the cover base 42 to a rear side at which the cover member coupling portion 46 is disposed. At this point, the plurality of detecting member cables 443 may be fastened into a bundle by a cable guide member **443*a* such as a contraction tube, a tape or a cable tie and may pass through the cover member coupling portion 46 in this state. That is, the cable guide member 443*a* may be disposed at a section which passes through at least the cover member coupling portion 46**.

At this point, the detecting member cables 443 may be guided into the body part 30 through one (left one in FIG. 36) of the pair of cover member coupling portions 46 which is disposed at the rear end of the cover base 42. Therefore, the detecting member cables 443 may be prevented from being damaged although the cover member 40 is continuously operated to be opened and may be easily disposed in the body part 30 by passing through the cover member coupling portion 46.

Meanwhile, the display 45 and the display PCB 451 may be disposed on the upper surface of the cover base 42. Of course, the display 45 and the display PCB 451 may be installed and fixed to a rear surface of the outer cover 43 of the cover member 40.

The display PCB 451 may be installed and fixed to the upper surface of the cover base 42, and the display 45 may be installed on the display PCB 451. The display 45 may include a light guide **45*a* which is in contact with the rear surface of the outer cover 43, and a plurality of LED holes 45*b* may be installed at the light guide 45*a*. And LEDs (not shown) may be accommodated in the plurality of LED holes 45*b* and may be independently turned on and off. Therefore, the battery residual value of the battery unit 38 may be displayed by light which is guided by the LED holes 45*b* and transmitted to the outer cover 43**.

Meanwhile, the display cable 452 may be installed at the display PCB 451. The display cable 452 may be configured with a plurality of wires and may be fastened into a bundle by a cable guide member **452*a* which is the same as the cable guide member 443*a*. The cable guide member 452*a* may be disposed at a section which passes through at least the cover member coupling portion 46. And the display cable 452 may be guided into the body part 30 through the cover member coupling portion 46. At this point, the display cable 452 may be guided through the other one (right one in FIG. 36) of the pair of cover member coupling portions 46 rather than the one by which the detecting member cable 443 is guided. That is, the detecting member cable 443 and the display cable 452 may be separately guided by the pair of cover member coupling portions 46 which are provided at the rear end of the cover base 42**.

Figure 37:
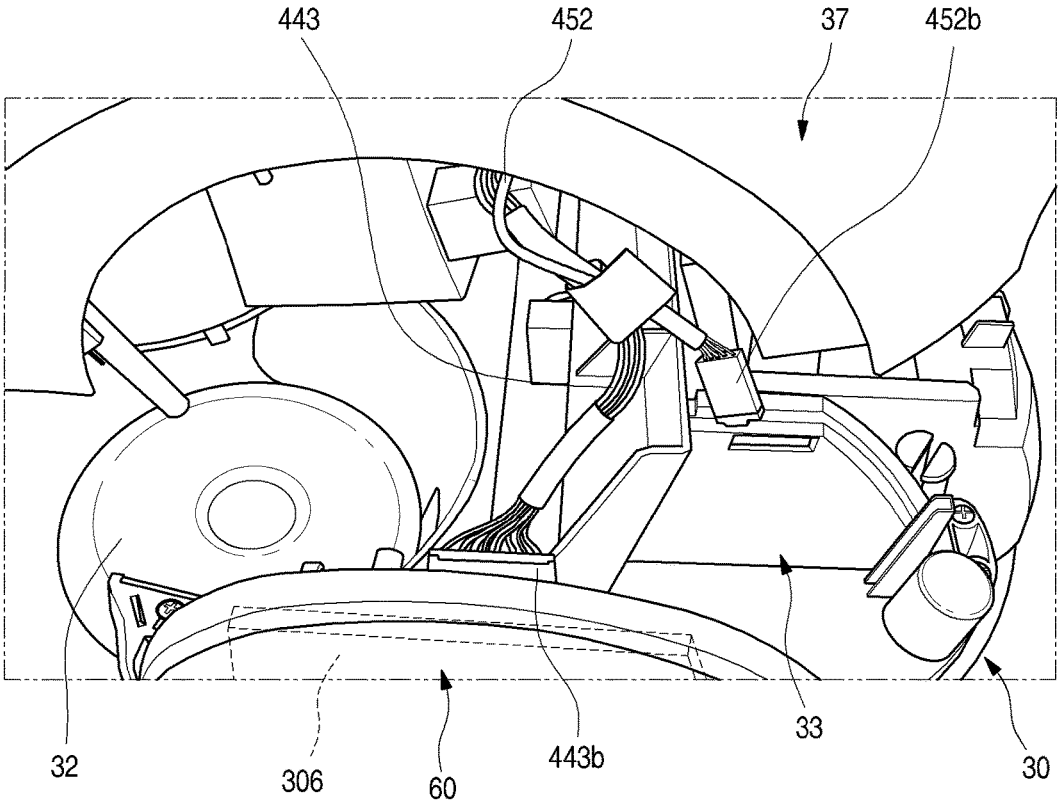
FIG. 37 is a view illustrating a coupling structure of the wire to the cleaner body

FIG. 37 is a view illustrating a coupling structure of the wire to the cleaner body.

As illustrated in the drawing, the detecting member cable 443 and the display cable 452 may be guided into the body part 30 through the pair of cover member coupling portions 46 and may be guided without exposing the cables to the outside even when the cover member 40 is operated to be opened and closed by the rotation.

The detecting member cable 443 introduced into the body part 30 may be guided to one side of the body part 30 at which the moving wheel 60 is installed. And the detecting member cable 443 may be connected to the detecting part 306 installed at the body part 30. Therefore, an obstacle detecting signal detected by the obstacle detecting member 44 may be transmitted to and processed in the detecting part 306, and the travelling of the cleaner body 10 may also be controlled by controlling the driving of the moving wheel 60.

At this point, connectors 443*b* which are connectable to each other may be provided at an end of the detecting member cable 443 and one side of the detecting part 306, and thus the detecting member cable 443 and the detecting part 306 may be connected through a simple operation which connects the connectors 443*b*.

And the display cable 452 introduced into the body part 30 may be connected to the battery unit 38 installed on the lower frame 33 while being guided into the body part 30 or may be connected to another PCB or a device which may provide the information about the battery residual value of the battery unit 38.

That is, the information about the battery residual value of the battery unit 38 and the electric power which are transmitted in a connected state of the display cable 452 are transmitted to the display 45, and thus operating information of the battery unit 38 may be transmitted to the user.

Of course, a connector 452*b* may also be provided at an end of the display cable 452 to be easily coupled to a target object.

Figure 38:
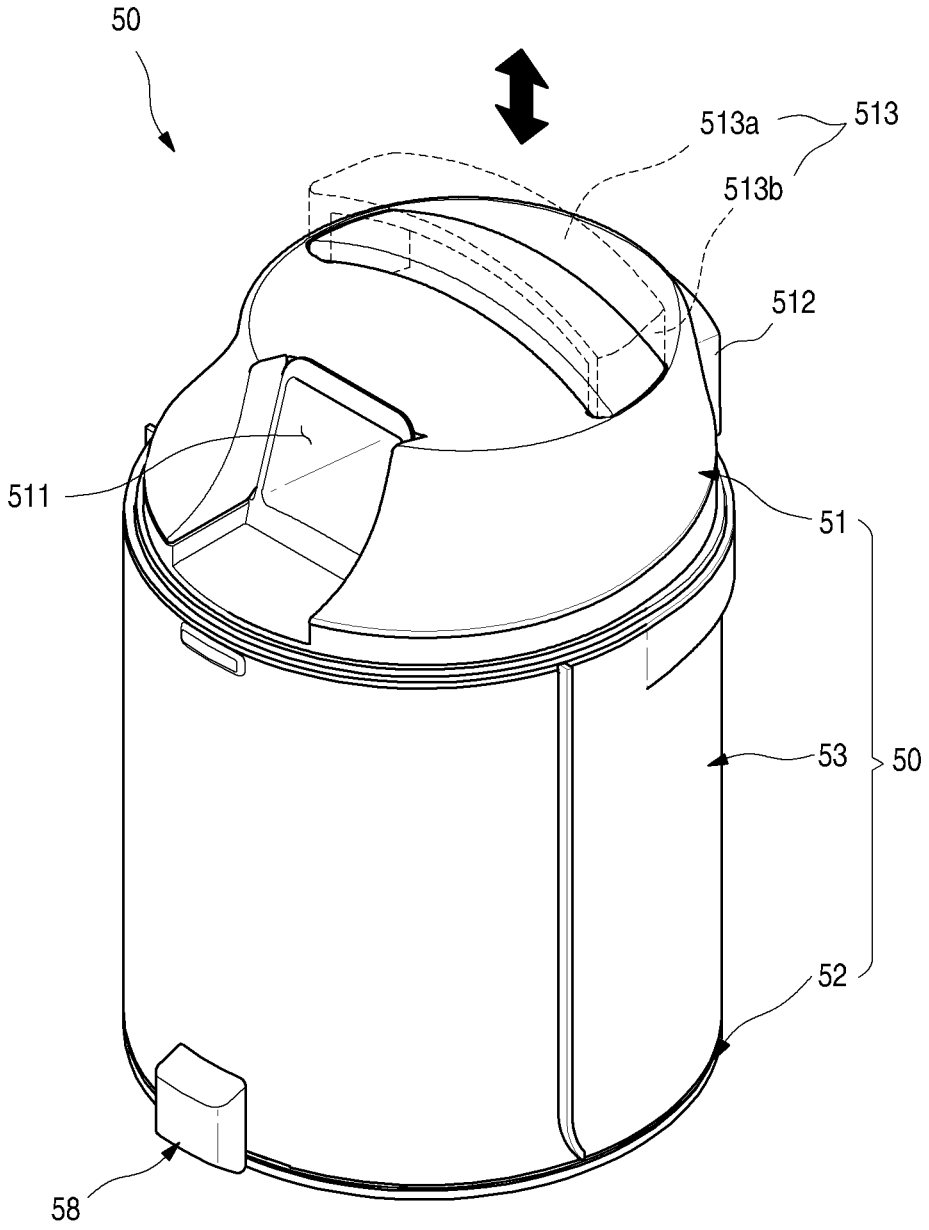
FIG. 38 is a perspective view of the dust container.
Figure 39:
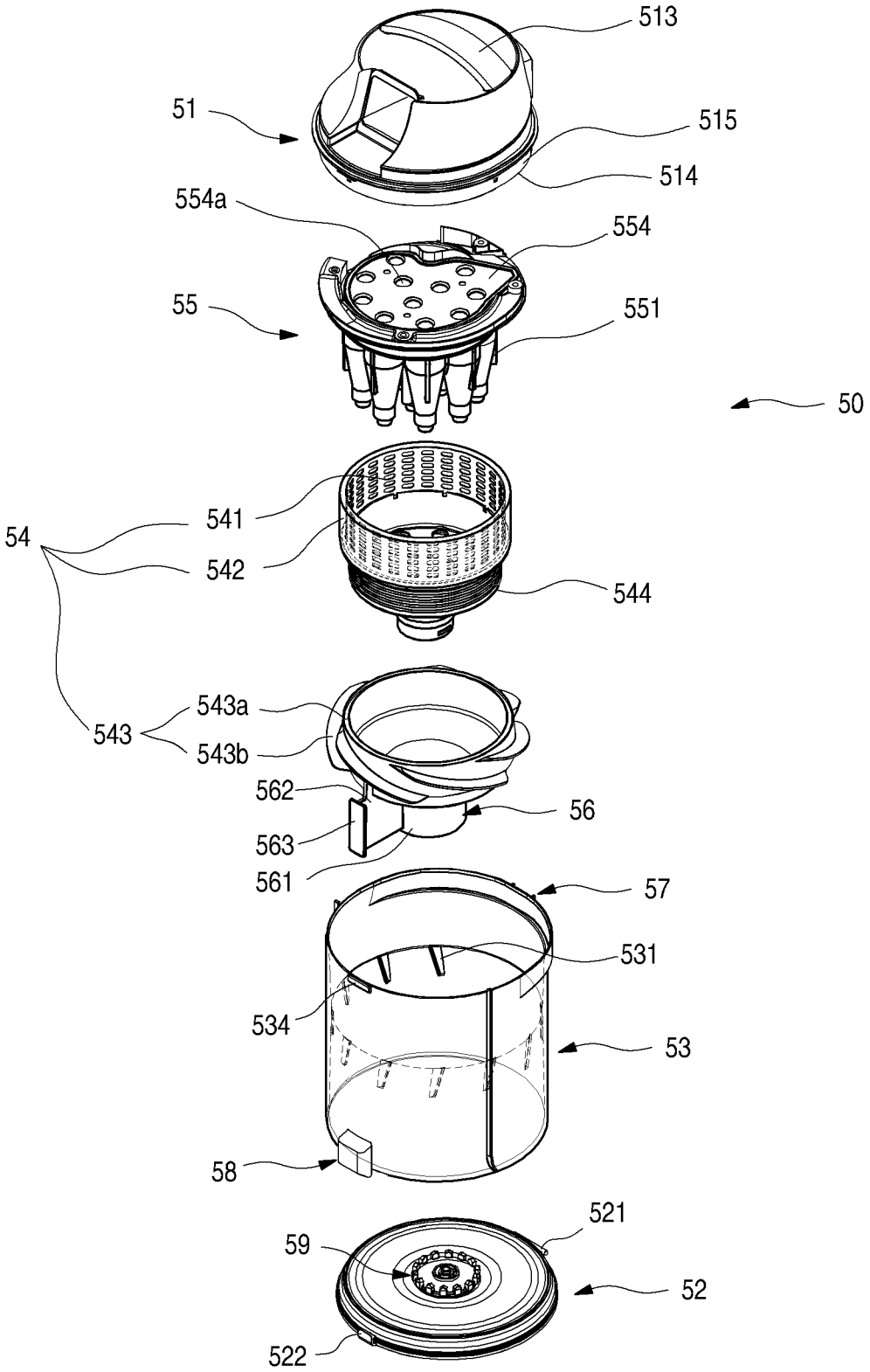
FIG. 39 is an exploded perspective view of the dust container.

FIG. 38 is a perspective view of the dust container. And FIG. 39 is an exploded perspective view of the dust container.

As illustrated in the drawings, the dust container 50 serves to separate and store the dust in the air introduced through the suction unit 20, and the suctioned air may be filtered, in turn, through a first cyclone 54 and a second cyclone 55 which separate the dust from the air in a cyclone method, then may be discharged through the discharge port 512 and may be introduced inside the body part 30.

The dust container 50 may include a transparent case 53 which is generally formed in a cylindrical shape, an upper cover 51 which opens and closes an opened upper end of the transparent case 53 and a lower cover 52 which opens and closes an opened lower end of the transparent case 53. And the first cyclone 54, the second cyclone 55, an inner case 544, the dust compressing unit 56, a guide unit 543 and so on may be accommodated in the transparent case 53.

More specifically, the upper cover 51 forms an exterior of an upper surface of the dust container 50 and is formed to be shielded by the cover member 40 while being installed at the body part 30. And the suction port 511 is formed at a front of the dust container 50. The suction port 511 is formed to be in communication with the connector 401 while the cover member 40 is closed, such that the air containing the dust which is suctioned through the suction unit 20 is introduced inside the dust container 50.

And although not illustrated in detail, a passage guide 518 is provided inside the upper cover 51 so that the air introduced through the suction port 511 is guided along an outer circumference thereof and flows downward along an inner surface of the transparent case 53. At this point, the flowing air may be discharged in one direction along the inner surface of the transparent case 53 by the upper cover 51 and may be rotated along a circumference of the transparent case 53 while being rotated spirally.

The discharge port 512 is formed at a rear of the upper cover 51 which faces the suction port 511. The discharge port 512 is an outlet through which the air from which the dust is filtered while passing through the first cyclone 54 and the second cyclone 55 inside the dust container 50 is discharged to an outside of the dust container 50. The air in the dust container 50 may be guided to the discharge port 512 by the passage guide 518 provided inside the upper cover 51. And the discharge port 512 may be in contact with the filter hole 361*a* of the prefilter assembly 36 and may be introduced into the body part 30 through the filter hole 361*a*.

Meanwhile, a dust container handle 513 which is withdrawable upward may be provided at an upper surface of the upper cover 51. The dust container handle 513 may include a handle portion 513*a* which extends transversely to be gripped by the user and a side extending portion 513*b* which extends vertically from each of both ends of the handle portion 513*a*. The side extending portion 513*b* may be inserted inside the upper cover 51. At this point, the handle portion 513*a* may be in close contact with the upper surface of the upper cover 51. While the dust container 50 is installed, the dust container handle 513 is maintained in an inserted state due to its own weight and does not interfere with the cover member 40 when the cover member 40 is opened and closed.

And a cover inserting portion 514 which extends downward along a circumference of the upper cover 51 is formed at a lower end of the upper cover 51, and an upper gasket 515 is provided at the upper cover inserting portion 514 to seal the transparent case 53 while the upper cover 51 is installed at the transparent case 53. And the upper cover 51 is maintained in a coupled state to the transparent case 53 by the upper locker 57 which will be described below.

The lower cover 52 may be formed in a corresponding shape to shield an opened lower surface of the transparent case 53. A lower gasket 523 is provided at a circumference of the lower cover 52 to be in close contact with the transparent case 53 while the lower cover 52 is closed, thereby sealing between the transparent case 53 and the lower cover 52.

And a transmission gear 59 may be provided at a center of the lower cover 52. The transmission gear 59 connects the compression motor assembly 323 with the dust compressing unit 56 and transmits power so that the dust compressing unit 56 is driven by driving of the compression motor assembly 323.

One side of the lower cover 52 may be shaft-coupled to the lower end of the transparent case 53, and thus the lower cover 52 may be opened and closed by rotation to remove the dust. And the lower cover 52 is maintained in the coupled state to the transparent case 53 by a lower locker 58 which will be described below. Therefore, the lower cover 52 may be selectively opened and closed by an operation of the lower locker 58.

And the first cyclone 54 is formed to filter the dust and foreign substances from the introduced air and also to allow the air, from which the dust and the foreign substances are filtered, to be introduced inward. The first cyclone 54 may include a cylindrical strainer 541 which has a plurality of holes and a dust filter 542 which is provided outside or inside the strainer 541.

Therefore, the air introduced along the transparent case 53 may be filtered by the filter unit 39, and the filtered air may be introduced inside the strainer 541, then may fall downward, may pass through the guide unit 543 and may be stored in a first dust collecting space 501 formed at a lower portion of the dust container 50. Meanwhile, the fine dust which is not filtered by the filter unit 39 may pass through the filter unit 39 and may be introduced into the second cyclone 55 to be separated therein.

The second cyclone 55 may include a plurality of casings 551 which are accommodated inside the strainer 541 and formed in a conical shape which becomes narrower downward. An upper end and a lower end of each of the casings 551 may be opened so that the fine dust is separated and discharged downward while the suctioned air is rotated inside the casing 551 and the air from which the fine dust is separated flows upward. The fine dust separated by the casing 551 may be stored in a second dust collecting space 502 which is separated from the first dust collecting space 501.

An inlet port 551*a* through which the air is introduced may be formed at an upper portion of the casing 551. And a guide vane 552 formed in a spiral shape along an inner circumference of the casing 551 is provided at the inlet port 551*a* to generate a rotating flow of the introduced air.

A vortex finder 553 at which an outlet port 553*a* for discharging the air separated from the fine dust in the casing 551 is formed is provided at the upper portion of the casing 551. The vortex finder 553 shields an opened upper surface of the casing 551, and the outlet port 553*a* may be disposed at a center of the casing 551. And a cyclone cover 554 which forms an upper surface of the second cyclone 55 is provided. The cyclone cover 554 is formed to be in communication with the outlet ports 553*a* of a plurality of vortex finders 553. The vortex finder 553 and the cyclone cover 554 may be formed integrally, and the guide vane 552 may also be integrally formed with the vortex finder 553. And the cyclone cover 554 may be coupled and fixed to the upper cover 51 or may be fixed to the upper end of the transparent case 53.

The air which is discharged upward through the outlet port 553*a* of the vortex finder 553 may flow through the upper cover 51, may flow along an inside of the body part 30 through the discharge port 512 and then may be discharged outside the body part 30 through the rear cover 314.

The inner case 544 may support the first cyclone 54 and the second cyclone 55 and may also divide the first dust collecting space 501 and the second dust collecting space 502. The inner case 544 may be formed in a cylindrical shape of which an upper surface and a lower surface are opened, and a diameter of a lower portion thereof may be formed smaller than that of an upper portion thereof. Therefore, a space between the inner case 544 and the transparent case 53 may be defined as the first dust collecting space 501 in which the dust separated by the first cyclone 54 is stored, and a space inside the inner case 544 may be defined as the second dust collecting space 502 in which the dust separated by the second cyclone 55 is stored.

An upper portion of the inner case 544 is formed so that the diameter thereof becomes narrower downward and also formed to accommodate a lower portion of the casing 551. And the guide unit 543 may be provided at the upper portion of the inner case 544.

The guide unit 543 serves to enable the air separated from the dust by the first cyclone 54 to be moved downward while being spirally rotated and may include a guide base 543*a* which is installed outside the inner case 544 and a vane 543*b* which protrudes from the guide base 543*a*.

The guide base 543*a* may be formed in a cylindrical shape and may be disposed outside the inner case 544. The guide base 543*a* may be coupled to the inner case 544 or may be integrally formed with the inner case 544. And the guide base 543*a* may be installed outside the inner case 544 to be rotatable. And the guide base 543*a* may be integrally formed with the dust compressing unit 56.

The vane 543*b* may be formed along a circumference of an outer surface of the base 31 and may be formed to be inclined such that a flowing direction of the dust and the air is forced spirally. At this point, a plurality of vanes 543*b* may be disposed so that adjacent vanes 543*b* are at least partially overlapped with each other when being seen from an upper side, and the dust and the air may flow downward through a passage formed between the adjacent vanes 543*b*.

The dust guided through the vane 543*b* may pass through the vane 543*b* and then may be stored in the first dust collecting space 501. And the dust stored in the first dust collecting space 501 may not flow back in a reverse direction but may be stayed in the first dust collecting space 501 due to a structure of the vanes 543*b* which are formed to be inclined and disposed to be vertically overlapped with each other.

In particular, a backflow preventing portion 531 is formed at the inner surface of the transparent case 53 corresponding to an area of the vane 543*b*. The backflow preventing portion 531 may be disposed along an inner circumference of the transparent case 53 at a predetermined interval. The backflow preventing portion 531 may be formed in a rib shape which extends in a direction which crosses the vane 543*b*.

Therefore, some of the dust which flows back in the first dust collecting space 501 collides with the backflow preventing portion 531 during a process in which the vane 543*b* is rotated. Therefore, the dust does not pass through the vane 543*b*, falls downward again and then is primarily compressed. That is, some of the dust which flows upward is continuously and repeatedly falls downward by the vane 543*b* and the backflow preventing portion 531 and then compressed while colliding with another dust.

The dust compressing unit 56 is provided at a lower portion of the inner case 544 and formed to compress the dust stored inside the first dust collecting space 501 by rotation, thereby reducing a volume of the dust.

Specifically, the dust compressing unit 56 may include a rotating portion 561 and a pressing portion 562. The rotating portion 561 is formed in a cylindrical shape and installed outside the inner case 544. The rotating portion 561 may be independently rotated according to a coupling state with the inner case 544 and may be formed to be rotated along with the inner case 544. Of course, the rotating portion 561 may also be rotated along with the guide unit 543 when being coupled to the guide unit 543.

The pressing portion 562 may be formed to cross the first dust collecting space 501 from one side of the rotating portion 561 to the inner surface of the transparent case 53. The pressing portion 562 may be formed in a plate shape corresponding to a cross section of the first dust collecting space 501 and may divide an inside of the first dust collecting space 501. An inner wall (not shown) which extends inward to be overlapped with the pressing portion 562 may be formed inside the first dust collecting space 501. The dust stored in the first dust collecting space 501 may be compressed between the pressing portion 562 and the inner wall by normal and reverse rotation of the pressing portion 562. That is, the dust stored in the first dust collecting space 501 is secondarily compressed by the rotation of the pressing portion 562.

A plurality of vent holes 562*a* may be formed at the pressing portion 562 to solve resistance of the air which may be generated when the pressing portion 562 is rotated and also to solve a pressure unbalance between spaces divided by the pressing portion 562. And a decoration member 563 which is in contact with the inner surface of the transparent case 53 may be installed at an extending end of the pressing portion 562. The decoration member 563 may be formed in a quadrangular shape which is in surface contact with the transparent case 53 and may shield between the pressing portion 562 and the transparent case 53. And the decoration member 563 may be formed of a wear resistant material and may be formed of a lubricant material to allow smooth rotation of the pressing portion 562.

Meanwhile, one pair of supporting ribs 532 may be formed at an outer surface of the transparent case 53. The supporting ribs 532 may be formed to extend from an upper end of the transparent case 53 to a lower end thereof. And the supporting ribs 532 are in contact with both of left and right side ends of the opened front surface of the body part 30 when the dust container 50 is installed and guide the exact installing of the dust container 50.

Figure 40:
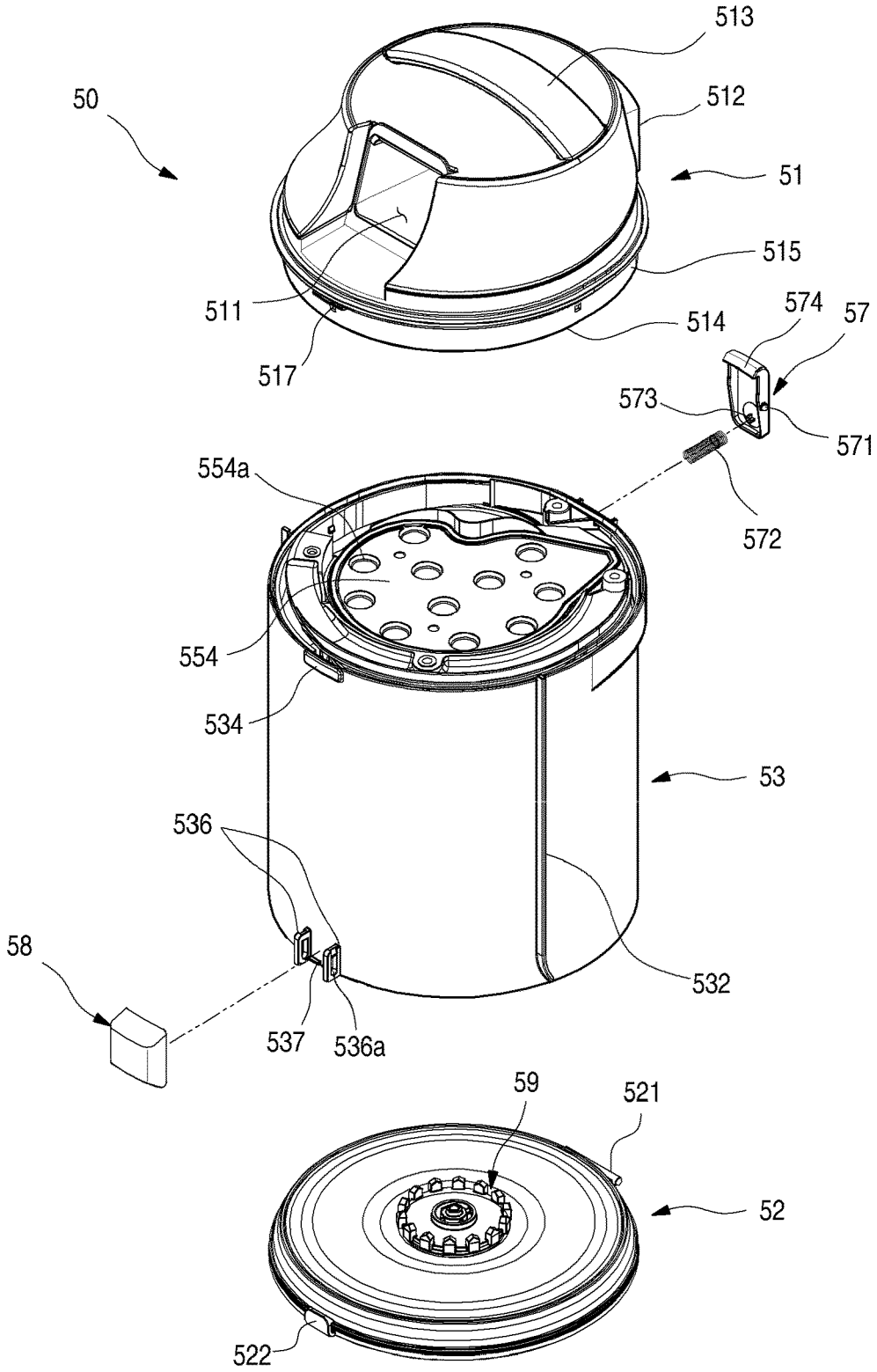
FIG. 40 is an exploded perspective view illustrating a coupling structure of an upper cover and a lower cover of the dust container when being seen from one side.
Figure 41:
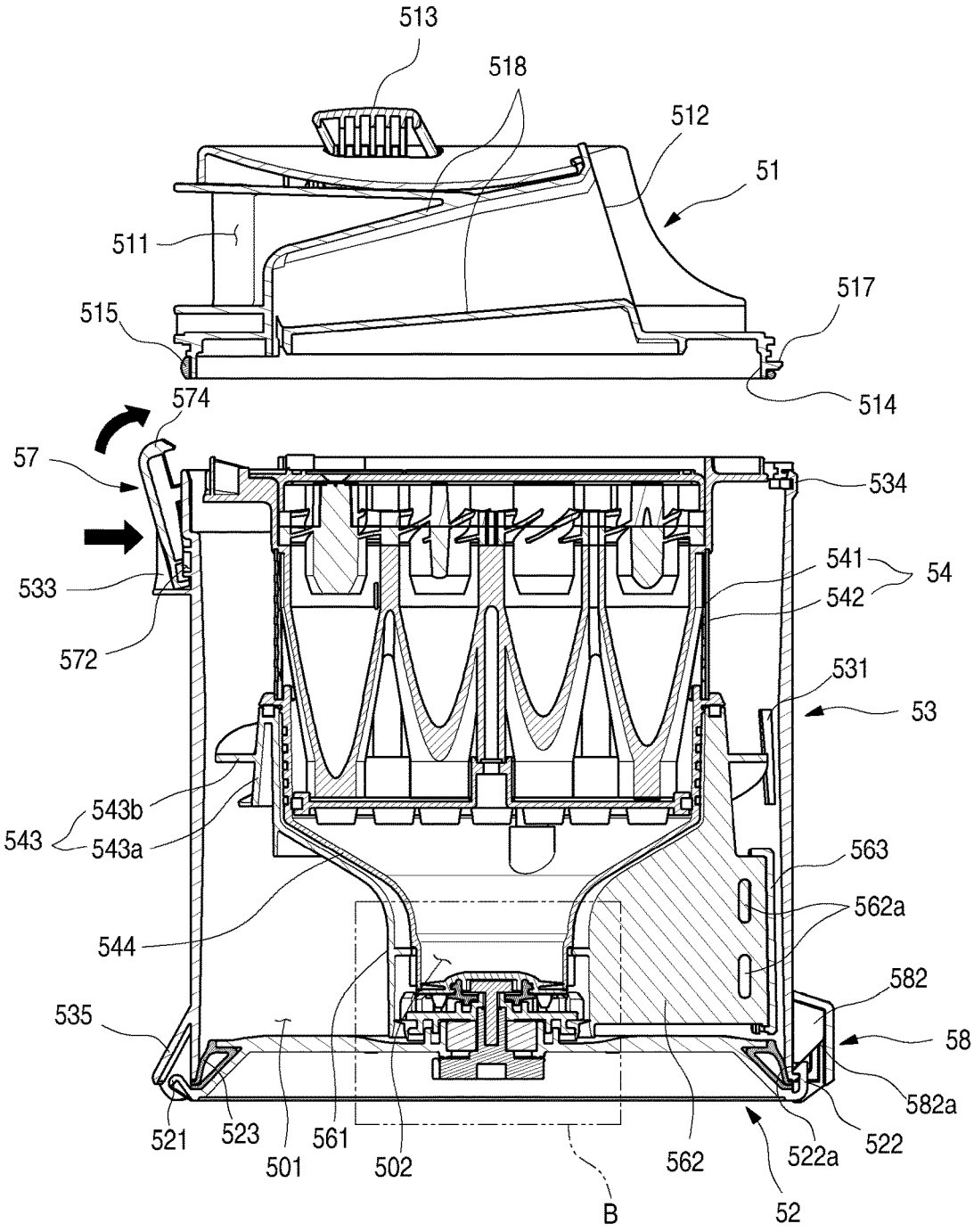
FIG. 41 is a cross-sectional view illustrating a state in which the upper cover is opened.
Figure 42:
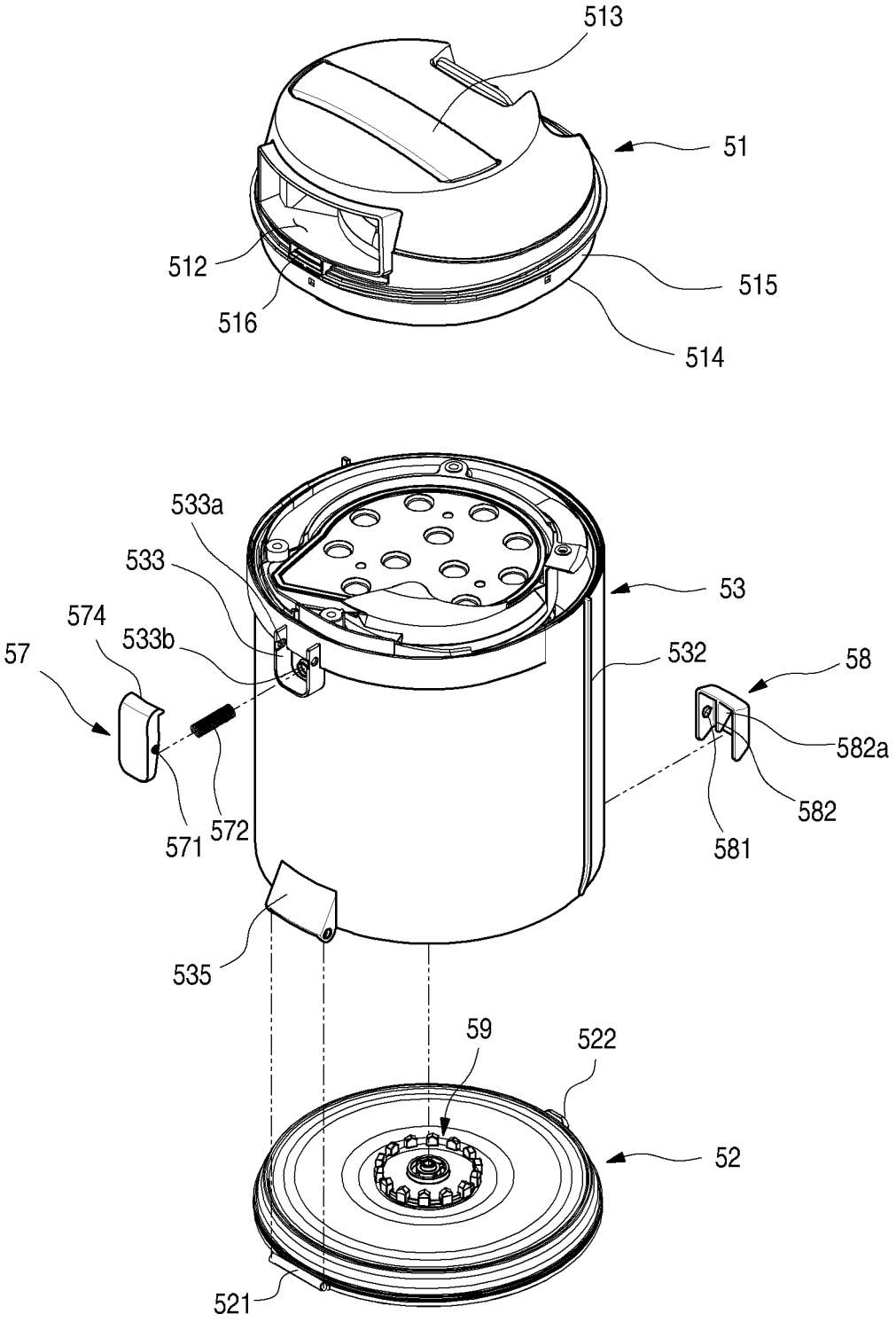
FIG. 42 is an exploded perspective view illustrating the coupling structure of the upper cover and the lower cover of the dust container when being seen from another side.
Figure 43:
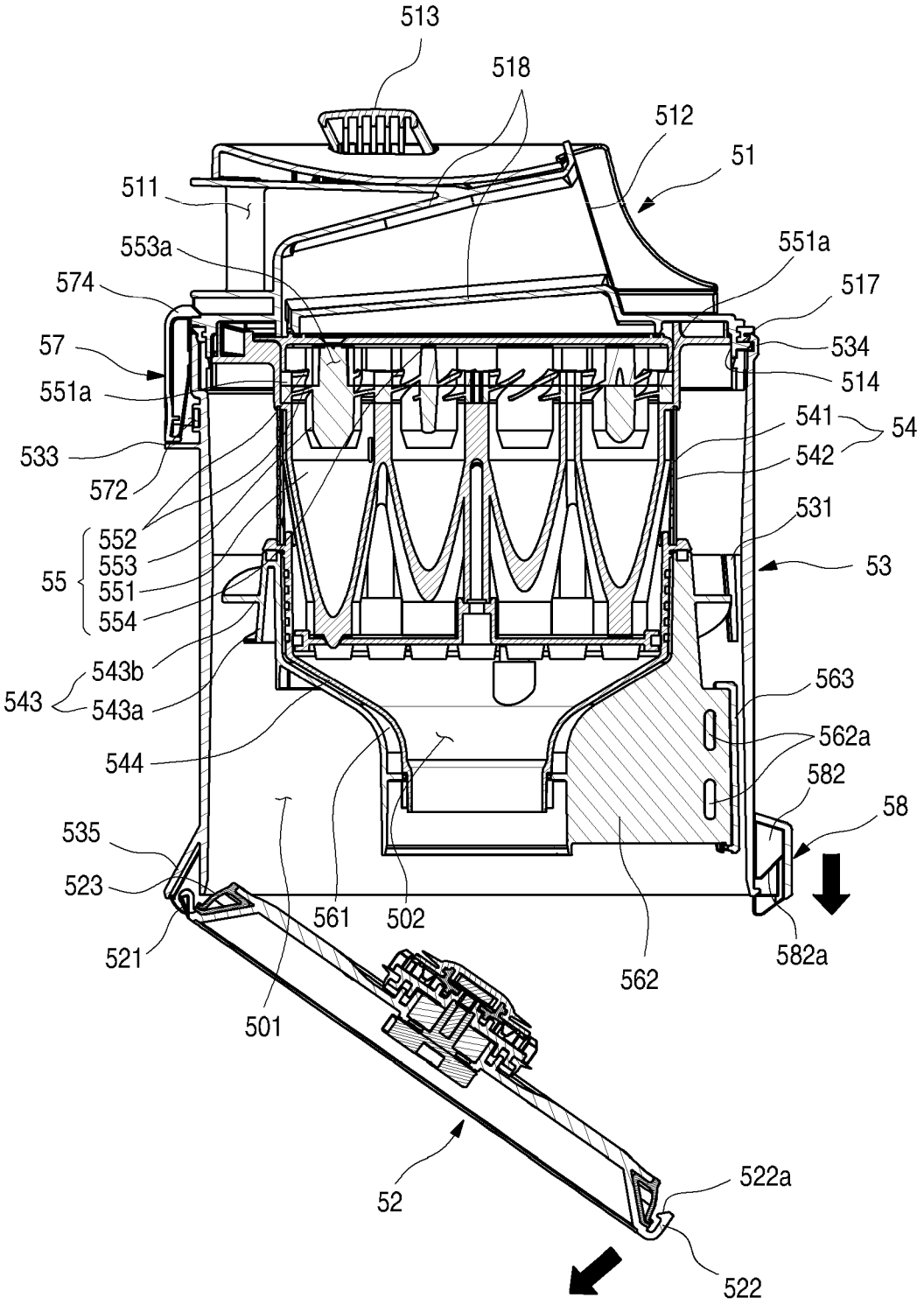
FIG. 43 is a cross-sectional view illustrating a state in which the lower cover is opened.

FIG. 40 is an exploded perspective view illustrating a coupling structure of the upper cover and the lower cover of the dust container when being seen from one side. And FIG. 41 is a cross-sectional view illustrating a state in which the upper cover is opened. And FIG. 42 is an exploded perspective view illustrating the coupling structure of the upper cover and the lower cover of the dust container when being seen from another side. And FIG. 43 is a cross-sectional view illustrating a state in which the lower cover is opened.

As illustrated in the drawings, the upper cover 51 and the lower cover 52 may be respectively installed at the upper end and the lower end of the transparent case 53 to shield the transparent case 53.

The upper cover 51 may be maintained in a restricted state to the transparent case 53 by the upper locker 57. And when it is necessary to disassemble and clean or maintain internal elements of the dust container 50, the upper cover 51 may be separated from the transparent case 53 by an operation of the upper locker 57.

The upper locker 57 may be installed at an upper locker installing portion 533 formed at the upper end of the transparent case 53. At this point, a locker rotating shaft 571 which protrudes laterally from each of both side surfaces of the upper locker 57 may be inserted and installed into a locker hole 533*a* of the upper locker installing portion 533, and thus the upper locker 57 may be operated to be rotated.

And a locker spring 572 may be provided between the upper locker installing portion 533 and the upper locker 57 under the locker rotating shaft 571 and a lower portion of the upper locker 57 may be elastically supported by a spring installing portion 573 and a spring guide 533*b*.

The upper locker 57 may extend further than the upper end of the transparent case 53, and a hook portion 574 which protrudes in a hook shape may be formed at an extending end thereof. The hook portion 574 may be inserted into a hook restricting portion 516 of the upper cover 51 to be caught and restricted to each other while the upper cover 51 is installed.

An upper protrusion 517 may be formed at one side of the upper cover 51 which faces the hook restricting portion 516, and an upper groove 534 in which the upper protrusion 517 is inserted is correspondingly formed at an upper end of the inner surface of the transparent case 53.

Therefore, while the upper cover 51 is installed, one end of the upper cover 51 is fixed by coupling between the upper protrusion 517 and the upper groove 534, and the other end of the upper cover 51 is fixed by the upper locker 57, and thus the upper cover 51 may be maintained in an installed state. And to separate the upper cover 51, the restriction of one end of the upper cover 51 is released by operating the upper locker 57, and then the upper protrusion 517 and the upper groove 534 are separated from each other.

The lower cover 52 may be maintained in a closed state by the lower locker 58, and the first dust collecting space 501 and the second dust collecting space 502 may be opened by opening the lower cover 52, and thus the dust in the first dust collecting space 501 and the second dust collecting space 502 may be removed.

A lower cover shaft 521 is formed at one end of the lower cover 52. The lower cover shaft 521 is rotatably coupled to a lower cover coupling portion 535 formed at the lower end of the transparent case 53. Accordingly, when the lower cover 52 is opened and closed, the lower cover 52 is rotated about an axis of the lower cover 52.

And the lower locker 58 is provided at the other end of the transparent case 53 corresponding to the lower cover coupling portion 535. The lower locker 58 may be installed to be slidable vertically, and thus the lower cover 52 may be selectively restricted.

Specifically, a lower locker installing portion 536 is formed at the lower end of the transparent case 53 which faces the upper locker installing portion 533. The lower locker installing portion 536 may be configured with one pair of protruding ribs, and a locker slot 536*a* which extends vertically is formed therein.

A case catching portion 537 is formed between the protruding ribs of the lower locker installing portion 536. The case catching portion 537 protrudes from the lower end of the transparent case 53, and a lower hook 522 of the lower cover 52 may be caught and restricted while the lower cover 52 is closed.

And the lower locker 58 is formed to be recessed, such that the lower locker installing portion 536 is accommodated therein, and a locker protrusion 581 which protrudes inward is formed at each of both sides of an inner surface of the lower locker 58 and inserted into the locker slot 536*a*. Therefore, the lower locker 58 may be installed to be vertically movable while being installed at the lower locker installing portion 536.

And a pushing portion 582 which extends downward may be formed at a recessed inside of the lower locker 58. The pushing portion 582 is in contact with the lower hook 522 formed at the lower cover 52 and is formed to have an inclined surface 582*a*. When the lower locker 58 is moved downward, the pushing portion 582 pushes the lower hook 522 so that the lower hook 522 is separated from the case catching portion 537 and thus the lower cover 52 is opened.

An inclined surface 522*a* may be formed at an upper end of the lower hook 522. While the lower cover 52 is closed, the inclined surface 522*a* of the lower hook 522 is in contact with the inclined surface 582*a* of the pushing portion 582. In this state, when the lower locker 58 is moved downward, the pushing portion 582 pushes the inclined surface 522*a* of the lower hook 522, and thus the lower hook 522 is elastically deformed. Therefore, due to the elastic deformation of the lower hook 522, the lower hook 522 may be released from the case catching portion 537.

Figure 44:
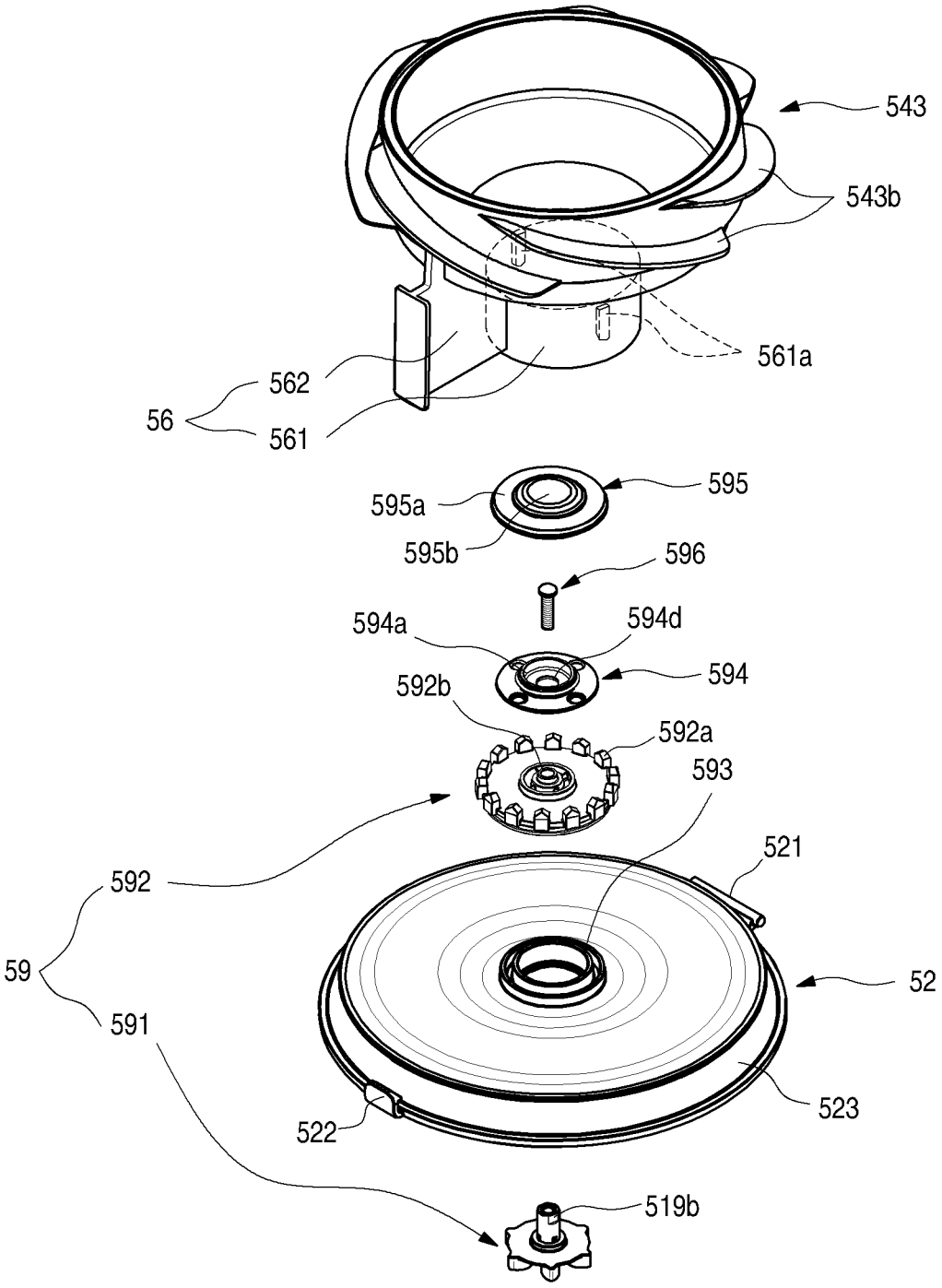
FIG. 44 is an exploded perspective view illustrating a coupling structure of the lower cover and a dust compressing unit.
Figure 45:
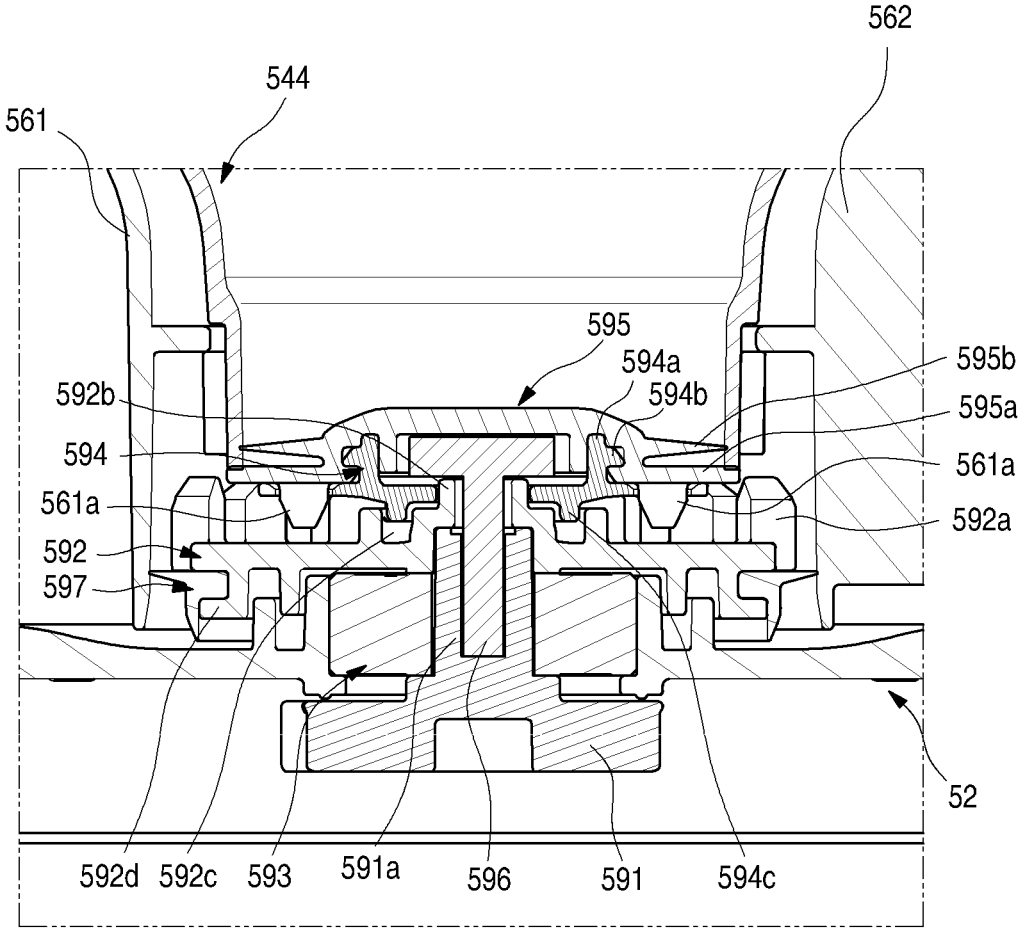
FIG. 45 is an enlarged view of a B portion in FIG. 41.

FIG. 44 is an exploded perspective view illustrating a coupling structure of the lower cover and the dust compressing unit. And FIG. 45 is an enlarged view of a B portion in FIG. 41.

As illustrated in the drawings, a bearing 593 may be installed at a center of the lower cover 52. And the first transmission gear 591 may be provided at a lower surface of the lower cover 52. The first transmission gear 591 may be connected with the compression motor assembly 323 to be rotatable. When the dust container 50 is seated on the seating part 32, the first transmission gear 59 is naturally connected to the compression motor assembly 323 to be rotatable.

A rotating shaft 591*a* of the first transmission gear 591 may be installed to pass through the bearing 593 and may be smoothly rotated by the bearing 593. And a second transmission gear 592 is disposed at an upper surface of the lower cover 52 and formed to be connected to the rotating shaft 591*a* of the first transmission gear 591 through the bearing 593. Accordingly, the second transmission gear 592 may be rotated along with the first transmission gear 591.

The second transmission gear 592 is formed in a circular plate shape, and a plurality of gear portions 592*a* are formed along a circumference thereof. The plurality of gear portions 592*a* may be coupled to a gear coupling protrusion 561*a* formed at an inner circumferential surface of the rotating portion 561 of the dust compressing unit 56.

That is, in an assembling operation of the dust container 50, when the lower cover 52 is closed while the dust compressing unit 56 is installed, the gear portion 592*a* of the second transmission gear 592 is matched with the gear coupling protrusion 561*a* of the dust compressing unit 56, and thus the dust compressing unit 56 may be driven.

Meanwhile, a coupling boss 592*b* may be formed at a center of an upper surface of the second transmission gear 592, and a seating groove 592*c* in which a gasket plate 594 is seated may be formed outside the coupling boss 592*b*.

And a gasket installing protrusion 592*d* is formed at a lower surface of the second transmission gear 592. A transmission gear gasket 597 is installed at the gasket installing protrusion 592*d*. The transmission gear gasket 597 may be sealed by being in contact with the inner circumferential surface of the rotating portion 561. At this point, the transmission gear gasket 597 is integrally coupled to the second transmission gear 592 and rotated together when the second transmission gear 592 is rotated.

The gasket plate 594 is formed in a circular plate shape, and an inner gasket 595 which shields an opened lower surface of the inner case 544 is installed thereat. The inner gasket 595 may be integrally coupled with gasket installing portions 594*a* and 594*b* formed at an upper end of the gasket plate 594. The inner gasket 595 may be formed in a shape corresponding to an opening of the inner case 544.

The inner gasket 595 may include a first sealing portion 595*a* which is formed in a circular plate shape to be in contact with an opened lower end of the inner case 544 and a second sealing portion 595*b* which is provided above the first sealing portion 595*a* and inserted inside the inner case 544 to be in contact with an inner surface of the inner case 544, and may seal the opening of the inner case 544 in a fixed state.

The gasket installing portions 594*a* and 594*b* include a first protruding portion 594*a* which protrudes upward from an upper surface of the gasket plate 594 and a second protruding portion 594*b* which protrudes vertically outward from the first protruding portion 594*a*. Both of the first protruding portion 594*a* and the second protruding portion 594*b* are inserted into a lower surface of the inner gasket 595 and may firmly fix the inner gasket 595 to the gasket plate 594.

Meanwhile, a seating rib 594*c* which is inserted into the seating groove 592*c* may be formed at a lower surface of the gasket plate 594. The seating rib 594*c* is formed to be movable while being inserted into the seating groove 592*c*.

And a shaft coupling hole 594*d* in which a shaft coupling member 596 for coupling the gasket plate 594 with the second transmission gear 592 is fastened is formed at a center of the gasket plate 594. The shaft coupling member 596 may be fastened through the shaft coupling hole 594*d* and the coupling boss 592*b* of the second transmission gear 592.

At this point, the coupling boss 592*b* is formed higher than the gasket plate 594, and thus the shaft coupling member 596 does not press the gasket plate 594. Therefore, the gasket plate 594 may be installed to be freely rotatable even while being coupled to the second transmission gear 592.

That is, when the compression motor assembly 323 is driven while the dust container 50 is installed, the first transmission gear 591 and the second transmission gear 592 are rotated, and the rotating portion 561 which is gear-coupled with the second transmission gear 592 is also rotated, and thus the dust compressing unit 56 may be driven.

At this point, since the gasket plate 594 seated at the second transmission gear 592 is coupled to be freely rotatable above the second transmission gear 592, the stopped state may be maintained even when the second transmission gear 592 is rotated. Therefore, the inner gasket 595 installed at the gasket plate 594 may be maintained in a state of shielding the lower surface of the inner case 544, i.e., the second dust collecting space 502.

Hereinafter, when the main motor is driven, the flow of the dust and the air in the vacuum cleaner will be described.

Figure 46:
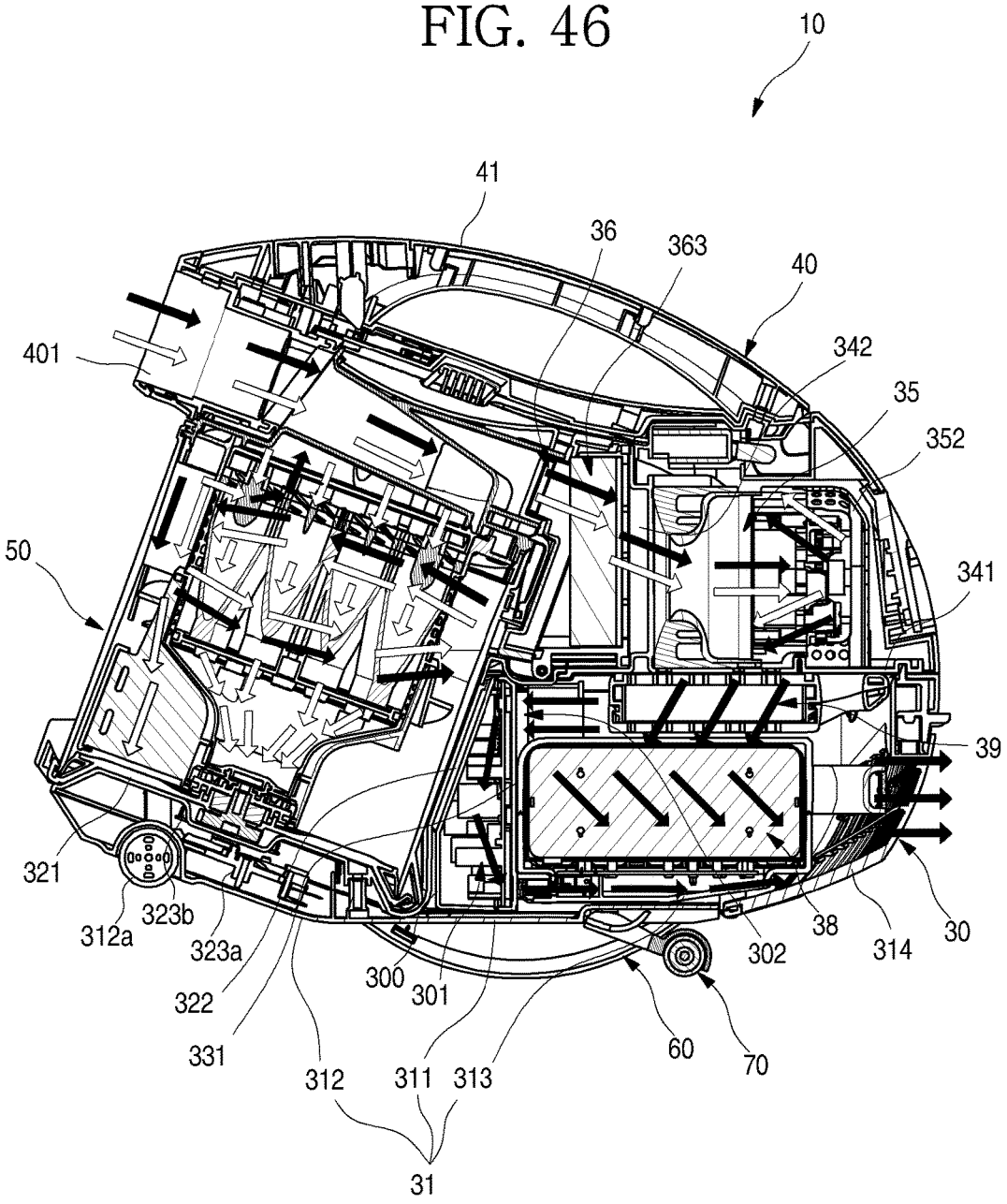
FIG. 46 is a cross-sectional view illustrating a flow of air and dust in the cleaner body.
Figure 47:
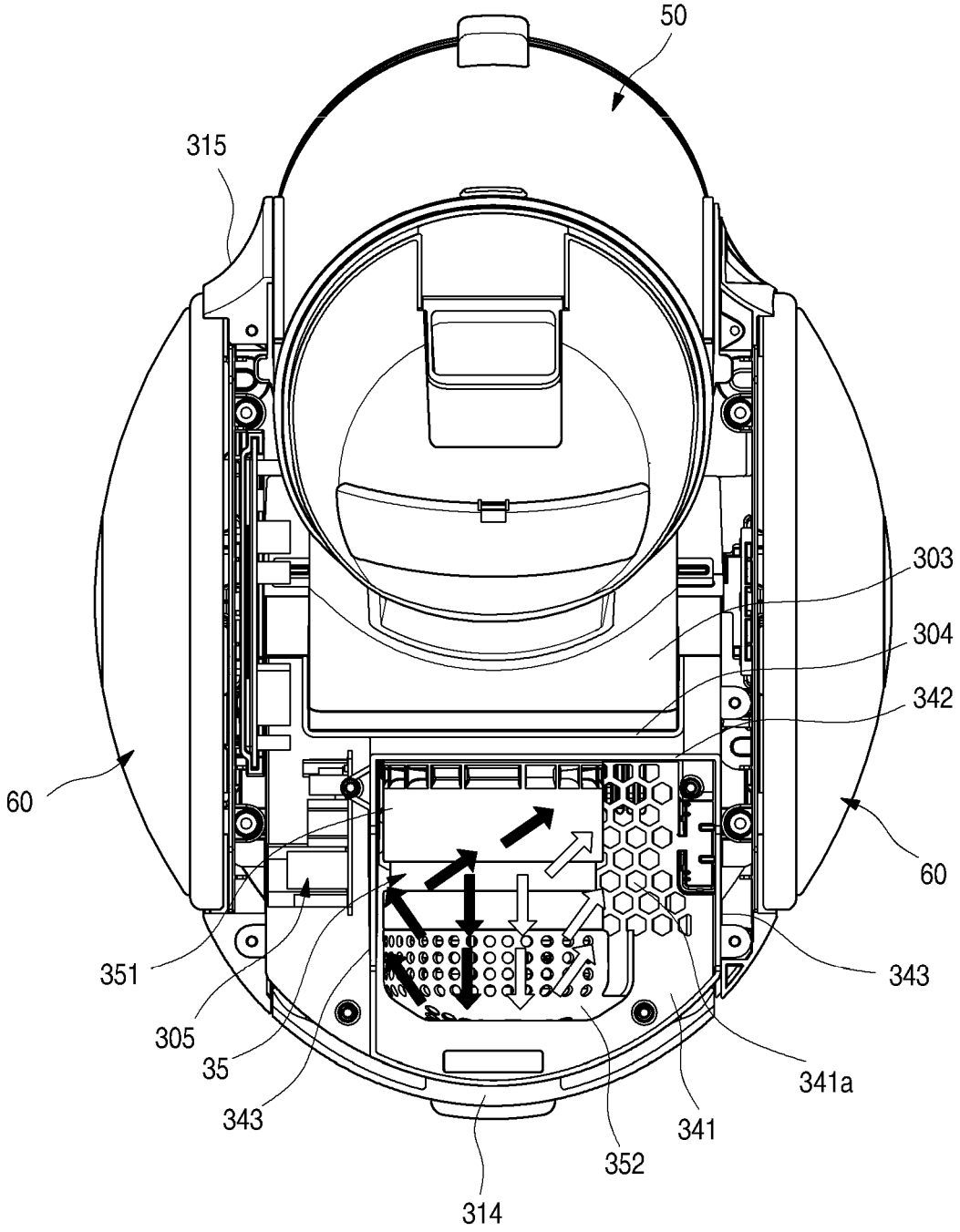
FIG. 47 is a plan view illustrating the flow of the air and dust in the cleaner body.

FIG. 46 is a cross-sectional view illustrating the flow of the air and the dust in the cleaner body 10. And FIG. 47 is a plan view illustrating the flow of the air and dust in the cleaner body 10.

As illustrated in the drawings, when the user operates the vacuum cleaner 1, the driving of the main motor 35 starts, and the air containing the dust may be suctioned through the suction unit 20 by a suction force which is generated by the main motor 35.

The air containing the dust may be suctioned through the connector 401 of the cleaner body 10 and then may be suctioned into the dust container 50 through the suction port 511 of the dust container 50. And in the dust container 50, the dust and the fine dust are separated by the first cyclone 54 and the second cyclone 55 and then collected in the first dust collecting space 501 and the second dust collecting space 502, respectively.

Specifically, the air containing the dust introduced through the suction port 511 is introduced between the dust container 50 and the strainer 541 through the passage guide 518. At this point, the air and the dust introduced by the passage guide 518 flows while being rotated along an inner wall of the dust container 50.

While the flowing dust and air pass though the dust filter 542 and the strainer 541, the dust may be primarily filtered, and the filtered air may be introduced into a space inside the strainer 541. And the separated dust falls downward, passes through the guide unit 543 and is then stored in the first dust collecting space 501. The dust collected in the first dust collecting space 501 may be doubly compressed by the dust compressing unit 56, the guide unit 543 and the backflow preventing portion 531 and then may be stored in the first dust collecting space 501.

Meanwhile, the air filtered while passing through the dust filter 542 and the strainer 541 is introduced inside the casing 551 through the inlet port 551*a* of the casing 551. At this point, the air introduced into the casing 551 by the guide vane 552 disposed at a side of the inlet port 551*a* forms a vortex flow along an inner wall of the casing 551.

In this process, the fine dust and the air are separated, and the fine dust is secondarily filtered. The fine dust separated in the casing 551 may fall downward through an opened lower surface of the casing 551 and may be stored in the second dust collecting space 402. And the filtered air flows upward through the outlet port 553*a* of the vortex finder 553 and then flows to the outside of the dust container 50 through the discharge port 512.

The fine dust in the air discharged through the discharge port 512 may be secondarily filtered while the air passes through the prefilter assembly 36. And the air passed through the prefilter assembly 36 flows to an internal space of the upper frame 34 and passes through the main motor 35. The air passed through the main motor 35 flows downward through the plate hole 341*a* and passes through the filter unit 39 installed at the lower frame 33.

While the air passes through the filter unit 39, the ultrafine dust contained in the air may be separated. Eventually, the ultrafine dust may also be tertiarily filtered. Most of the filtered air is used to cool the battery unit 38 under the filter unit 39 and then discharged backward through the rear cover 314.

And some of the air passed through the filter unit 39 passes through the first barrier hole 331*a*. In this process, the noise filter 302 and the main PCB 301 are cooled. The air which cools the noise filter 302 and the main PCB 301 may be naturally discharged from the inside of the body part 30 or may be discharged through the rear cover 314.

Meanwhile, to empty the dust container 50 after using of the vacuum cleaner 1, first, the push member 81 is pushed to operate the locking assembly 80, and the cover member 40 is opened. When the cover member 40 is completely opened, the cover member 40 is maintained in the opened state by the link assembly 90.

In this state, the dust container 50 is separated from the body part 30, and then the lower cover 52 may be opened by operating the lower locker 58. When the lower cover 52 is opened, all of the dust in the first dust collecting space 501 and the second dust collecting space 502 may be removed. And for cleaning and checking the dust container 50, the upper cover 51 may also be opened by operating the upper locker 57, and thus internal elements of the dust container 50 may be separated and then may be cleaned and checked.

After the dust container 50 is emptied, the dust container 50 is installed again at the body part 30, and then the cover member 40 is closed by rotating the cover member 40.

Meanwhile, when the vacuum cleaner 1 is used, the user moves while gripping the handle 23. In this process, travelling of the cleaner body 10 may be controlled.

Figure 48:
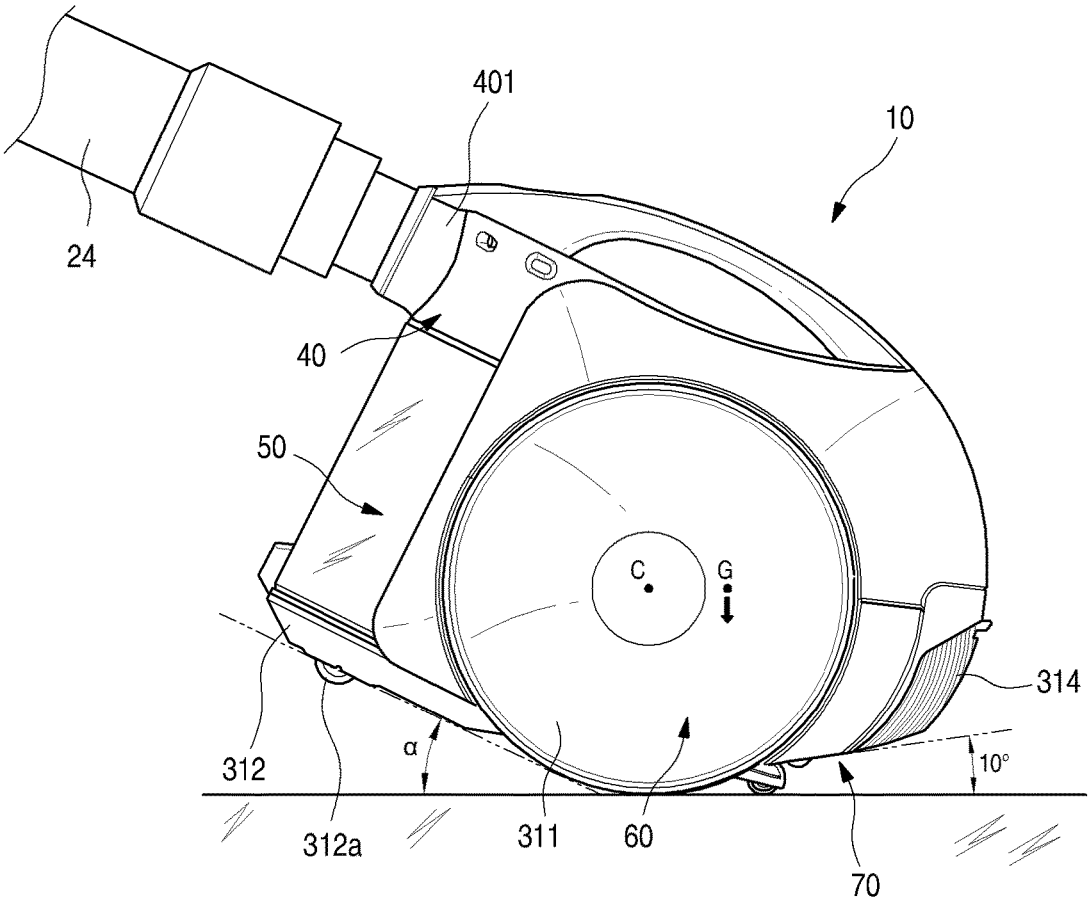
FIG. 48 is a view illustrating a stopping state of the cleaner body.

FIG. 48 is a view illustrating a stopped state of the cleaner body 10.

As illustrated in the drawing, while the cleaner body 10 is not moved and is in the stopped state, the center G of the gravity of the cleaner body 10 is located at a rear side further than the rotating center C of the moving wheel 60.

In this state, the cleaner body 10 is intended to be rotated clockwise (in a normal direction) based on the rotating center C of the moving wheel 60, and the second half portion 313 of the base 31 is lowered and the first half portion 312 is lifted.

At this point, the rear wheel unit 70 which is in contact with the ground prevents the second half portion 313 of the base 31 from being excessively lowered, elastically supports the base 31 and enables the cleaner body 10 to be maintained in the stable state.

That is, both of the moving wheel 60 and the rear wheel unit 70 are in contact with the ground, and the cleaner body 10 is three-point supported. Also, the rear of the cleaner body 10 at which the center of gravity is located is in a lowered state and thus the cleaner body 10 may maintain the stable posture in the stopped state.

Therefore, the first half portion of the cleaner body 10 may be maintained at the set angle $\alpha$, regardless of presence or absence of the dust in the dust container 50 or the amount of the dust. In this state, the detecting part 306 may determine a posture of the cleaner body 10 through the angle thereof.

That is, the detecting part 306 confirms that the first half portion 312 is maintained at the set angle $\alpha$, determines that the cleaner body 10 is not moved and is maintained in the stopped state and thus allows the wheel motor 632 not to be driven and to be maintained in the stopped state.

Figure 49:
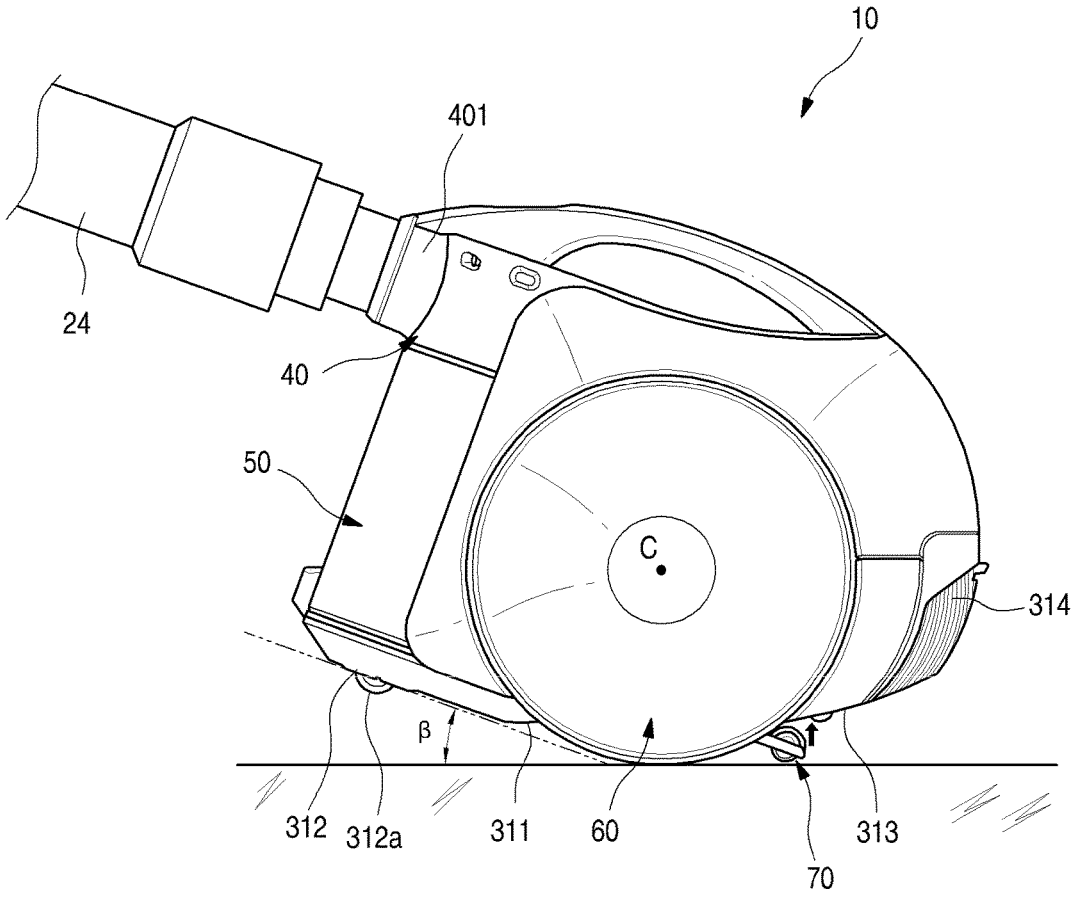
FIG. 49 is a view illustrating a travelling state of the cleaner body.

FIG. 49 is a view illustrating a travelling state of the cleaner body 10.

As illustrated in the drawing, when the user moves forward while gripping the handle 23 to perform the cleaning operation, the suction hose 24 connected to the handle 23 is pulled. And since the connector 401 connected to the suction hose 24 is located at the cover member 40, the force is applied to a place above the rotating center C of the moving wheel 60. Accordingly, the cleaner body 10 is rotated counterclockwise (in the reverse direction) by the rotating moment based on the rotating center C of the moving wheel 60.

An angle $\beta$ between the first half portion 312 and the ground may be changed according to a magnitude of the force applied to the connector 401 but is smaller than the set angle $\alpha$ in the stopped state of the cleaner body 10. And even when the force applied to the connector 401 becomes greater, the first half portion 312 is not in direct contact with the ground due to the front wheel 312*a*, and the front wheel 312*a* is in contact with the ground, and the vacuum cleaner 1 may be stably moved.

For example, while the cleaner body 10 is stabled travelled, the center portion 311 is in a horizontal state with the ground. And due to the counterclockwise movement of the cleaner body 10, the first half portion 312 forms an angle of 20° with respect to the ground, and the second half portion 313 forms an angle of 10°. In this state, the cleaner body 10 may be ideally travelled. However, the angle of the cleaner body 10 may be changed according to a user's momentary pulling force or a state of the ground.

The detecting part 306 detects the posture of the cleaner body 10 and determines the rotation of the moving wheel 60. When the angle $\beta$ between the first half portion 312 and the ground is smaller than the set angle $\alpha$, the detecting part 306 drives the wheel motor 632 and rotates the moving wheel 60 counterclockwise. Due to the rotation of the moving wheel 60, the cleaner body 10 may be travelled forward.

At this point, the detecting part 306 may immediately drive the wheel motor 632 at the moment when the detected angle becomes smaller than the set angle α. If necessary, the wheel motor 632 may be driven when a change value detected by the detecting part 306 exceeds a set range (e.g., 1° to 2°).

Meanwhile, since the detecting part 306 may detect a change in the angle β between the first half portion 312 and the ground, a rotating speed of the wheel motor assembly 63 may be controlled in proportion to the change in the angle. For example, when the angle β between the first half portion 312 and the ground becomes sharply smaller, a rotating speed of the wheel motor 632 also becomes faster, and thus the cleaner body 10 may be moved forward at a high speed. And when the angle β between the first half portion 312 and the ground becomes smaller relatively slowly, the rotating speed of the wheel motor 632 may relatively becomes slower.

When a distance from the user becomes closer due to forward movement of the cleaner body 10, the force applied to the connector 401 may become smaller or may be eliminated. When the force applied to the connector 401 is eliminated, the cleaner body 10 is rotated clockwise based on the rotating center of the moving wheel 60 and is in a state illustrated in FIG. 46. At this point, the detecting part 306 may confirm that the angle between the first half portion 312 and the ground is the set angle α and thus may stop the driving of the wheel motor assembly 63.

Therefore, when the user moves while gripping the handle 23 to use the vacuum cleaner 1, the force is applied to the connector 401, and the cleaner body 10 is moved forward. And when the cleaner body 10 is travelled forward and the distance from the user becomes closer, the force applied to the connector 401 becomes weaker. When the force applied to the connector 401 becomes weaker, the cleaner body 10 is stopped while being rotated clockwise due to the center of gravity.

Meanwhile, in a state in which the vacuum cleaner 1 is being travelled, when the angle between the bottom surface of the dust container 50 or the first half portion 312 and the ground (the floor surface) is less than the set angle (α<set angle<β), the driving of the wheel motor assembly 63 may be decelerated. That is, a predetermined speed is maintained until the set angle, and a deceleration thereof starts when the detected angle reaches the set angle, and the wheel motor assembly 63 is stopped when the detected angle is the set angle. Of course, a determination of the angle may be achieved based on the center portion 311 and the second half portion 313 rather than the first half portion 312.

When such a process is repeated, the cleaner body 10 follows the user according to the user's movement, and thus although the user does not perform a separate operation for moving the cleaner body 10, autonomous movement may be achieved.

Since the first half portion 312 is formed to be inclined, the cleaner body 10 may be effectively moved over the door sill or the obstacle when the door sill or the obstacle is located at the front thereof while being travelled. That is, even in a situation in which the obstacle is generated, the cleaner body 10 may be stably travelled and may be continuously moved over the obstacle.

And when it is necessary to move over an high obstacle or the user lifts the handle 23, the cleaner body 10 is rotated clockwise based on the center of the moving wheel 60, and thus the second half portion 313 may be moved toward the ground. At this point, the rear wheel unit 70 is in the contacting state with the ground and may prevent the second half portion 313 from being excessively lowered or overturned. And the rear wheel unit 70 elastically supports the second half portion 313 so that the cleaner body 10 is in the state illustrated in FIG. 46 when the external force is removed from the cleaner body 10.

Meanwhile, the cleaner body 10 may detect the obstacle O while being travelled. When the obstacle O is detected, the cleaner body 10 may be travelled while avoiding the obstacle by controlling the driving of the moving wheel 60.

Figure 50:
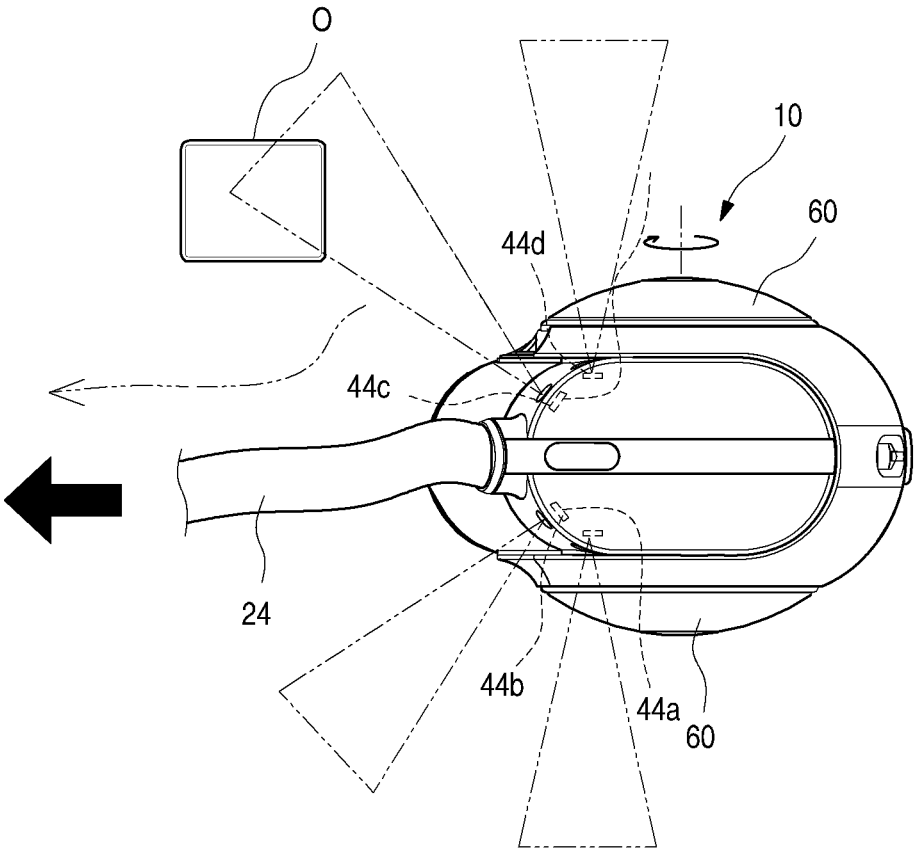
FIG. 50 is a view illustrating an obstacle avoidance travelling state of the cleaner body.

FIG. 50 is a view illustrating an obstacle avoidance travelling state of the cleaner body.

As illustrated in the drawing, when the cleaner body is being travelled or starts the travelling from the stopped state, the obstacle O may be detected by the obstacle detecting member 44. The plurality of obstacle detecting members 44 are provided at the front surface of the cover member 40 formed in the curved surface shape. After the obstacle detecting member 44 detects the obstacle O located within a set angular range, an obstacle avoidance travelling is performed.

For example, as illustrated in the drawing, when the obstacle O is detected by the front sensor 44*c* of the obstacle detecting member 44 while the cleaner body 10 is travelled, a location of the obstacle O is calculated by the main PCB 301 or the detection PCB 360*a*.

And when the position of the obstacle O is calculated, the main PCB 301 may allow one of the moving wheels 60 located at both of the left and right sides, which is closer to the obstacle O, to be rotated faster, thereby changing a travelling direction of the cleaner body 10 to avoid the obstacle O.

At this point, the main PCB 301 may drive only one of the wheel motors 632 located at both sides and may also avoid the obstacle O by differing a rotating speed of each of the wheel motors 632 from each other or differing a rotating direction thereof.

And the rotating speed of each of the wheel motors 632 may be deferred according to a distance from the obstacle detected by the obstacle detecting member 44. That is, when the obstacle O is detected from a long distance, the rotating speed of the wheel motors 632 may become relatively slower, and when the obstacle O is detected from a short distance, the rotating speed of the wheel motors 632 may become relatively faster.

As described above, even when the separate operation for avoiding the obstacle O is not performed, it is possible to travel while actively avoiding the obstacle O by the obstacle detecting member 44.

In the embodiment of the present invention, the forward travelling of the cleaner body 10 has been described. However, since the second half portion 313 also has an inclined state, the cleaner body 10 may be automatically moved backward according to a change in an angle of the second half portion 313.

Figure 51:
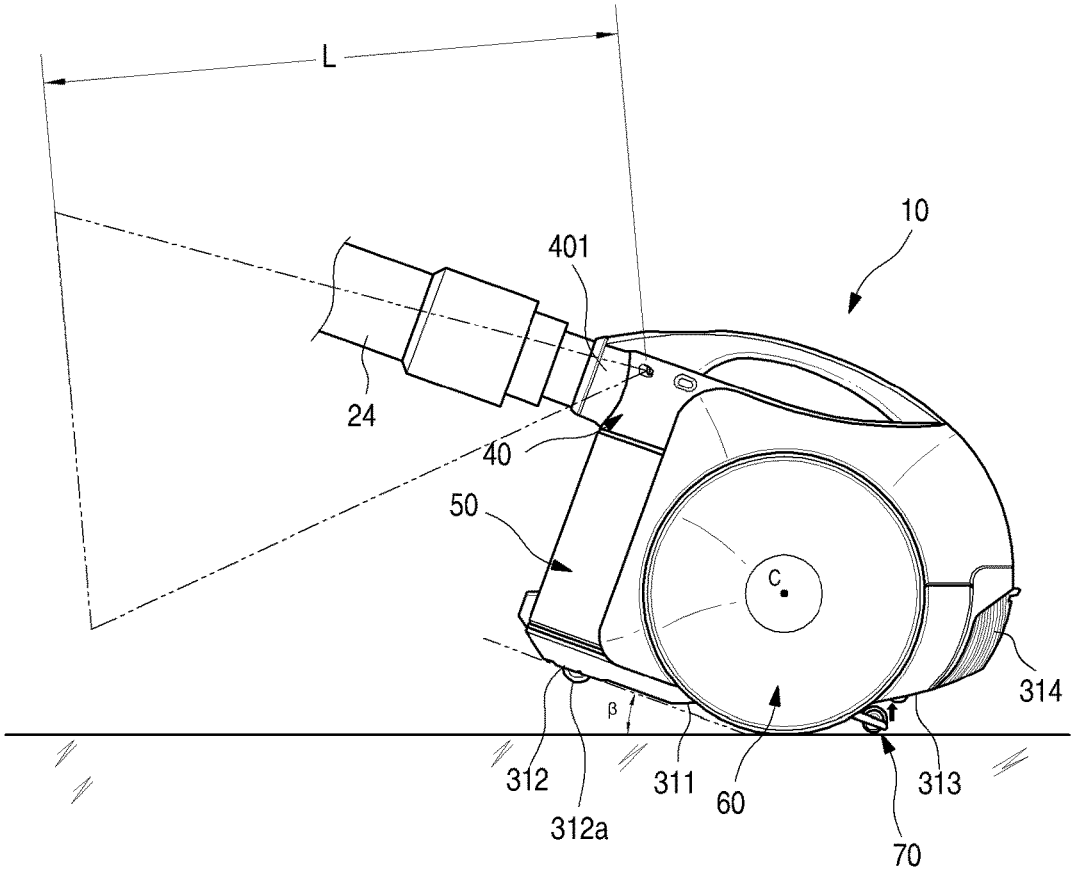
FIG. 51 is a view illustrating a detection range of the obstacle detecting member.

FIG. 51 is a view illustrating a detection range of the obstacle detecting member.

As illustrated in the drawing, the obstacle detecting member 44 detects the obstacle located within a set detection distance L. For example, the obstacle detecting member 44 may have a detection distance of about 650 mm.

At this point, the detection distance L of the obstacle detecting member 44 may be set to a distance at which the ground is not detected when the cleaner body 10 is rotated counterclockwise and the front wheel 312*a* is in contact with the ground.

When the detection distance L is too long, there is a problem that the ground may be recognized as the obstacle when the first half portion 312 of the cleaner body 10 is rotated counterclockwise. On the contrary to this, when the detection distance L is too short, avoidance movement should be performed very rapidly after the obstacle located at the front of the cleaner body 10 is detected, and thus user inconvenience may occur, and even when the avoidance movement is performed, the obstacle may not be avoided completely.

Therefore, the obstacle detecting member 44 may have the set distance L at which the ground is not detected when the cleaner body 10 is rotated and the travelling may be performed while effectively avoiding the obstacle.

Meanwhile, since the obstacle detecting member 44 is disposed at the front surface of the cover member 40 which is the uppermost end of the cleaner body 10, an emission angle of the obstacle detecting member 44 may be set so that the ground may not be detected even when an angle of the cleaner body 10 is changed and the obstacle may be effectively detected.

For example, when the obstacle detecting member 44 is provided at a lower surface of the cleaner body 10 or a low position, the light emitted from the obstacle detecting member 44 cannot help being directed to the ground, and an detection error may be generated due to a detection of the ground. In particular, due to a characteristic of the cleaner body 10 which is rotated, it is important to select a position at which the obstacle is distinguished while the ground is not detected.

Figure 52:
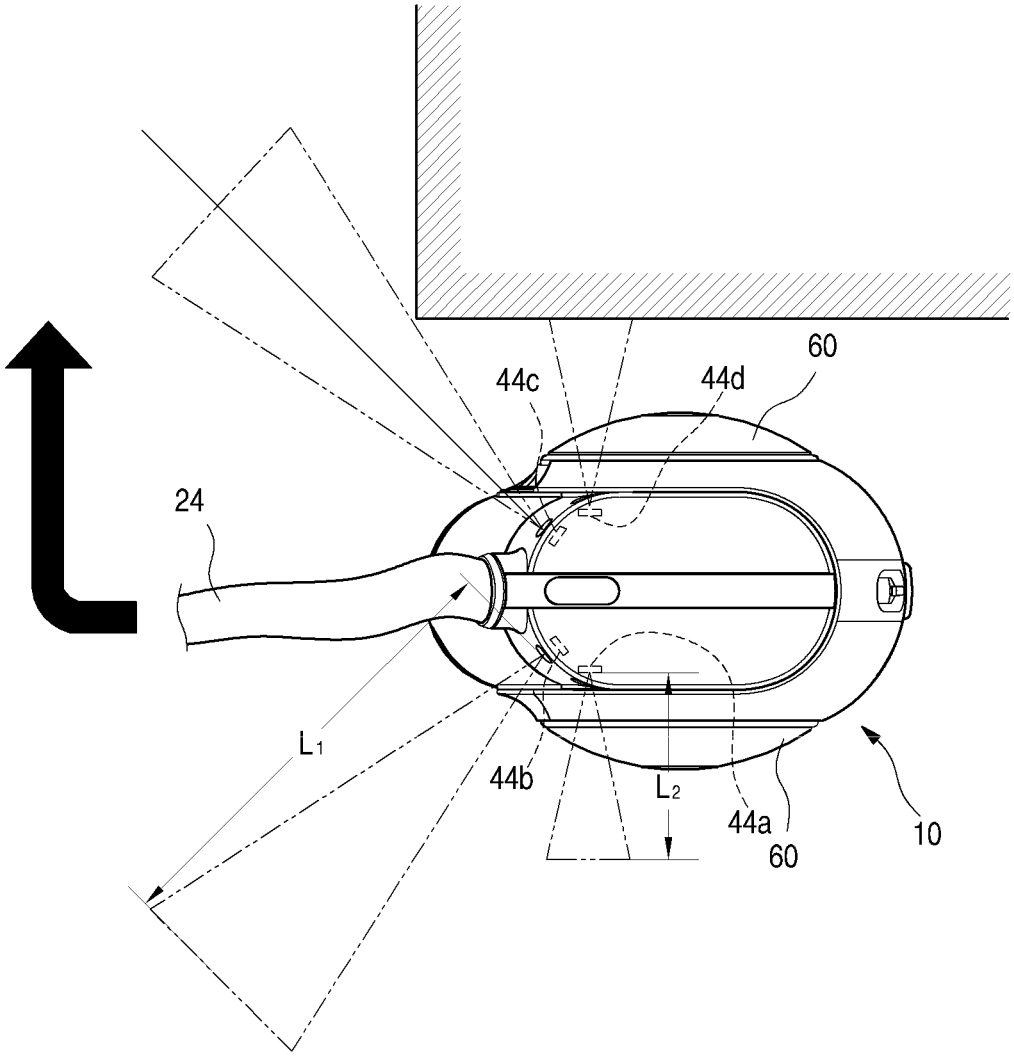
FIG. 52 is a view illustrating a wall surface travelling state of the cleaner body.

FIG. 52 is a view illustrating a wall surface travelling state of the cleaner body 10.

As illustrated in the drawing, the cleaner body 10 may be moved along a wall surface of a room or furniture to perform the cleaning operation. When the cleaner body 10 is moved along the wall surface, the cleaner body 10 should recognize the wall surface, should be travelled along the wall surface without avoidance of the wall surface and then should be rotated after completely escaping from the corner.

To this end, the obstacle detecting member 44 may be set so that the front sensors 44*b* and 44*c* and the side sensors 44*a* and 44*d* have different detection distances L1 and L2 from each other. The detection distance L1 of the front sensors 44*b* and 44*c* may be set longer than that L2 of the side sensors 44*a* and 44*d*. For example, when each of the front sensors 44*b* and 44*c* has a detection distance L1 of about 650 mm, each of the side sensors 44*a* and 44*d* may be set to have a detection distance L2 of about 300 mm.

When the detection distance L2 of each of the side sensors 44*a* and 44*d* is the same as or longer than that L1 of each of the front sensors 44*b* and 44*c*, the wall surface is too distant due to the detection distance L2 of each of the side sensors 44*a* and 44*d*, and the front sensors 44*b* and 44*c* may not detect the wall surface. Eventually, a situation in which all of the front sensors 44*b* and 44*c* and the side sensors 44*a* and 44*d* may not detect occurs, and thus the wall surface may not be recognized. Therefore, when the detection distance L2 of each of the side sensors 44*a* and 44*d* is shorter so that the cleaner body 10 is located closer to the wall surface, the front sensors 44*b* and 44*c* and the side sensors 44*a* and 44*d* may simultaneously recognize the wall surface.

Meanwhile, when the front sensors 44*b* and 44*c* and the side sensors 44*a* and 44*d* simultaneously recognize the obstacle while the cleaner body 10 is travelled, the obstacle may be regarded as the wall surface, and thus the cleaner body 10 may be travelled along the wall surface without the avoidance movement. That is, the travelling is performed while a state in which the front sensors 44*b* and 44*c* and the side sensors 44*a* and 44*d* detect the wall surface is maintained.

When the cleaner body 10 is continuously travelled along the wall surface and then absence of the obstacle is determined by the front sensors 44*b* and 44*c* and the absence of the obstacle is also determined by the side sensors 44*a* and 44*d*, it is determined that the cleaner body 10 has passed a corner of the wall surface, and the cleaner body 10 may be travelled in a direction of the corner.

At this point, after the absence of the obstacle is also determined by the side sensors 44*a* and 44*d*, the cleaner body 10 may be moved forward further by a set distance and then may be rotated. That is, the cleaner body 10 may be rotated after completely passing the corner, and thus a rear portion of the cleaner body 10 may be prevented from colliding with the wall surface.

The present invention may have various other embodiments in addition to the above-described embodiment.

The remaining configuration of another embodiment of the present invention except a part thereof will be the same as that of the above-described embodiment, and like terms refer to like or corresponding elements and repeated description thereof will be omitted.

Figure 53:
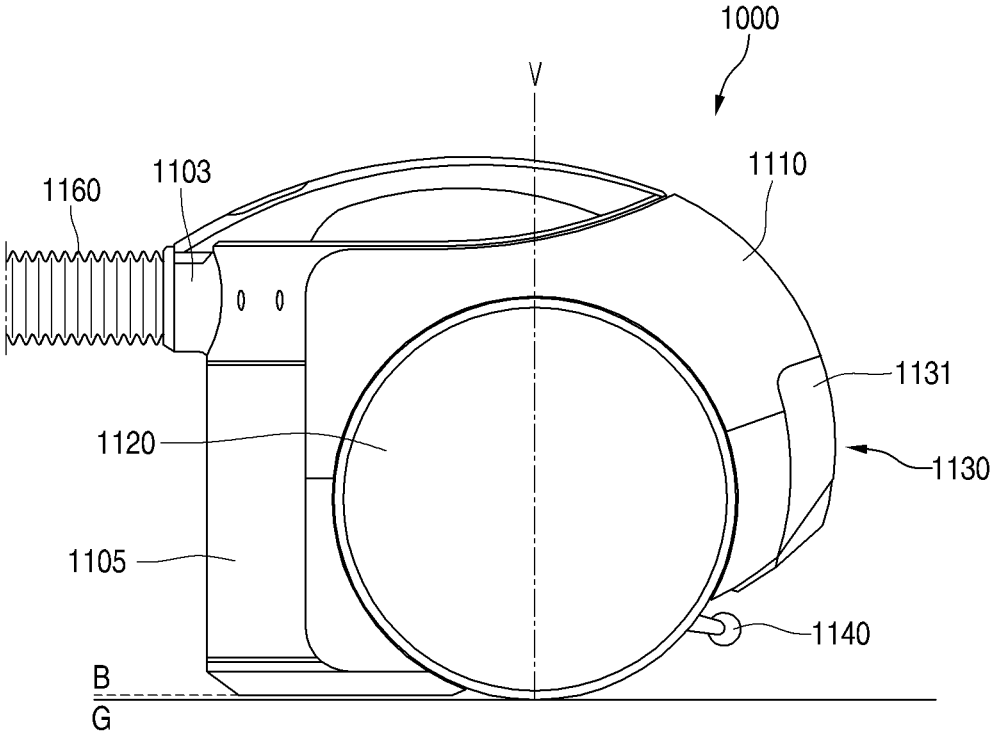
FIG. 53 is a view illustrating a state in which a body part of the cleaner body according to another embodiment of the present invention is inclined forward.

FIG. 53 is a view illustrating a state in which a body part of the cleaner body according to another embodiment of the present invention is inclined forward. And FIG. 54 is a view illustrating a state in which the body part is inclined backward. And FIG. 55 is a view illustrating a configuration of a support part according to another embodiment of the present invention.

Figure 55:
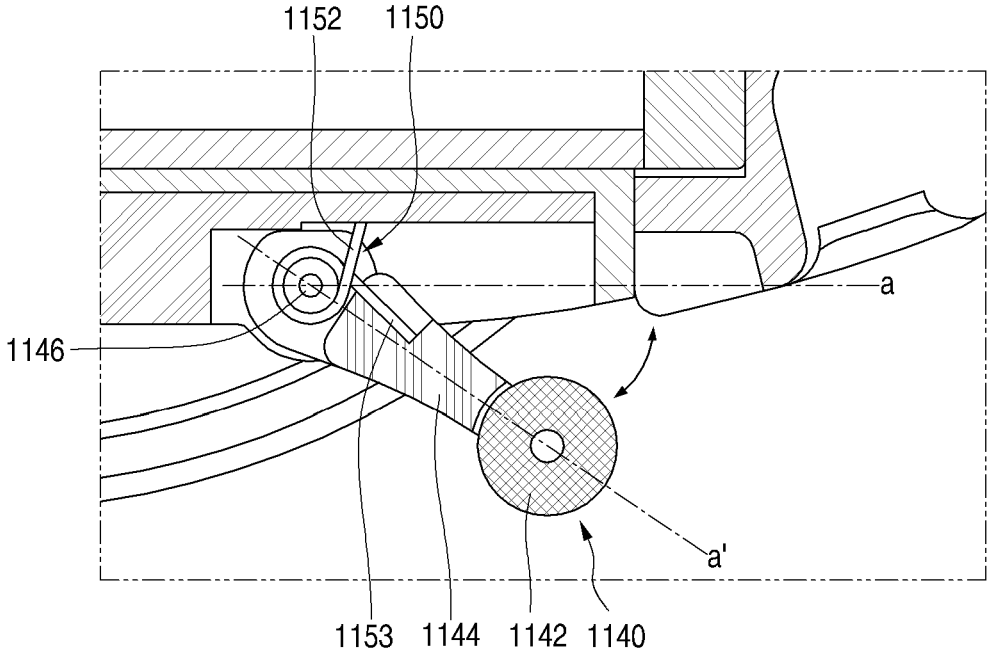
FIG. 55 is a view illustrating a configuration of a support part according to another embodiment of the present invention.

Referring to FIGS. 53 to 55, a cleaner body 1000 includes a body part 1110, a moving wheel 1120 and a battery 1130.

A dust container 1105 in which the dust suctioned through a suction unit 1160 is stored may be provided at the body part 1110. A pair of moving wheels 1120 may be coupled to both sides of the body part 1110, respectively. The battery 1130 may be separably coupled to the body part 1110.

A portion of the cleaner body 1000 in which a connector 1103 is arranged based on a straightly extending line V passing through a rotating center of the moving wheel 1120 may be defined as a front, and a portion thereof in which the battery 1130 is arranged may be defined as a rear. Also, the case in which the body part 1110 is rotated forward is a case in which the body part 1110 is rotated counterclockwise on the drawing (referring to FIG. 53), and the case in which the body part 1110 is rotated backward is a case in which the body part 1110 is rotated clockwise (referring to FIG. 54).

The cleaner body 1000 may further include a driving part for driving the moving wheels 1120. And the cleaner body 1000 may control driving of the moving wheels 1120 by a control part according to detecting information of a detecting part for detecting movement of the cleaner body 1000.

When the detecting part is in an OFF state, the moving wheels 1120 may not be driven. In this case, the body part 1110 is inclined according to a position of a center of gravity. For example, when the center of gravity of the body part 1110 is located at a front of the straightly extending line V passing through the rotating center of the moving wheel 1120, the body part 1110 is inclined forward, as illustrated in FIG. 53, and when the center of gravity of the body part 1110 is located at a rear of the straightly extending line V, the body part 1110 is inclined backward, as illustrated in FIG. 54.

When the detecting part is turned on, the control part may control the driving of the moving wheels 1120 so that the center of gravity of the body part 1110 is located on the straightly extending line V passing through the rotating center of the moving wheel 1120. In this case, a lower surface B of the body part 1110 may also be spaced apart from a floor surface G, as illustrated in FIG. 54.

The cleaner body 1000 may further include a rear wheel unit 1140. The rear wheel unit 1140 may be disposed at a rear of the lower surface of the body part 1110 and may serve to restrict an angle at which the body part 1110 is inclined backward.

The rear wheel unit 1140 may further include an extending portion 1144. An auxiliary wheel 1142 may be rotatably connected to one side of the extending portion 1144. The other side of the extending portion 1144 may be rotatably connected to the body part 1110 by a rotating shaft 1146. And the extending portion 1144 may be rotated upward or downward within a range a-a'.

The rear wheel unit 1140 may further include an elastic member 1150. For example, the elastic member 1150 may be a torsion spring. One end 1152 of the elastic member 1150 may be supported by the body part 1110, and the other end 1153 thereof may be supported by the extending portion 1144. The elastic member 1150 may apply an elastic force so that the extending portion 1144 is rotated clockwise on the drawing.

When the body part 1110 is maximally inclined forward, a front portion of the lower surface B of the body part 1110 may be in contact with the floor surface G. Thus, a maximum forward rotation angle of the body part 1110 may be restricted.

On the other hand, when the body part 1110 is inclined backward, the rear wheel unit 1140 may be in contact with the floor surface G. Accordingly, a maximum backward rotation angle of the body part 1110 may be restricted. Therefore, the body part 1110 may be prevented from being overturned forward or backward.

The lower surface B of the body part 1110 may form a predetermined angle θ with respect to the floor surface G when the body part 1110 is maximally inclined backward. At this point, the angle θ between the lower surface B of the body part 1110 and the floor surface G may be about 17° to 20°.

A cover 1131 may be provided at the battery 1130. While the battery 1130 is installed at the body part 1110, the cover 1131 may be exposed to an outside. Therefore, the cover 1131 may form at least a part of an exterior of the body part 1110. Also, the user may separate or couple the battery 1130 from/to the body part 1110 without disassembling the body part 1110.

Hereinafter, a process in which the battery 1130 is installed or separated at/from the body part 1110 will be described in detail. However, the following descriptions are limited to the cases in which the center of gravity of the body part 1110 is located at the front when the battery 1130 is separated from the body part 1110 and the center of gravity of the body part 1110 is located at the rear when the battery 1130 is coupled to the body part 1110.

Figure 56:
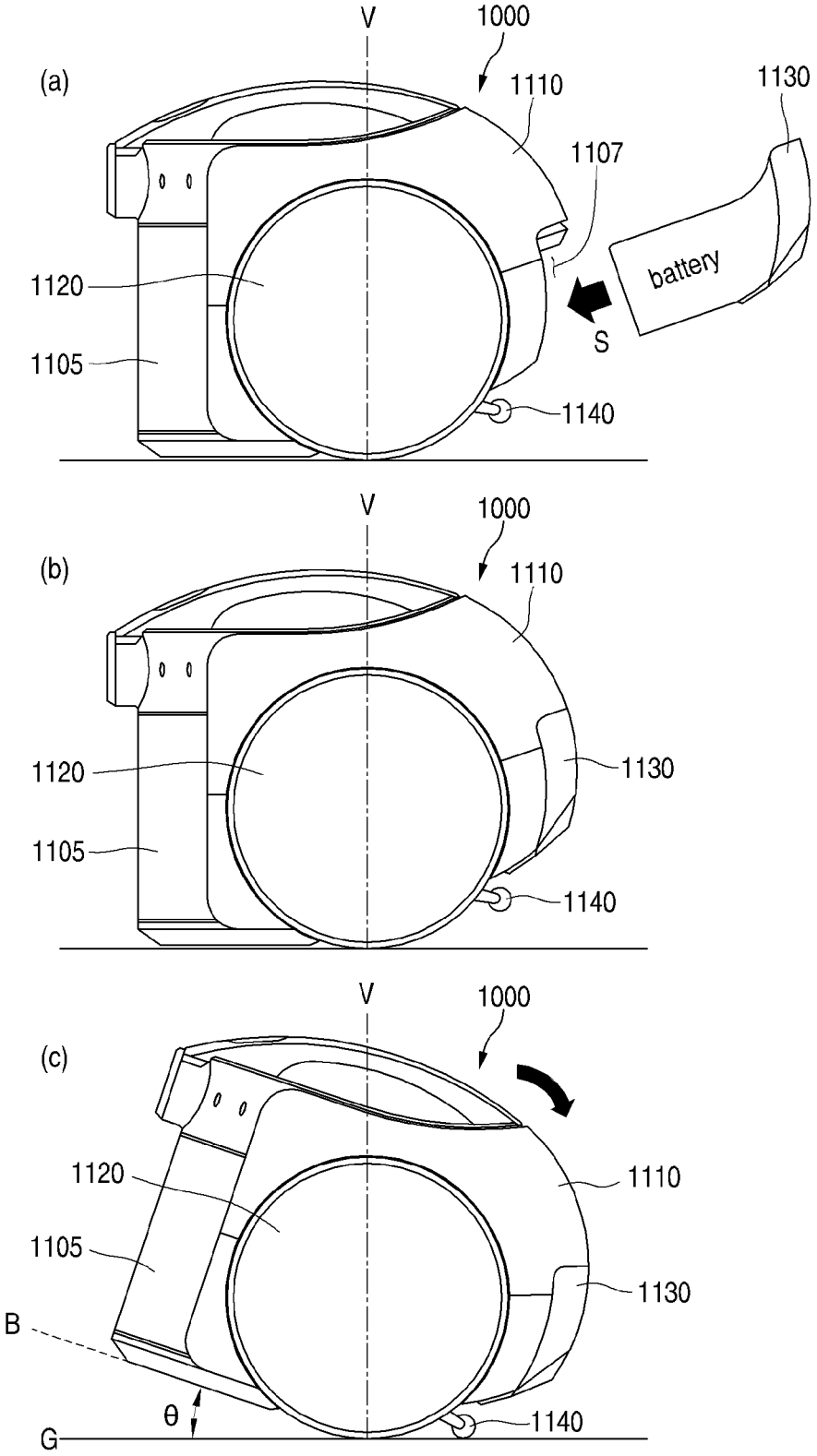
FIG. 56 is a view sequentially illustrating a process in which a battery is coupled to the cleaner body.

FIG. 56 is a view sequentially illustrating a process in which the battery is coupled to the cleaner body.

FIG. 56A is a view illustrating a state in which the battery 1130 is separated from the body part 1110, and FIG. 56B is a view illustrating a state in which the battery 1130 is coupled to the body part 1110, and FIG. 56C is a view illustrating a state in which the body part 1110 is inclined backward.

A battery coupling portion 1107 to which the battery 1130 is coupled is formed at the body part 1110. The battery coupling portion 1107 may be formed by recessing a part of body part 1110.

The battery coupling portion 1107 is formed at a lower side of the body part 1110, and thus the battery 1130 is coupled to the lower side of the body part 1110. For example, while the battery 1130 is installed at the body part 1110, the center of gravity of the battery 1130 may be located at a lower side further than the rotating center of the moving wheel 1120.

Therefore, since the center of gravity of the battery 1130 may be moved downward when the battery 1130 is coupled to the body part 1110, travel stability of the cleaner body 1000 may be enhanced.

When the battery 1130 is coupled to the lower side of the body part 1110, there is an advantage that the travel stability of the cleaner body 1000 is enhanced. However, since the battery 1130 should be coupled to the lower side of the body part 1110, it may be inconvenient for the user to couple the battery 1130.

However, while the battery 1130 is separated from the body part 1110, the center of gravity of the body part 1110 may be located at a front of the straightly extending line passing through the center of the moving wheel 1120. Therefore, when the battery 1130 is separated from the body part 1110, the body part 1110 may be inclined forward about the moving wheel 1120.

As the body part 1110 is inclined forward, the front portion of the lower surface of the body part 1110 comes in contact with the floor surface. At this point, the battery coupling portion 1107 is obliquely directed upward. Therefore, the user may easily couple the battery 1130.

The battery 1130 may be coupled in an oblique direction with respect to the body part 1110 by a coupling guide portion provided at the battery coupling portion 1107. Specifically, an insertion direction S of the battery 1130 may form an acute angle with respect to each of the straightly extending line V and floor surface. Therefore, when the front portion of the lower surface of the body part 1110 is in contact with the floor surface, the insertion direction S of the battery 1130 forms the acute angle with respect to the floor surface.

When the battery 1130 is coupled to the body part 1110, the center of gravity of the body part 1110 may be moved backward. That is, while the battery 1130 is coupled to the body part 1110, the center of gravity of the body part 1110 may be located at the rear of the straightly extending line passing through the center of the moving wheel 1120.

In other words, when the battery 1130 is coupled to the body part 1110, the body part 1110 may be inclined backward about the moving wheels 1120. At this point, the rear wheel unit 1140 is selectively in contact with the floor surface. At this point, the lower surface B of the body part 1110 forms a predetermined angle θ with respect to the floor surface G.

Figure 57:
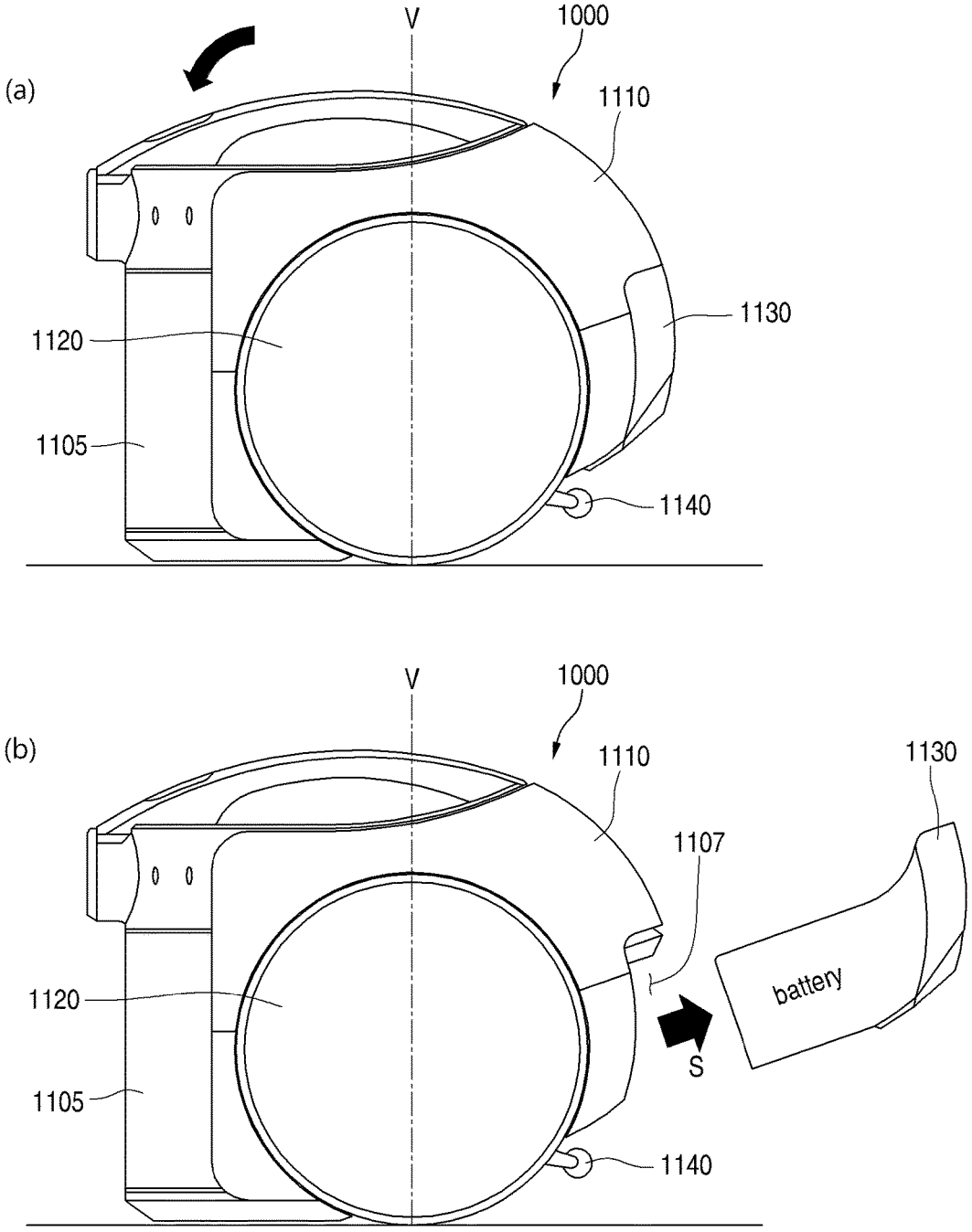
FIG. 57 is a view sequentially illustrating a process in which a battery is separated from the cleaner body.

FIG. 57 is a view sequentially illustrating a process in which the battery is separated from the cleaner body.

Specifically, FIG. 57A illustrates a state before the battery 1130 is separated from the body part 1110, and FIG. 57B illustrates a state in which the battery 1130 is separated from the body part 1110.

To separate the battery 1130 from the body part 1110, the user may directly apply a force to the body part 1110 and may tilt forward the body part 1110. Then, the user may separate the battery 1130 in a direction opposite to the insertion direction S.

When the battery 1130 is separated from the body part 1110, the center of gravity of the body part 1110 is moved forward again. Therefore, the body part 1110 may be maintained in a forwardly inclined state.

As described above, in the vacuum cleaner of the present invention, while the battery 1130 is installed at the body part 1110, the body part 1110 may be rotated backward and thus the lower surface of the body part 1110 may be spaced apart from the floor surface. That is, the body part 1110 may be two-point supported by the moving wheels 1120 when travelling. In this case, the cleaner body 1000 may more easily climb over an obstacle, and since travel friction acting on the moving wheels 1120 may be reduced, a labor force required when the user moves the cleaner body 1000 may also be reduced.

When the battery 1130 is separated from the body part 1110, the center of gravity of the body part 1110 is moved forward, and the body part 1110 is rotated forward, and thus the battery coupling portion 1107 provided at a rear lower side of the body part 1110 is moved up. Accordingly, the user may easily couple the battery 1130 to the battery coupling portion 1107.

The vacuum cleaner according to the embodiment of the present invention is characterized by including a cleaner body; a moving wheel provided at the cleaner body and configured to rotatably support the cleaner body; a wheel motor assembly provided at cleaner body and configured to rotate the moving wheel; a suction hose configured to connect a suction part for suctioning dust with the cleaner body; a suction unit in which the suction hose is connected to the cleaner body at a position spaced apart from a rotating center of the moving wheel; a detecting part provided inside the cleaner body and configured to detect a slope of the cleaner body; and a PCB configured to drive the wheel motor assembly when the slope of the cleaner body detected by the detecting part is deviated from a set angle, wherein a center of gravity of the cleaner body is located at an opposite side to a connection position of the suction hose based on the rotating center of the moving wheel.

The cleaner body may include a base configured to form a bottom of the cleaner body, and the base may include a first half portion located at a front side further than the rotating center of the moving wheel and formed to be inclined, thereby being gradually spaced apart from the ground toward a front side thereof.

A front wheel which is selectively in contact with the ground according to rotation of the cleaner body may be installed at the first half portion.

The base may include a second half portion located at the front side further than the rotating center of the moving wheel and formed to be inclined, thereby being gradually spaced apart from the ground toward the front side thereof.

A rear wheel unit which is selectively in contact with the ground according to rotation of the cleaner body may be installed at the second half portion.

The rear wheel unit may include a leg installed at the base to be rotatable; a rear wheel installed at an extending end of the leg to be rotatable; and an elastic portion configured to extend from one side of the rear wheel to be inclined or to have a curvature and formed so that an extending end thereof is in contact with a lower surface of the base and elastically deformed according to rotation of the leg.

A battery unit configured to supply electric power for driving the cleaner may be provided at the cleaner body, and the battery unit may be disposed at a rear side further than the rotating center of the moving wheel.

A main motor for supplying a suction force is provided at the cleaner body, and the main body may be disposed at a rear side further than the rotating center of the moving wheel.

The detecting part may include a gyro sensor.

The vacuum cleaner may include an obstacle detecting member provided at a front surface of the cleaner body and configured to detect an obstacle located at a front thereof.

The obstacle detecting member may include a laser sensor.

A plurality of obstacle detecting members may be disposed on the same extension line and may also be disposed to be directed in different directions from each other.

The cleaner body may include a body part at which a dust container for storing suctioned dust separated from air is installed; and a cover member provided at the body part to be openable and closeable and configured to selectively shield an upper surface of the dust container, and the obstacle detecting member may be provided at a rounded front surface of the cover member.

One pair of moving wheels may be provided at both sides of the body part, and the wheel motor assembly may be connected to each of the pair of moving wheels to independently drive the moving wheels.

The PCB may drive one of the wheel motor assemblies when the obstacle detecting member detects the obstacle.

The PCB may control the wheel motor assemblies to have different rotating speeds from each other when the obstacle detecting member detects the obstacle.

The PCB may control the wheel motor assemblies to be rotated in opposite directions to each other when the obstacle detecting member detects the obstacle.

A base frame for dividing an internal space of the body part into a front portion and a rear portion may be installed inside the body part, and the dust container for collecting the dust may be installed at a front of the base frame.

The base frame may include a lower frame at which a battery unit configured to supply the electric power for driving the cleaner is installed; and an upper frame installed at an upper end of the lower frame and configured to form a space in which the main motor for providing the suction force is accommodated.

One pair of first side walls may be provided at the upper frame, and the main motor may be disposed between the pair of first side walls so that an air suctioning and discharging operation of the main motor is performed in forward and backward directions.

A sub-motor for assisting a dust suctioning operation may be provided at the suction part, and a sub-PCB for driving the sub-motor may be provided at an outer surface of the first side wall.

The main motor may be disposed to be leaned to one of the pair of first side walls, and a plate hole for discharging the air may be formed at a bottom surface of the side upper frame.

A barrier hole through which the air introduced through the plate hole passes may be formed at a front surface of the lower frame, and the PCB may be installed at a front surface of the barrier hole, and a noise filter for removing noise of the supplied electric power may be provided at a rear surface thereof.

A rear opening which is in communication with a space of the lower frame may be formed at a rear surface of the cleaner body, and a rear cover for opening and closing the rear opening may be provided at the cleaner body.

The lower frame may be disposed to be spaced, thereby providing a space in which the battery unit is installed and may include one pair of second side walls for guiding an inserting and withdrawing operation of the battery unit, and a battery restricting groove restricted by the second side wall may be formed at both side surfaces of the battery unit.

A battery restricting portion which protrudes to be insertable into the battery restricting groove may be formed at one of the pair of second side walls, and a battery restricting member which is separately molded to be insertable into the battery restricting groove may be installed at the other one thereof.

The vacuum cleaner may further include the dust container seated in the cleaner body and configured to collect the suctioned dust, and the dust container may include a transparent case formed in a cylindrical shape and configured to separate and store the dust in the suctioned air; an upper cover configured to form the upper surface of the dust container and having a suction port and a discharge port; and a lower cover configured to open and close an opened lower surface of the dust container.

The lower cover may include a lower cover shaft coupled to a lower end of the transparent case to be rotatable; and a lower hook provided at a position corresponding to the lower cover shaft to be caught and restricted by a case catching portion formed at a lower end of the transparent case such that the lower cover is maintained in a closed state.

A lower locker installing portion disposed at lower and upper sides of the transparent case and a lower locker installed at the lower locker installing portion to be movable up and down and configured to push the lower hook when being moved down and thus to release the coupling with the case catching portion may be included.

An upper surface of the hook and a lower end of the lower locker which is in contact with the upper surface of the hook may be formed to be inclined.

The vacuum cleaner may further include an inner case formed in a cylindrical shape and provided inside the dust container, and the inner case may form a first dust collecting space between the inner case and the dust container and a second dust collecting space inside the inner case to collect the dust.

The vacuum cleaner may further include a compression motor assembly provided at one side of the cleaner body in which the dust container is installed; a transmission gear provided at the lower cover and connected to the compression motor assembly when the dust container is installed; and a dust compressing unit provided at the inner case and coupled to the transmission gear to be rotated and thus to compress the dust in the first dust collecting space.

The transmission gear may include a first transmission gear provided at a lower surface of the lower cover and connected to the compression motor assembly and a second transmission gear coupled to a rotating shaft of the first transmission gear and provided at an upper surface of the lower cover to be connected to the dust compressing unit, and a bearing through which the rotating shaft of the first transmission gear passes and coupled may be provided at the lower cover.

A gasket plate seated on an upper surface of the second transmission gear, an inner gasket installed and fixed to the gasket plate to seal an opened lower surface of the inner cover and a shaft coupling member passing through the gasket plate and fastened to the second transmission gear so that the gasket plate is installed to be independently rotated may be provided.

The inner gasket may include a first sealing portion which is formed in a circular plate shape to be in contact with an opened lower end of the inner case and a second sealing portion which is provided above the first sealing portion and is in contact with an inner surface of the inner case.

The upper cover may be separably installed at an opened upper surface of the transparent case and may have a protruding upper protrusion and a recessed upper groove which are respectively formed at an inner upper end of the transparent cover and the upper cover to be coupled to each other, and an upper locker for restricting one end of the upper cover may be provided at an upper end of the transparent case facing the upper groove.

An upper locker installing portion may be formed at an outer surface of the transparent case, and the upper locker may be rotatably installed at the upper locker installing portion to extend higher than the upper end of the transparent case, thereby being selectively caught and restricted by the upper cover.

The cleaner body may include a body part in which the dust container for separating and storing the dust in the suctioned air is separably installed; and a cover member installed at the body part to be rotatable and configured to selectively shield an upper portion of the dust container.

A connector which is connected to the suction unit and is in communication with the suction port of the dust container while the cover member is closed may be provided at the cover member.

A locking assembly which selectively protrudes in both lateral directions by a user's operation and is restricted by the body part may be provided at the cover member.

The locking assembly may include a push member which is pushably installed at an outer surface of a grip portion formed at the cover member to be gripped by the user; a transmission member which is moved up and down to transmit a push operation of the push member; one pair of main links which are in contact with the transmission member and rotated by the transmission member; and a sub-link which is connected to the main link to linearly reciprocate and of which an end is inserted into or withdrawn from the cover member to be caught and restricted by the body part.

The main link may include a through portion rotatably shaft-coupled from both sides of the transmission member; a first extending portion configured to extend from the through portion toward the transmission member and having an inclined surface which is in contact with an inclined lower end of the transmission member; and a second extending portion configured to extend in a direction perpendicular to the first extending portion and to which the sub-link is shaft-coupled.

A link guide which accommodates the sub-link and guides movement of the sub-link may be formed at the cover member, and an entrance through which an end of the sub-link is inserted and withdrawn may be opened at a side surface of the cover member corresponding to the link guide.

A link assembly which connects the cover member with the body part to allow the cover member to be maintained in an opened state may be provided between the cover member and the body part.

A cover member coupling portion which extends to be rotatable together with the body part may be formed at an end of the cover member, and one end of the link assembly may be rotatably installed at the cover member coupling portion, and the other end thereof may be slidably installed at the body part.

The link assembly may include a rotating link on which one end is rotatably installed at the cover member; a slider rotatably installed at the other end of the rotating link and accommodated at one side of the body part to linearly reciprocate when the cover member is opened and closed; and an elastic member provided between the cover member and the slider to elastically support the slider.

A link assembly accommodating portion which is opened in a rotating shaft direction of the cover member and accommodates at least a part of the slider and the rotating link may be formed at the body part.

A slider guide which is in contact with both side surfaces of the slider to guide a linearly reciprocating motion of the slider may be formed at the link assembly accommodating portion.

One pair of supporting portions which are spaced apart from each other may be formed at the rotating link, and the pair of supporting portions may include slider fixing portions configured to protrude in directions facing each other to be rotatably coupled to the slider; a supporting protrusion configured to protrude outward to be caught and restricted by an interference protrusion protruding from the link assembly accommodating portion; and a supporting slit cut from an end of the supporting portion to a space between the slider fixing portion and the supporting protrusion and configured to provide elasticity of the supporting protrusion.

The interference protrusion may be formed at a position which interferes with the supporting protrusion while the cover member is opened at a set angle, may support the supporting protrusion and thus may restrict rotation of the cover member.

A holder by which a protrusion formed at one side of the suction unit is caught and restricted and the suction unit is supported may be provided at the cleaner body, and the holder may be formed of a metallic material and then may be coupled to the cleaner body.

According to the vacuum cleaner according to the embodiment of the present invention, the following effects can be expected.

In the vacuum cleaner according to the embodiment of the present invention, the display which can display the state of the vacuum cleaner is provided at the cover member provided at the upper surface of the cleaner body to allow the user to check a variety of information about the operating state of the vacuum cleaner, thereby enhancing user convenience.

In particular, since the display is formed to display the residual value and the charging state of the battery provided in the cleaner body, the user can check the state of the battery through the display and can perform the cleaning operation or the charging operation, and thus the user convenience can be further enhanced.

And the cover member is rotatably installed at the cleaner body, and the display cable connected to the display can be guided inside the cleaner body through the cover member coupling portion for the rotation of the cover member. Therefore, the display cable can be prevented from being exposed, and thus the exterior thereof can be enhanced, and also the display cable can be prevented from being disconnected even when the cover member is repeatedly opened and closed.

And one pair of the cover member coupling portions are provided at both sides so that the detecting member cable and the display cable can be independently guided into the body part. Also, the cables can be guided in a simple arrangement while being not exposed.

And since the center of gravity of the cleaner body is located at the second half portion, the cleaner body can be rotated about the moving wheels and can also can be maintained in the stably supported state by being in contact with the ground while the vacuum cleaner is in the stopped state.

And since the center of gravity is located at the second half portion, the cleaner body can be rotated to be in the inclined state when the travel of the vacuum cleaner is stopped and can also be rotated when the cleaner body travels so that the change of the angle thereof occurs and the stopped or travelling state of the vacuum cleaner can be exactly determined.

In the vacuum cleaner according to the embodiment of the present invention, since the center of gravity of the cleaner body is located at the second half portion, the cleaner body can be rotated about the moving wheel and can be maintained in the stably supported state by being in contact with the ground.

And since the center of gravity is located at the second half portion, when the travelling of the vacuum cleaner is stopped, the cleaner body can be rotated and then can be in the inclined state, and when the cleaner body is travelled, the change in the angle thereof occurs by the rotation, and thus the stopped or moving state of the vacuum cleaner can be accurately determined.

Also, the detecting part for detecting the posture of the cleaner body, i.e., the slope or the rotating angle thereof is provided inside the cleaner body. And since the vacuum cleaner has a structure in which the suction hose is connected to the upper portion of the cleaner body, the cleaner body is inclined when the user pulls the suction hose to move the vacuum cleaner, and the moving wheel is driven by the detecting part which detects the situation.

Therefore, although the user does not pull the cleaner body itself to move the cleaner body, the cleaner body can be automatically travelled by an simple operation such as moving of the suction hose, and the cleaner body can be travelled following the user when the user moves, and thus user convenience can be enhanced.

Particularly, since the cleaner body can be stopped while the slope of the cleaner body is maintained always constantly, regardless of presence and absence of the dust or the amount of the dust, reliability of the detecting part in detecting the slope can be enhanced.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or comprises or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

What is claimed is:

1. A vacuum cleaner comprising:

a cleaner body;

a base that defines a lower surface of the cleaner body;

wheels provided at both side surfaces of the cleaner body, the wheels being configured to allow the vacuum cleaner to travel on ground and to allow the cleaner body to rotate about the wheels in forward and reverse directions;

a detecting part configured to detect an inclination of the cleaner body;

a wheel motor assembly that is located inside the cleaner body and that is connected to the wheels and configured to rotate the wheels;

a main motor configured to generate suction force and located inside the cleaner body, the main motor being positioned rearward of a rotating shaft of the wheels;

a battery configured to provide electric power for driving the main motor and the wheel motor assembly, the battery being positioned rearward of the rotating shaft of the wheels; and a PCB configured to cause the wheel motor assembly to be driven according to the inclination of the cleaner body detected by the detecting part, wherein the base includes:

a center portion, a first half portion that is inclined upward in a forward direction from a front end of the center portion, and a second half portion that is inclined upward in a rearward direction from a rear end of the center portion, and wherein a rotating center axis of the wheels is located between the first half portion and the second half portion.

2. The vacuum cleaner according to claim 1, wherein the first half portion forms a greater inclination angle with respect to the center portion than the second half portion.

3. The vacuum cleaner according to claim 1, wherein the cleaner body is configured such that an angle between the center portion and the ground is greater based on the vacuum cleaner being stationary as compared to the vacuum cleaner travelling in a forward direction.

4. The vacuum cleaner according to claim 1, wherein the cleaner body is configured to rotate about the wheels such that the center portion is inclined with respect to the ground based on the vacuum cleaner being stationary.

5. The vacuum cleaner according to claim 1, wherein the first half portion is inclined 20° with respect to the center portion, and the second half portion is inclined 17° with respect to the center portion.

6. The vacuum cleaner according to claim 1, wherein the first half portion includes a front wheel that is configured to rotate based on making contact with the ground or an object.

7. The vacuum cleaner according to claim 1, further comprising a wheel unit provided at the center portion and configured to make contact with the ground, the wheels and the wheel unit providing a three-point support based on the vacuum cleaner being stationary.

8. The vacuum cleaner according to claim 1, further comprising a dust container that is configured to receive suctioned dust and that is detachably coupled to the first half portion, the dust container being configured to be inclined based on a slope of the first half portion such that an upper end thereof is located further rearward than a lower end thereof based on the vacuum cleaner being stationary.

9. The vacuum cleaner according to claim 8, wherein the first half portion includes a seating part that defines a recessed portion for accommodating the dust container and that exposes a front part of the dust container to the outside of the cleaner body.

10. The vacuum cleaner according to claim 1, wherein, based on the vacuum cleaner travelling in a forward direction, an angle between the first half portion and the ground is less than when the vacuum cleaner is stationary, and an angle between the second half portion and the ground is greater than when the vacuum cleaner is stationary.

11. The vacuum cleaner according to claim 10, wherein a center of gravity of the cleaner body is located further rearward than a rotating center axis of the wheels.

12. The vacuum cleaner according to claim 1, wherein the center portion is maintained in a substantially parallel state with the ground while the cleaner body is travelling.

13. The vacuum cleaner according to claim 1, further comprising:

a dust container located forward of the wheels and configured to receive suctioned dust.

14. The vacuum cleaner according to claim 13, wherein the cleaner body is configured to rotate about the wheels such that a rear end of the base is closest to the ground based on the vacuum cleaner being stationary.

15. The vacuum cleaner according to claim 14, wherein the cleaner body is configured to rotate about the wheels such that a front end of the base is farthest away from the ground based on the vacuum cleaner being stationary.

16. The vacuum cleaner according to claim 13, wherein the cleaner body is configured to rotate about the wheels such that a rear end of the base becomes farther from the ground based on the vacuum cleaner starting to move in the forward direction.

17. The vacuum cleaner according to claim 13, wherein the base includes a front portion that is inclined upward in the forward direction.

* * * * *